US007754285B2

(12) United States Patent
Kanke et al.

(10) Patent No.: US 7,754,285 B2
(45) Date of Patent: Jul. 13, 2010

(54) METHOD FOR FORMING A PLURALITY OF COATING LAYERS ON A CONTINUOUS SUBSTRATE

(75) Inventors: Shin Kanke, Shizuoka-ken (JP); Hiromu Andou, Shizuoka-ken (JP); Hideaki Kominami, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/955,724

(22) Filed: Dec. 13, 2007

(65) Prior Publication Data

US 2008/0095947 A1 Apr. 24, 2008

Related U.S. Application Data

(62) Division of application No. 10/219,812, filed on Aug. 16, 2002, now Pat. No. 7,329,437.

(30) Foreign Application Priority Data

| | | |
|---|---|---|
| Aug. 17, 2001 | (JP) | 2001-247991 |
| Aug. 17, 2001 | (JP) | 2001-247992 |
| Aug. 17, 2001 | (JP) | 2001-248011 |
| Aug. 17, 2001 | (JP) | 2001-248012 |
| Sep. 7, 2001 | (JP) | 2001-271474 |
| Sep. 28, 2001 | (JP) | 2001-298827 |

(51) Int. Cl.

| | |
|---|---|
| ***B05D 1/36*** | (2006.01) |
| ***B05D 1/38*** | (2006.01) |
| ***B05D 7/02*** | (2006.01) |
| ***B05D 7/14*** | (2006.01) |

(52) U.S. Cl. ..... 427/258

(58) Field of Classification Search ..... 427/258
See application file for complete search history.

(56) References Cited

U.S. PATENT DOCUMENTS

| | | | | |
|---|---|---|---|---|
| 2,066,780 | A | | 1/1937 | Holt |
| 2,598,733 | A | | 6/1952 | Warner |
| 2,729,192 | A | | 1/1956 | Warner |
| 3,084,663 | A | | 4/1963 | Warner |
| 3,424,126 | A | | 1/1969 | Mahoney |
| 4,263,870 | A | | 4/1981 | Saito et al. |
| 4,340,621 | A | | 7/1982 | Matsumiya et al. |
| 4,456,637 | A | | 6/1984 | Takeda et al. |
| 4,521,459 | A | | 6/1985 | Takeda |
| 4,839,201 | A | | 6/1989 | Rantanen et al. |
| 4,848,268 | A | | 7/1989 | Sollinger et al. |
| 4,869,933 | A | | 9/1989 | Sollinger et al. |
| 4,921,729 | A | | 5/1990 | Kaneko et al. |
| 5,083,527 | A | | 1/1992 | Naruse |
| 5,190,794 | A | * | 3/1993 | Yoshino et al. ..... 427/162 |
| 5,306,523 | A | | 4/1994 | Shibata |
| 5,505,995 | A | | 4/1996 | Leonard |
| 5,582,870 | A | | 12/1996 | Shigesada et al. |
| 5,599,393 | A | | 2/1997 | Elvidge et al. |
| 5,650,010 | A | | 7/1997 | Rantanen et al. |
| 5,665,163 | A | | 9/1997 | Li et al. |
| 5,741,549 | A | | 4/1998 | Maier et al. |
| 5,820,935 | A | | 10/1998 | Kashiwabara et al. |
| 5,843,529 | A | | 12/1998 | Peiffer |
| 5,858,090 | A | | 1/1999 | Gottwald |
| 5,868,844 | A | | 2/1999 | Kato et al. |
| 6,024,797 | A | | 2/2000 | Li et al. |
| 6,579,368 | B1 | | 6/2003 | Kohl et al. |
| 2003/0049379 | A1 | | 3/2003 | Kanke et al. |
| 2003/0217692 | A1 | | 11/2003 | Kanke et al. |

FOREIGN PATENT DOCUMENTS

| | | | |
|---|---|---|---|
| DE | 195 18 132 | C1 | 2/1997 |
| DE | 197 16 647 | A1 | 10/1998 |
| EP | 0 581 962 | A1 | 2/1994 |
| EP | 1 070 550 | A2 | 1/2001 |
| GB | 1 585 217 | | 2/1981 |
| JP | 58-4589 | | 1/1983 |
| JP | 58-004589 | | 1/1983 |
| JP | 59-189967 | A | 10/1984 |
| JP | 6-007816 | | 3/1994 |
| JP | 6-7816 | | 3/1994 |
| JP | 8-84953 | | 4/1996 |
| JP | 11243042 | A | 9/1999 |
| JP | 2000-107665 | | 4/2000 |
| JP | 2000-126673 | | 5/2000 |
| JP | 2000185254 | A | 7/2000 |
| JP | 2000262954 | A | 9/2000 |
| JP | 2001-147521 | A | 5/2001 |
| WO | 90/01178 | A1 | 2/1990 |

OTHER PUBLICATIONS

Abstract JP 3503576 T, Aug. 8, 1991, also published as WO 90/01178A1.

* cited by examiner

*Primary Examiner*—William Phillip Fletcher, III
(74) *Attorney, Agent, or Firm*—Sughrue Mion, PLLC

(57) ABSTRACT

A coating method for forming a plurality of layers over a continuously traveling band-shaped substrate, including the steps of: forming a lower layer by coating a first coating liquid, and forming an upper layer over the lower layer by coating a second coating liquid including a composition substantially identical to or different from a composition of the first coating liquid; and applying an undercoating liquid to an uncoated portion before coating the second coating liquid when the uncoated portion is generated during forming the lower layer.

12 Claims, 42 Drawing Sheets

METHOD FOR FORMING A PLURALITY OF COATING LAYERS ON A CONTINUOUS SUBSTRATE

CROSS-REFERENCE TO RELATED APPLICATIONS

This is a Divisional of application Ser. No. 10/219,812 filed Aug. 16, 2002, issued as U.S. Pat. No. 7,329,437; the entire disclosure of the prior application is hereby incorporated by reference.

BACKGROUND OF THE INVENTION

1. Field of the Invention

The present invention relates to a coating apparatus and a coating method. More particularly, the invention relates to a coating apparatus and a coating method, which can coat a web stably with a coating liquid by a bar coater even when the web travels at a high speed.

The invention further relates to a coating apparatus and a coating method, which can be suitably used for forming a coating film of a laminated structure having two or more layers, over a band-shaped object to be coated.

The invention further relates to a rod coating apparatus and, more particularly, to a rod coating apparatus and a rod coating method for coating a web such as a band-shaped metal sheet with a coating liquid by transferring it using a coating rod.

The invention further relates to a coating apparatus and a coating method which can continuously coat stably for a long time when a plurality of layers are to be formed by coating a long band-shaped substrate stably and continuously for a long time with two or more coating liquids.

2. Description of the Related Art

A planographic printing plate is usually manufactured by graining at least one face of a web of pure aluminum or aluminum alloy, by forming an anodized film, if necessary, on that face to form a support web, and by coating the grained face of the support web with a photosensitive layer forming liquid or a heat-sensitive layer forming liquid and drying it to form a photosensitive or a heat-sensitive engraving face.

In order to coat a band-shaped web such as the support web with a coating liquid such as a photosensitive layer forming liquid or a heat-sensitive layer forming liquid, it is customary to use a bar coater.

The bar coater may be constructed to have a compact coating head, and the bar coater is widely used for applying the photosensitive layer forming liquid and the heat-sensitive layer forming liquid.

The bar coater of the prior art generally has a bar and a coating portion mounted thereon. The bar rotates in the same or opposite direction as or to the traveling direction of the web while touching the lower face of a continuously traveling web. The coating portion discharges, at the traveling time of the web, a coating liquid to the upstream side of the bar with respect to the traveling direction of the web to form a coating liquid pool thereby to coat the lower face of the web with the coating liquid. In the following, the upstream side or the downstream side with respect to the traveling direction of the web will be simply referred to as the "upstream" or the "downstream".

As the bar coater, moreover, there is an SLB type bar coater (Japanese Utility Model No. 2054836). This SLB type coater is provided with a first weir plate which is disposed upstream of and adjacent to the bar and formed to have a smaller thickness downstream with respect to the traveling direction of the web. The first weir plate is bent at its upper end portion toward the bar and has a flat face of a length from 0.1 to 1 mm at its top portion. There is another PBS type bar coater (Japanese Patent Application Publication No. 58-004589). This PBS bar coater is provided with a first weir plate formed to have a smaller thickness downstream at its upper end portion, a bar and a second weir plate disposed downstream of the bar.

When the traveling speed of the support web is raised, however, the air to run following the support web, i.e., an entrained air film or a film of entrained air is formed over the surface of the support web.

In either of the SLB bar coater or the PBS bar coater, the entrained air film, if formed over the surface of the support web, is carried by the support web to a coating liquid pool in the coating portion. In the coated film of the coating liquid formed on the surface of the support web, moreover, a film runout, a ripple streak and/or a coating heterogeneity occurs so that the coating of the coating liquid cannot be stabilized.

Next, the printing plate layer may have a multi-layered structure having two or more layers. Over the surface of the printing plate layer, moreover, an anti-oxidant layer of polyvinyl alcohol may be formed.

A bar coater is used when a printing plate layer forming liquid is applied to form the printing plate layer having the multi-layered structure. When second and subsequent layers are to be formed, the bar of the bar coater may come into contact with the first layer to scrape off and damage the first layer, or the coating film of the first layer scraped off by the bar may migrate into the printing plate layer forming liquid returned from a return line in the bar coater thereby to contaminate the same. During forming the first layer, moreover, the bar may touch the grained face of the support web thereby to damage the grained face.

Next, the planographic printing plate is manufactured by forming a visible exposure type or a laser exposure type printing plate layer on the roughed surface of the support web anodized, if necessary. Moreover, the printing plate layer is usually formed by coating the roughed surface of the support web with either a photosensitive layer forming liquid containing a photosensitive resin or a heat-sensitive layer forming liquid containing a thermally polymerizable resin and by drying the support web.

In the recent years, there has been studied the planographic printing plate which has a printing plate layer of a multi-layered structure having two or more layers. This planographic printing plate can be exemplified by the visible light exposure type planographic printing plate having two or more photosensitive layers or the laser exposure type planographic printing plate with a heat-sensitive layer as the first layer and a photo-thermal conversion layer as the second layer.

When all the layers of the multi-layered printing plate layer are formed by the bar coater, the bar of the bar coater may come into contact with the first layer to scrape off and damage the first layer when the second and subsequent layers are to be formed. Moreover, the coating film of the first layer scraped off by the bar may migrate and contaminate the photosensitive layer forming liquid or the heat-sensitive layer forming liquid returned from the return line of the bar coater. Thus, it has been desired that the planographic printing plate having the printing plate layer of the laminated structure can be stably formed by using the bar coater.

Next, as a rod coating apparatus for coating a web face with a coating liquid, there is a method for coating the web with a coating liquid at a coating amount adjusted with a coating rod, by bringing the coating rod contact with the web. This rod coating method is widely used because it is featured by forming a thin coating layer with an extremely simple construction and at a high speed.

This rod coating method is as disclosed, for example, in Japanese Patent Application Laid-Open (JP-A) No. 53-22543 or JP-A No. 59-123568. Of this method, the coating rod (as will be shortly referred to as the "rod") is brought into contact with the traveling web, and a coating liquid pool is formed just before the contact portion of the web and the rod. The coating liquid in the pool is scooped up and transferred to the web by the rod forced to rotate in the traveling direction of the web.

There still remains a defect that the web is scrubbed unless the rotating speed of the rod and the traveling speed of the web are well synchronized although the rod is forced to rotate into contact with the web.

Therefore, a coating apparatus was proposed as referred to JP-A 12-107665. In the apparatus, the rod is forced to rotate at a rotating speed of 10% or higher of that at the coating time or at the following time and in which the transmission of the forced rotating force is interrupted after the rod made contact with the web, to cause the rod to follow the web and to rotate.

In the practice, however, it takes a constant time to complete the transmission interruption actually after a command to release the interruption of the rotating force was issued from a controller. Therefore, it takes a long time for the rod to start to touch and follow the web. As a result, the time period, for which the traveling speed of the web and the rotating speed of the rod are not synchronized, is elongated to restrict the improvement in the production efficiency.

If the resistance to the rod rotation is raised by disturbances and the rod stops its rotation, the web will be continuously scratched.

Next, in the manufacture of the planographic printing plate, there is included a procedure to form an anti-oxidant layer on the surface of the printing plate layer. In the planographic printing plate having multiple printing plate layers or the planographic printing plate having the anti-oxidant layer over the printing plate layer, it is cursory to form every layers one by one. These individual layers are usually formed by applying the coating liquids such as a photosensitive layer forming liquid containing a photosensitive resin, a heat-sensitive layer forming liquid containing a thermally polymerizable resin and an anti-oxidant layer forming liquid composed mainly of an aqueous solution of polyvinyl alcohol, and then by drying the applied liquids.

In the case where the photosensitive layer is formed by coating the support web with the photosensitive layer forming liquid and then by drying it and where the anti-oxidant layer is then formed by coating the photosensitive layer with the anti-oxidant layer forming liquid and then by drying it, an uncoated portion will be left uncoated with the photosensitive layer forming liquid for some reason. At this time, the anodized layer of the support web is exposed at the uncoated portion. The anti-oxidant forming liquid has an excellent wettability to the photosensitive layer but not always to the anodized surface film.

Despite of this wettability, the coated layer of the prior art is continuously coated with the anti-oxidant forming liquid even with the uncoated portion. In this uncoated portion, therefore, a coating defect of the anti-oxidant layer occurs to raise a sixth problem that the anti-oxidant layer forming liquid is not homogeneously applied. Even if the coating defect in the photosensitive layer forming liquid is corrected and the photosensitive layer forming liquid is normally applied, coating defect may not be eliminated once it occurs.

SUMMARY OF THE INVENTION

An objective of the invention is to provide a coating apparatus and a coating method, which can perform a stable coating without any of the various effects on a coated film even if a support web is coated by causing it to travel at a high speed.

Another objective of the invention is to provide a coating apparatus and a coating method for a bar coater, which can manufacture a planographic printing plate having a multi-layered printing plate layer without damaging a preformed layer or the grained face of a support web.

Still another objective of the invention is to provide a coating apparatus and a coating method, which can form a planographic printing plate having a multi-layered printing plate layer stably.

A further objective of the invention is to improve the production efficiency by synchronizing the traveling speed of the web and the rotating speed of the rod within a short time after the rod coming into contact with the web, thereby to cause no scratch in the web.

A further objective of the invention is to provide a coating apparatus and a coating method, which are freed, even if a lower layer is defective, from any coating defect in an upper layer to be laid over the lower layer.

According to a first aspect of the invention, there is provided a coating apparatus comprising: a forward bar rotatable about an axis in a direction following a traveling direction of a continuously traveling band-shaped web while the forward bar touches the web; a liquid feed passage for feeding a coating liquid to an area between a upstream side of the forward bar with respect to the traveling direction of the web when coating the web with the coating liquid; and a metering device arranged on a downstream side of the forward bar with respect to the traveling direction of the web, for metering the coating liquid applied to the web by the forward bar, to a predetermined coating thickness.

In the coating apparatus, the coating liquid fed from the liquid feed passage is caused to splash on the web by the forward bar so that the air can be prevented from being entrained between the web and the coating liquid. The coating liquid is applied in an excessive amount to the web by the forward bar. Therefore, the coating liquid excessively applied is metered to a predetermined coating thickness by scooping it with the metering device.

According to the above coating apparatus, therefore, the coating heterogeneity due to the air entrainment can be effectively prevented when the web is made to travel at a high speed and coated with the coating liquid.

The forward bar may take such a rotating speed that it may not be locally worn by the friction with the web. Therefore, the forward bar may be either an equal speed bar rotating at the same circumferential speed as the traveling speed of the web or a different speed bar rotating at a circumferential speed different from the traveling speed of the web.

The coating apparatus can be used not only for manufacturing the planographic printing plate but also for manufacturing a photosensitive material such as a photographic film, a magnetic recording material such as a recording tape and a painted metal sheet such as a colored iron sheet.

Therefore, the web can be exemplified not only by the support web having been described in Description of the Related Art but also a continuously band-shaped flexible substrate made of metal, plastics or paper such as a planographic printing plate web having a photosensitive or heat-sensitive engraving face on the grained side of the support web, a photographic film substrate, a baryta paper for photographic paper, a recording tape substrate, a video tape substrate or a floppy (R) disk substrate.

As the coating liquid, on the other hand, there is enumerated a solution to be used for forming a surface film by applying it to the web and by drying it. The coating liquid can be exemplified not only by the photosensitive layer forming liquid and the heat-sensitive layer forming liquid but also by an intermediate layer forming liquid for forming an intermediate layer on the surface of the support web to improve the adhesion of the printing plate layer, an aqueous solution of polyvinyl alcohol used for forming an anti-oxidant layer film for protecting the engraving face of the planographic printing plate web against oxidation, a colloidal liquid of a photosensitive agent for the photographic film to be used for forming the photosensitive layer in the photographic film, a colloidal liquid of a photosensitive agent for the printing paper to be used for forming the photosensitive layer of the photosensitive paper, a magnetic layer forming liquid to be used for forming the magnetic layer of a recording tape, a video tape or a floppy (R) disk, and various paints to be used for coating metals.

The metering device may be a later-described backward bar, to which the invention is not limited if the device has a function to scrape off the coating liquid applied to the web by the forward bar, to a specified amount.

In the first aspect of the invention, the metering device is usually provided with a backward bar arranged parallel with the forward bar rotatable in an opposite direction to the traveling direction of the web while the backward bar touches the web.

In the coating apparatus, the backward bar is disposed on the downstream side of the forward bar with respect to the traveling direction of the web and rotates in the opposite direction to that of the forward bar. The phrase "downstream with respect to the traveling direction of web" will be simply referred to as the "downstream".

Therefore, the coating liquid having been applied to the web by the forward bar is scraped off and metered to a specified amount by the backward bar.

In the first aspect of the invention, the coating apparatus further comprises a downstream liquid feed passage for feeding the coating liquid to an area between the forward bar and the backward bar and the web.

In the coating apparatus, the coating liquid is fed via the downstream liquid feed passage to between the forward bar and the backward bar and the web to form a coating liquid pool. Even if the entrained air cannot be sufficiently removed in the forward bar, therefore, it is pushed back to the upstream side by the liquid pressure of the coating liquid pool and no defect due to the entrained air is caused in the face coated with the coating liquid. Even if the coating liquid applied in the forward bar is waved perpendicularly of the traveling direction of the web by the forward bar to cause the coating heterogeneity called the "ripples", moreover, the ripples are leveled to disappear by the coating liquid pool when the web passes through the coating liquid pool. Therefore, the web can be prevented from having streaked defective portions by the ripples.

In the first aspect of the invention, the downstream liquid feed passage is usually a passage formed substantially in a slit shape parallel with the forward bar and the backward bar.

In the coating apparatus, the volume of the coating liquid pool may be made small. If the volume of the pool is small, a liquid pressure can become high in the coating liquid pool even if the flow rate of the coating liquid to be fed from the downstream liquid feed passage to the coating liquid pool is low. When the entrained air cannot be sufficiently removed in the forward bar or the ripples occur, therefore, the coating liquid can be homogeneously and effectively applied to prevent the "avalanche heterogeneity", i.e., the coating heterogeneity appeared like an avalanche, as might otherwise be caused by the entrained air.

In the first aspect of the invention, the forward bar is often a differently speeded bar for rotating at a circumferential speed different from the traveling speed of the web.

In the coating apparatus, the rotating speed of the forward bar can be set within such a range independently of the traveling speed of the web as cause no entrainment of the air in the web. Therefore, this air entrainment can be prevented over the wide range of the web traveling speed.

In the first aspect of the invention, the forward bar is usually exemplified by a smooth bar including a smooth surface.

The coating apparatus is featured in that the forward bar can be prepared at a low cost.

In the first aspect of the invention, the forward bar is usually exemplified by a grooved bar including grooves formed substantially at constant intervals on a surface thereof.

In the coating apparatus, the forward bar can splash more coating liquid so that the coating heterogeneity due to the entrained air can be prevented more effectively.

According to a second aspect of the invention, there is provided a coating method comprising: feeding a coating liquid from an upstream side with respect to a traveling direction of a continuously traveling band-shaped web, to an area between the web and a forward bar rotatable in a direction following a traveling direction of the web while the forward bar touches the web, for coating the web with the coating liquid; and metering the coating liquid applied to the web by the forward bar to a predetermined coating thickness by a metering device arranged on a downstream side of the forward bar with respect to the traveling direction of the web.

In the coating method, the coating liquid fed from the liquid feed passage is caused to splash on the web by the forward bar so that the air is prevented from being entrained between the web and the coating liquid. The coating liquid, as excessively applied to the web by the forward bar, is metered to a predetermined coating thickness by scooping it with the metering device.

Like the coating apparatus of the first aspect, therefore, the coating method can prevent the heterogeneity due to the air entrainment can also be effectively prevented.

According to a third aspect of the invention, there is provided a coating method comprising: applying a coating liquid to a continuously traveling band-shaped object by a coating liquid applicator; and metering the coating liquid applied to the object to a predetermined coating amount with a metering rod by floating the object from the metering rod adjacent to a downstream side of the coating liquid applicator with respect to a traveling direction of the object, the metering rod including a smooth surface.

In the coating method, the coating liquid applied to the object to be coated by the coating liquid applicator is brought to between the smooth surface of the metering rod and the object. By the pressure of the coating liquid brought, moreover, the object is floated from the metering rod. Therefore, the coating liquid is applied to the object without any touch and the surface of the object to be coated is not damaged by the metering rod.

The object to be coated is a continuous band-shaped flexible substrate. The object may be the planographic printing plate but also a substrate to be used for a photosensitive material or a magnetic recording material. The substrate is exemplified by the support web, the photographic film substrate, the baryta paper for photographic paper, the recording tape substrate, the video tape substrate or the floppy (R) disk substrate. The substrate further covers the painted metal sheet to be used for the painted metal sheet such as a colored iron sheet.

The coating liquid may be the various printing plate layer forming liquids, as enumerated in Description of the Related Art, but also by the photosensitive agent colloidal liquid to be used for forming the photosensitive layer for the silver salt photography, the aforementioned magnetic layer forming liquid, and the various paints to be used for the undercoating layer, the intercoating layer and the overcoating layer of the painted metal sheet.

No specific restriction is made on the coating liquid applicator if this device is used for applying the coating liquid to the object to be coated. The applicator is specifically exemplified by a liquid feed passage for feeding the coating liquid to the upstream side of the metering rod with respect to the traveling direction of the object. In the following, the "upstream side with respect to the traveling direction of the object" will be simply referred to as the "upstream", and the "downstream side with respect to the traveling direction of the object" will be simply referred to as the "downstream".

In the third aspect of the invention, the metering usually includes rotating the metering rod in the same direction and at the same circumferential speed as the traveling speed of the object.

In the coating method, the relative speed between the object to be coated and the metering rod is substantially 0. Thus, the surface of the object is not damaged even if the object happens to touch the metering rod.

In the third aspect of the invention, the metering usually includes rotating the metering rod at a circumferential speed different from the traveling speed of the object.

In the coating method, the coating amount of the coating liquid to be applied to the object can be increased/decreased by raising/lowering the circumferential speed of the metering rod or by making the rotating direction the same as or opposite to the traveling direction of the object.

In the third aspect of the invention, the coating amount of the object to be coated with the coating liquid is usually controlled by adjusting the viscosity of the coating liquid.

This coating method makes use of the fact that the adhesion of the coating liquid to the object is increased by raising the viscosity of the coating liquid and decreased by lowering the viscosity.

According to the above coating method, the coating amount of the coating liquid can be controlled without changing the circumferential speed of the metering rod or the tension to be applied to the object.

In the third aspect of the invention, the coating amount of the object with the coating liquid is usually controlled by controlling a tension to be applied to the object.

In the coating method, the coating amount of the coating liquid is decreased as the tension rises but increased as the tension lowers.

In the third aspect of the invention, the coating amount of the object with the coating liquid is usually controlled by controlling the circumferential speed of the metering rod.

In the coating method, the smaller the difference between the circumferential speed of the metering rod and the traveling speed of the object becomes, the higher the pressure in the coating liquid between the metering rod and the object becomes to increase the coating amount of the coating liquid.

The method for increasing the circumferential speed of the metering rod may be increasing the speed of the metering rod but also increasing the diameter of the metering rod.

In the third aspect of the invention, the coating amount of the object with the coating liquid is usually controlled by changing the diameter of the metering rod.

As the diameter of the metering rod is enlarged for a constant speed of the metering rod, the circumferential speed rises to increase the coating amount.

In the third aspect of the invention, the coating amount of the object with the coating liquid is usually controlled by controlling the number of revolutions of the metering rod per unit time.

In the coating apparatus, as the speed of the metering rod is increased for a constant diameter of the metering rod, the coating amount can be increased by increasing the speed of the coating rod.

In the third aspect of the invention, the coating amount of the object to be coated with the coating liquid is usually controlled by controlling a lap angle at which the object is made to run on the metering rod.

In the coating apparatus, the coating amount can be increased by reducing the lap angle, i.e., the turning angle, and can be decreased by enlarging the lap angle.

In the third aspect of the invention, the object is usually exemplified by a support web for a planographic printing plate prepared by graining at least one face of an aluminum web or a continuous band-shaped aluminum sheet.

The coating method is an example in which the coating method of the third aspect of the invention is applied to the manufacture of the planographic printing plate.

According to the coating method, the face of the grained side of the support web or the face on which the layer formed is not damaged by the rod of the rod coater so that a non-defective planographic printing plate can be manufactured.

In the third aspect of the invention, an anodized coating film is usually formed on the grained face of the support web.

In the coating method, the anodized film formed on the side of the support web is coated with the coating liquid so that the engraving plate prepared by the method for the planographic printing plate is excellent in the wear resistance at the non-image portion.

According to a fourth aspect of the invention, there is provided a coating apparatus comprising: a coating liquid applying device for applying a coating liquid to a continuously traveling band-shaped object; and a metering rod made of a rod-shaped member adjacent to a downstream side of the coating liquid applicator with respect to a traveling direction of the object, the metering rod including a smooth surface, for metering the coating liquid applied to the object by the coating liquid applying device, to a predetermined coating amount while the object floating from the surface.

In the coating apparatus, the coating liquid applied to the object by the coating liquid applicator is brought to an area between the smooth surface of the metering rod and the object and the object is floated from the metering rod. Therefore, the coating liquid is applied to the object without being touched and the surface of the object is not damaged by the metering rod.

The object to be coated, the coating liquid and the coating liquid applicator in the coating apparatus are identical to those having been described in connection with the method of the third aspect of the invention.

In the fourth aspect of the invention, the coating apparatus usually further comprises: an auxiliary metering rod including a smooth surface and positioned on the downstream side of the metering rod with respect to the traveling direction of the object; and an auxiliary coating liquid feeding device for feeding the coating liquid to an area between the metering rod and the auxiliary metering rod.

When the object to be coated is caused to travel at a high speed, the gas entrained by the surface of the object may be brought into the coating apparatus.

In the coating apparatus, however, the entrained air is pushed back upstream by the pressure of the coating liquid discharged from the coating liquid discharge unit, so that the coating heterogeneity due to the air entrainment can be effectively prevented.

According to a fifth aspect of the invention, there is provided a coating apparatus for forming a plurality of layers over a continuously traveling band-shaped object, comprising: a bar coater including a bar for coating the object with a first layer forming liquid thereby to form a first layer, the bar including corrugations formed along a circumference thereof and rotatable in a direction following a traveling direction of the object while the bar touches the object; and a non-contact coating device positioned on a downstream side of the bar coater with respect to the traveling direction of the object, for coating the first layer with a second layer forming liquid including a composition identical to or different from a composition of the first layer forming liquid, to form second and subsequent layers.

In the coating apparatus, the rotating direction of the bar in the bar coater is in the same direction as the traveling direction of the object to be coated and the bar has a low speed relative to that of the object. Even if the object is grained like the support web and subjected to various surface treatments, therefore, the grained face or the surface-treated layer will substantially not be scrubbed or damaged with the grooves formed on the surface of the bar.

Moreover, although the grained surface of the support web is largely roughed, appropriate contactability of the first layer can be ensured by coating the surface with the layer forming liquid by the bar coater.

Moreover, the non-contact coating device is used for forming the second and subsequent layers. It is, therefore, possible to effectively solve the problems that the first layer is scratched and damaged during forming the second layer and that the chips of the first layer is caused by the scratching action to migrate into and contaminate the second layer forming liquid.

The coating apparatus can be suitably used not only for manufacturing the planographic printing plate but also for manufacturing the photosensitive material such as the photosensitive film, the movie film or the photographic paper, for manufacturing the magnetic recording material such as the recording tape, the video tape or the floppy (R) disk, and for manufacturing the product, in which two or more layers are formed over the substrate of a metal sheet, a polyester resin film or an acetate resin film such as the colored iron sheet or the painted metal sheet.

In the bar of the bar coater, circumferential grooves are formed in the surface at a constant interval or at an indefinite interval. In the bar coater, the layer forming liquid is fed to the upstream side of the bar. Moreover, the coating liquid flows downstream through the clearances formed between the grooves formed in the bar and the object and is applied to the object to be coated.

The bar may be a grooved bar prepared by forming the circumferential grooves in a metal rod having a circular section by a rolling, cutting or laser-working method, or a wire bar having a wire wound helically on the metal rod.

According to a sixth aspect of the invention, there is provided a coating apparatus for forming a plurality of layers over a continuously traveling band-shaped object, comprising: a first layer rod coater including a rod, the rod including a flat surface, rotatable without touching the object for metering and coating the object with a first layer forming liquid thereby to form a first layer; and a non-contact coating device positioned on a downstream side of the first layer rod coater with respect to a traveling direction of the object, for coating a second forming liquid including a composition identical to or different from a composition of the first layer forming liquid, to form second and subsequent layers on the first layer.

The first layer rod coater belonging to the coating apparatus uses the rod including the smooth surface, as has been described hereinbefore, the layer forming liquid enters, when it is applied, the clearance between the object to be coated and the rod. Thus, the object is floated from the rod. Moreover, the layer forming liquid is metered by the clearance between the rod and the object and is applied to the object.

In the first layer rod coater, therefore, the surface of the object is not damaged by the rod coater, and the planographic printing plate, the photosensitive material, the magnetic recording material and the painted metal sheet can be manufactured with excellent qualities.

In the sixth aspect of the invention, the non-contact coating device is usually exemplified by a bar coater similar to the first layer bar coater.

In the coating apparatus, the rod coater to be used as the non-contact coating device includes a construction similar to that of the first layer rod coater.

The coating apparatus may be the coating apparatus provided with the bar coater at the first stage and the rod coater at the second stage but also the coating apparatus provided with the first layer rod coater at the first stage and the rod coater at the second stage.

In the sixth aspect of the invention, the non-contact coating device is usually exemplified by a slide bead coater comprising a discharge slit for discharging the second layer forming liquid in a band shape; and a slide face for allowing the second layer forming liquid discharged from the discharge slit to flow thereon, wherein the slide face is positioned at its leading end in a vicinity of a traveling plane acting as a traveling path of the object, and wherein the slide bead coater coats the first layer with the second layer forming liquid by forming a layer forming liquid bridge between the leading end of the slide face and the first layer formed on the object.

The coating apparatus is an example using the slide bead coater as the non-contact coating device.

The slide bead coater applies the layer forming liquid by forming the layer forming liquid bridge so that the coater can form the second layer without touching the first layer. During forming the second layer, therefore, the first layer will not be scratched and damaged.

In the sixth aspect of the invention, the non-contact coating device is usually exemplified by a curtain coater arranged over the traveling plane for coating the first layer formed on the object, with the second layer forming liquid by causing the second layer forming liquid to flow in a curtain shape.

The coating apparatus is an example using the curtain coater as the non-contact coating device.

The curtain coater applies the second layer forming liquid to the first layer by causing it to fall in the curtain shape so that the coater can coat without touching the first layer. During forming the second layer, therefore, the first layer will not be scratched and damaged.

In the sixth aspect of the invention, the non-contact coating device is usually exemplified by an extrusion coater including a slit layer forming liquid discharge port opened in a vicinity of and toward a traveling plane of the object for discharging the second layer forming liquid toward the first layer formed on the object.

The coating apparatus is an example using the extrusion coater as the non-contact coating device.

The extrusion coater discharges and applies the second layer forming liquid toward the first layer so that it can form the second and subsequent layers without touching the first layer.

In the sixth aspect of the invention, the coating apparatus further comprises a first layer drying device disposed between the bar coater and the non-contact coating device for drying the first layer.

According to the coating apparatus, the first layer is dried before the second layer is formed, so that the second layer can be formed with the dried first layer.

In the sixth aspect of the invention, the coating apparatus further comprises a first layer drying device disposed between the first layer rod coater and the non-contact coating device for drying the first layer.

In the coating apparatus, the first layer is dried before the second layer is formed, as in the coating apparatus including the first layer drier between the bar coater and the non-contact coating device. The second layer can be formed with the dried first layer.

In the sixth aspect of the invention, the coating apparatus further comprises a second-layer drying device disposed downstream of the non-contact coating device for drying the layer formed by the non-contact coating device.

In the coating apparatus, after the second layer was formed and dried in the second layer drier, an upper layer can be formed, or the procedure can be transferred to a next step.

According to a seventh aspect of the invention, there is provided a coating method for forming a plurality of layers, comprising the step of: coating a continuously traveling band-shaped object with a layer forming liquid to form a first layer by a bar coater including a bar, the bar including corrugations formed along a circumference thereof and rotatable in a direction following a traveling direction of the object while the bar touches the object; and coating the first layer with a second layer forming liquid including a composition substantially identical to or different from a composition of the first layer forming liquid, to form second and subsequent layers by a non-contact coating device.

The coating method has advantages similar to those which have been described in connection with the coating apparatus of the sixth aspect.

According to an eighth aspect of the invention, there is provided a coating method for forming a plurality of layers, comprising the steps of: coating a continuously traveling band-shaped object with a layer forming liquid to form a first layer, by a first layer rod coater including a rod, the rod including a smooth surface rotatable without touching the object when applying the layer forming liquid; and forming second and subsequent layers on the first layer with a second layer forming liquid including a composition substantially identical to or different from a composition of the first layer forming liquid by a non-contact coating device.

The coating method has advantages similar to those described in connection with the coating apparatus of the sixth aspect.

According to a ninth aspect of the invention, there is provided a coating apparatus for forming a plurality of layers over a continuously traveling band-shaped object, comprising: a bar coater for coating the object with a layer forming liquid to form a first layer; and a non-contact coating device positioned on a downstream side of the bar coater with respect to a traveling direction of the object, for coating a second layer forming liquid including a composition substantially identical to or different from a composition of the first layer forming liquid, to form second and subsequent layers on the first layer.

In the coating apparatus, the bar coater is used for forming the first layer. Even if the object to be coated has an irregular surface such as the roughed surface of the planographic printing plate, it is possible to form the first layer which is excellent in the surface smoothness and in the adhesion to the object.

Moreover, the non-contact coating device is used for forming the second and subsequent layers. It is, therefore, possible to effectively solve the problems that the first layer is scratched and damaged during forming the second layer and that the chips of the first layer is caused by the scratching action to migrate into and contaminate the second layer forming liquid.

The bar coater may be one usually used in the prior art. The bar in the bar coater may be the smooth bar having the smooth surface, the grooved bar having the grooves in the circumferential direction at a constant interval, or the wire bar having a metal thin wire wound thereon.

The non-contact coating device may be a slide hopper coating device, a curtain coating device or an extrusion coating device, as will be described hereinafter. However, the non-contact coating device should not be limited thereto if the device can apply the second layer forming liquid without touching the object.

The coating apparatus can be suitably used not only for manufacturing the planographic printing plate but also for manufacturing the photosensitive material such as the photosensitive film, the movie film or the photographic paper, for manufacturing the magnetic recording material such as the recording tape, the video tape or the floppy (R) disk, and for manufacturing the painted metal sheet such as the colored steel sheet.

The object to be coated may be the continuous band-shaped flexible substrate. Specifically, the various substrates can be used as the objects in the coating method of the third aspect of the invention.

The layer to be formed on the object to be coated may be the photosensitive layer or the heat-sensitive layer in the planographic printing plate but also the anti-halation layer or the photosensitive layer in the photosensitive material, the magnetic layer in the magnetic recording material, or the undercoating, intercoating or overcoating layers in the painted metal sheet.

The layer forming liquid and the second layer forming liquid are the liquid used for forming the anti-halation layer, the photosensitive layer, the magnetic layer, the undercoating layer, the intercoating layer or the overcoating layer by applying the liquid to the object to be coated and by drying the liquid. As the liquids, more specifically, there can be enumerated the photosensitive layer forming liquid, the heat-sensitive layer and the photo-thermal conversion layer forming liquid in the planographic printing plate, the photosensitive agent colloidal liquid in the photosensitive material, the magnetic layer forming liquid to be used for forming the magnetic layer in the magnetic recording material, and the various paints to be used in the undercoating layer, the intercoating layer and the overcoating layer in the painted metal sheet.

Both the layer forming liquid and the second layer forming liquid can be selected from the enumerated liquid forming liquids and may have identical or different compositions.

The first layer may be formed either directly on the object to be coated or after the object was subjected to a suitable surface treatment.

The surface treatment may be a treatment for improving the adhesion between the object to be coated and the first layer. When the object to be coated is a planographic printing plate substrate, more specifically, the surface treatment may be a silicate treatment with an aqueous solution of alkaline silicate, a silane treatment with an organic silane, and a hydrophilic compound treatment with a dilute solution of a hydrophilic compound having either a hydrophilic vinyl polymer having an acid group such as a carboxyl group or a sulfon group, or a hydrophilic group such as $NH_2$ group or —COOH group.

In the ninth aspect of the invention, the non-contact coating device is usually exemplified by a slide hopper coater including: a discharge slit for discharging the second layer forming liquid in a band shape; and a slide face for allowing the second layer forming liquid discharged from the discharge slit to flow thereon. The slide face is positioned at its leading end in the vicinity of a traveling plane acting as a traveling path of the object, and the slide hopper coater coats the first layer with the second layer forming liquid by forming a layer forming liquid bridge between the leading end of the slide face and the first layer formed on the object.

The coating apparatus is an example using the slide hopper coater as the non-contact coating device.

The slide hopper coater forms the second and subsequent layers, as described hereinbefore, by applying the layer forming liquid with the layer forming liquid bridge being formed between it and the first layer, so that those layers can be formed without touching the first layer. Therefore, the first layer is not scratched and damaged during forming the second layer.

In the ninth aspect of the invention, the non-contact coating device may be of a curtain type and arranged over the traveling plane for coating the first layer formed on the object, with the second layer forming liquid by causing the second layer forming liquid to flow in a curtain shape.

The coating apparatus is an example using the curtain coater as the non-contact coating device.

The curtain coater coats the first layer with the second layer forming liquid by causing the liquid to flow in the curtain shape, as described hereinbefore, so that the coating operation can be done without touching the first layer. Therefore, the first layer is not scratched and damaged during forming the second layer.

In the ninth aspect of the invention, the non-contact coating device may be usually exemplified by an extrusion type having a slit layer forming liquid discharge port opened in the vicinity of and toward the traveling plane for discharging the second layer forming liquid toward the first layer formed on the object.

The coating apparatus is an example using the extrusion coater as the non-contact coating device.

The extrusion coater coats the first layer by discharging the second layer forming liquid to the first layer so that the coater can form the second and subsequent layers without touching the first layer.

In the ninth aspect of the invention, the coating apparatus may further comprise a first layer drying device disposed between the bar coater and the non-contact coating device for drying the first layer.

According the above coating apparatus, the first layer is dried before the second layer is formed, so that the second layer can be formed with drying the first layer.

In the ninth aspect of the invention, the object to be coated is usually exemplified by a support web used for a planographic printing plate.

The coating apparatus is an example, in which the coating apparatus of the invention is applied to the manufacture of the planographic printing plate having a printing plate layer of the multi-layered structure of two or more layers.

According to the above coating apparatus, defects such as the flaws or streaks are not formed in any layer in the printing plate layer, so that an excellent planographic printing plate can be manufactured.

In the ninth aspect of the invention, at least one of the bar coater and the non-contact coating device usually forms a photosensitive layer.

According to the coating apparatus, it is possible to manufacture the planographic printing plate having a plurality of layers, at least one of which is a photosensitive layer.

In the ninth aspect of the invention, it is usual that the bar coater forms a heat-sensitive layer whereas the non-contact coating device forms a photo-thermal conversion layer.

According to the coating apparatus, there is manufactured the laser exposure type planographic printing plate which has the photo-thermal conversion layer over the heat-sensitive layer.

When the planographic printing plate is irradiated with a laser beam, this beam is converted into a heat by the photo-thermal conversion layer and the underlying heat-sensitive layer is made soluble to the developing liquid or not thereby to form the printing image.

According to a tenth aspect of the invention, there is provided a coating method for forming a plurality of layers, comprising the steps of: coating a continuously traveling band-shaped object with a layer forming liquid to form a first layer by a bar coater; and forming second and subsequent layers by coating the first layer with a second layer forming liquid including a composition substantially identical to or different from a composition of the first layer forming liquid by a non-contact coating device.

The coating method has advantages similar to those described in connection with the ninth aspect.

According to an eleventh aspect of the invention, there is provided a rod coating apparatus comprising a lift device for bringing a coating rod close to and away from a traveling web, to coat the web with a coating liquid in a liquid pool provided between the coating rod and the web, by getting the coating rod touching the web to be driven by the travelling web to rotate, the apparatus comprises: a drive device for generating a rotating force; and a clutch disposed in a transmission unit for transmitting/interrupting the rotating force of the drive device to/from the coating rod, to rotate idly thereby to interrupt the rotating force from the drive device when the coating rod touches the web and rotates.

In the construction, the web is coated with the coating liquid in the liquid pool formed in the coating rod and the web by bringing the coating rod into contact with the traveling web to cause the coating rod to rotate in the following manner.

In this coating rod, the rotating force of the drive device disposed in the transmission device is transmitted to or interrupted from the coating rod such that the coating rod is forced to rotate in the traveling direction of the web before the rod touches the web. Thus, the coating rod will not scratch the web when the rod touches the web.

This clutch mechanically rotates idly to interrupt the rotating force of the drive device as the coating rod comes into contact with the web to have a high (following) rotating speed. As compared with the coating apparatus of the prior art, therefore, the rotating force from the drive device is interrupted on real time so that the traveling speed of the web and the rotating speed of the coating rod are synchronized for a short time.

Even if the web is caused to travel at a high speed, therefore, the web is not scratched while being coated with the coating rod.

Moreover, the lift brings the coating rod close to or away from the web. Therefore, the coating rod can be moved away from the web before the joint portion of the web passes the rod, and close to the web after the joint portion passes the rod.

As a result, the joint portion of the webs is prevented from impinging against the coating rod and the coating rod is not disturbed to cause fine vibrations. Therefore, the bubbles are not entrained by the coating liquid to eliminate the coating defects that the bubbles might otherwise be transferred to the coated film face of the web and that the bubbles might otherwise reside in the coating liquid pool to cause streaks in the coated film face of the web.

In the eleventh aspect of the invention, the clutch often comprises a shaft to which the rotating force of the drive device is transmitted; an outer ring arranged on a circumference of the shaft and connected to the coating rod; and a roller device arranged between the shaft and the outer ring for transmitting the rotating force of the shaft to the outer ring and for rotating the outer ring idly when the outer ring takes a higher rotating speed than a rotating speed of the shaft.

With the construction, when the coating rod touches the web and it takes a higher rotating speed than that at its shaft, the outer ring arranged on the circumference of the shaft is caused to rotate idly by the roller device thereby to interrupt the rotating force to be transmitted from the shaft through the roller device to the coating rod, so that the coating rod instantly follows the web and rotates.

According to a twelfth aspect of the invention, there is provided a rod coating method for coating a traveling web with a coating liquid in a liquid pool formed between a coating rod and the web, by getting the rod touching the web to be driven to rotate, comprising the steps of: getting the coating rod touching the web while the rod rotates following a travelling direction of the web; and interrupting a rotating force of a driving device by rotating a clutch idly, the clutch transmitting and interrupting the rotating force of the driving device, for driving the coating rod to rotate at a travelling speed of the web.

According to a thirteenth aspect of the invention, there is provided a coating apparatus for forming a plurality of layers over a continuously traveling band-shaped substrate, comprising: an upstream coating device for applying a first coating liquid, to form a lower layer; a downstream coating device positioned on a downstream side of an upstream side coating device with respect to the traveling direction of the substrate for coating the lower layer with a second coating liquid including a composition substantially identical to or different from a composition of the first coating liquid, to form an upper layer; and an undercoating liquid applying device for applying an undercoating liquid to an uncoated portion, which the coating liquid is not coated when forming the lower layer, before the uncoated portion reaches the downstream coating device.

In the coating apparatus, when a coating defect occurs at the lower layer forming time and an uncoated portion is left, this uncoated portion is coated with the undercoating liquid by the undercoating liquid applying device. Next, the uncoated portion passes through the downstream coating device but is already coated with the undercoating liquid, so that the second coating liquid well adheres.

In the coating apparatus, therefor, even if the coating defect occurs in the upstream coating device to leave the uncoated portion, the coating defect due to the uncoated portion does not occur when the second coating liquid is applied to the lower layer.

No specific restriction is made on the substrate, if the substrate is an article of a flexible sheet or film. It is possible to use the various substrates enumerated as the coated articles of the method of the third aspect of the invention. The substrate may be subjected to the various treatments such as the graining treatment or the anodizing treatment in the support web.

The lower layer may be formed either directly on the substrate or on the layer laminated over the second layer formed on the substrate.

The first coating liquid and the second coating liquid may be the photosensitive layer forming liquid, the heat-sensitive layer forming liquid and the anti-oxidant layer forming liquid, as have been described in Description of the Related Art, but also the photosensitive agent emulsion used for the photosensitive recording material and for forming the photosensitive layer of the photosensitive paper, the anti-halation layer forming liquid used for forming the anti-halation layer of the photographic recording material, the magnetic recording layer forming liquid for forming the magnetic recording layer in the magnetic recording material, and the aforementioned various paints. However, these materials are not limitative, if the solutions or suspensions can form the layers by applying them to the substrate and by drying them. The first coating liquid and the second coating liquid may have identical or different compositions.

The upstream coating device may be the coater often used for coating the substrate with the solutions or suspensions enumerated as the first coating liquid. This coating device may be the bar coater using the grooved wire having the circumferential grooves formed in the surface or the wire bar having the thin metal wire wound thereon but also the non-contact coating device for coating the substrate with the coating liquid without touching. The non-contact coating device is such as the rod coater, the slide bead coater, the curtain coater or the extrusion coater using the coating rod having the smooth surface.

The downstream coating device may be the various ones described in connection with the upstream coating device, but the non-contact coating device is often used because of not damaging the lower layer.

As the undercoating liquid to be applied by the undercoating liquid applying device, there can be enumerated a liquid for improving the wettability between the substrate and the second coating liquid.

The undercoating liquid is often used for causing the coating defect such as the streaks or the liquid runout when the second coating liquid is applied to the undercoating liquid, if this undercoating liquid has a surface tension equal to or higher than that of the second coating liquid.

The undercoating liquid may be, as will be described hereinafter, the liquid containing the main solvent of the second coating liquid as its main component, or a solution of a surface active agent. The solvent of the surface active agent solution will often be the main solvent of the second coating liquid. Especially when the main solvent of the second coating liquid is water, the pre-wet portion gets homogeneously wet and spreads in the uncoated portion if an aqueous solution containing a surface active agent is used as the undercoating liquid. The density of the surface active agent in the surface active agent solution is preferred to be a micellar density or higher. When the second coating liquid contains the surface active agent, the undercoating liquid often contains a similar surface active agent.

The amount of applying the undercoating liquid in the undercoating liquid applying device can be determined of the width of the substrate and the composition of the undercoating liquid. The amount of 6 cc/$m^2$ or more of the undercoating liquid of water and the amount of 2 cc/$m^2$ of the undercoating liquid of an organic solvent are preferable because they can be applied to the whole face of the substrate.

The application of the undercoating liquid is caused to wet the coating face of the substrate by some method, which may be applying the undercoating liquid but also dripping or injecting the liquid from an injector.

The undercoating liquid applying device may be one for applying the undercoating liquid to the substrate.

The undercoating liquid applying device may be an undercoating liquid applying head for extruding the undercoating liquid in a band shape toward the substrate and a coating bar such as a grooved bar with circumferential grooves formed on its surface or a wire bar with a thin metal wire wound thereon.

The undercoating liquid applying head may be a slide bead coater having a construction substantially similar to that of the aforementioned slide bead coater, a curtain coater having a construction substantially similar to that of the aforementioned curtain coater, or an extrusion coater having a construction substantially similar to that of the aforementioned extrusion coater.

An alternative undercoating liquid applying device may be an undercoating liquid injector for applying the undercoating liquid in droplets to the surface of the substrate.

In the thirteenth aspect of the invention, it is usual that the undercoating liquid applying device stops the application of the undercoating liquid when the uncoated portion no longer exists.

In the coating apparatus, the application of the undercoating liquid is interrupted at the instant when the application of the undercoating liquid to the lower layer becomes unnecessary, and the undercoating liquid is not wasted. There is solved the problem that the second coating liquid is diluted with the undercoating liquid to elongate the time for drying the coating.

In the thirteenth aspect of the invention, it is usual that the upstream coating device leaves the coated face if the uncoated portion exists, and that the undercoating liquid applying device applies the undercoating liquid when the upstream coating device leaves the surface of the substrate.

In the coating apparatus of the prior art, the upstream coating device is constructed to leave the coated face of the substrate so as to recover the coating defect of the upstream coating device while forming the lower layer.

In the coating apparatus, the undercoating liquid applying device is started by using the separation of the upstream coating device and the components of the coating apparatus of the prior art can be used nearly without significant changes. It is, therefore, unnecessary to provide the uncoated portion detecting device additionally for detecting the occurrence of the uncoated portion to start the undercoating liquid applying device.

In the thirteenth aspect of the invention, the coating apparatus usually further comprises an uncoated portion detecting device for detecting that the uncoated portion appears at the time of forming the lower layer, and the undercoating liquid applying device applies the undercoating liquid to the uncoated portion when the uncoated portion detecting device detects the uncoated portion.

In the coating apparatus, independently of the separation or not of the upstream coating device from the coated face, the occurrence of the uncoated portion can be detected to start the undercoating liquid applying device. Thus, the effects of the invention can be more reliably attained.

The uncoated portion detecting device may be an optical type uncoated portion detecting device for detecting the occurrence of the uncoated portion optically.

In the thirteenth aspect of the invention, the downstream coating device is often a non-contact coating device for coating the lower layer with the second coating liquid without touching the lower layer.

The coating apparatus is featured in that the lower layer is not damaged while the second coating liquid is being applied by the downstream coating device.

The non-contact coating device may be a slide bead coater, the curtain coater, the extrusion coater or the rod coater which has been described in connection with the upstream coating device. The non-contact coating device should not be limited to the slide coater as far as a coating device can apply the second coating liquid without touching the layer at a coating portion.

In the thirteenth aspect of the invention, the non-contact coating device is often a slide bead coater including: a discharge slit for discharging the second layer forming liquid in a band shape; and a slide face for allowing the second layer forming liquid discharged from the discharge slit to flow thereon. The slide face is usually positioned at its leading end in the vicinity of a plane acting as a traveling path of the substrate, and the slide bead coater usually coats the first layer with the second layer forming liquid by forming a layer forming liquid bridge between the leading end of the slide face and the first layer formed on the substrate.

The coating apparatus is exemplified by the slide bead coater as the non-contact coating device of the coating apparatus.

In the thirteenth aspect of the invention, the non-contact coating device may be a curtain coater arranged over the traveling plane for coating the lower layer formed on the substrate, with the second layer forming liquid by causing the second layer forming liquid to flow in a curtain shape.

The coating apparatus may employ a curtain coater as the non-contact coating device of the coating apparatus.

In the thirteenth aspect of the invention, the non-contact coating device may be an extrusion coater including a discharge slit opened toward the traveling plane for discharging the second coating liquid toward the lower layer formed on the substrate.

The coating apparatus may employ an extrusion coater as the non-contact coating device of the coating apparatus.

In the thirteen aspect of the invention, the coating apparatus usually further comprises a lower layer drying device disposed between the upstream coating device and the undercoating liquid applying device for drying the lower layer.

The lower layer drying device may be a hot-air drier for drying by blowing hot air, a radiation type drying device for drying with the radiation from an electric heater or a high-frequency heating device for drying by the high-frequency heating.

In the thirteenth aspect of the invention, the undercoating liquid applying device usually applies a liquid with a surface tension substantially equal to or higher than that of the second coating liquid, as the undercoating liquid.

According to the coating apparatus, the coating defect such as the streaks or the liquid runout can be effectively prevented when the second coating liquid is applied in the downstream coating device.

In the thirteenth aspect of the invention, the undercoating liquid applying device often applies a liquid as the undercoating liquid including a main solvent of the second coating liquid.

The undercoating liquid includes a high affinity to the second coating liquid, so that the second coating liquid can be effectively applied to the uncoated portion by the coating apparatus.

In the thirteenth aspect of the invention, the undercoating liquid applying device often applies a liquid as the undercoating liquid including a surface active agent.

When water is used as the undercoating liquid in the coating apparatus, the surface tension is lowered by the surface active agent and the water wets and spreads widely over the uncoated portion. Therefore, the second coating liquid can be effectively applied to the uncoated portion thereby to achieve the objectives of the invention reliably.

In the thirteenth aspect of the invention, the surface active agent in the undercoating liquid usually includes a micellar density or higher.

The reduction in the surface tension of the surface active agent is important especially when the surface active agent has the micellar density or higher.

In the thirteenth aspect of the invention, the downstream coating device usually applies a coating liquid containing a surface active agent, as the second coating liquid, and that the undercoating liquid applying device applies a solution as the undercoating liquid including a surface active agent substantially identical to that included in the second coating liquid.

In the coating apparatus, the undercoating liquid and the second coating liquid have identical surface active agents, so that the surface active agent in the undercoating liquid cannot act as an impurity in the second coating liquid.

In the thirteenth aspect of the invention, the substrate is usually a support web used for a planographic printing plate.

The coating apparatus is an example in which the coating apparatus of the invention is applied to the manufacture of the planographic printing plate.

In the thirteenth aspect of the invention, the upstream coating device often applies a photosensitive layer forming liquid containing a photosensitive resin, as the first coating liquid.

The above-mentioned coating apparatus is an example in which the coating apparatus of the invention is applied to the manufacture of the planographic printing plate having the visible light exposure type printing plate layer.

In the thirteenth aspect of the invention, the downstream coating device often applies an anti-oxidant layer forming liquid containing a solution of polyvinyl alcohol, as the second coating liquid.

The above-mentioned coating apparatus is an example in which the coating apparatus of the invention is applied to the manufacture of the planographic printing plate including the anti-oxidant layer on the uppermost layer.

According to a fourteenth aspect of the invention, there is provided a coating method for forming a plurality of layers over a continuously traveling band-shaped substrate, comprising the steps of: forming a lower layer by coating a first coating liquid, and forming an upper layer over the lower layer by coating a second coating liquid including a composition substantially identical to or different from a composition of the first coating liquid; and applying an undercoating liquid to an uncoated portion before coating the second coating liquid when the uncoated portion is generated during forming the lower layer.

In this coating method, when the coating defect is made to leave the uncoated portion when the lower layer is to be formed, the undercoating layer is applied to the uncoated portion, and the second coating liquid is applied to the undercoated layer.

Therefore, the second coating liquid adheres well to the uncoated portion, so that the coating defect due to the uncoated portion can be effectively prevented when the second coating liquid is applied.

The substrate, the one coating liquid, the second coating liquid and the undercoating liquid have been described in connection with the fourteenth aspect of the invention.

DESCRIPTION OF THE PREFERRED EMBODIMENTS

First Embodiment

Figure 1:
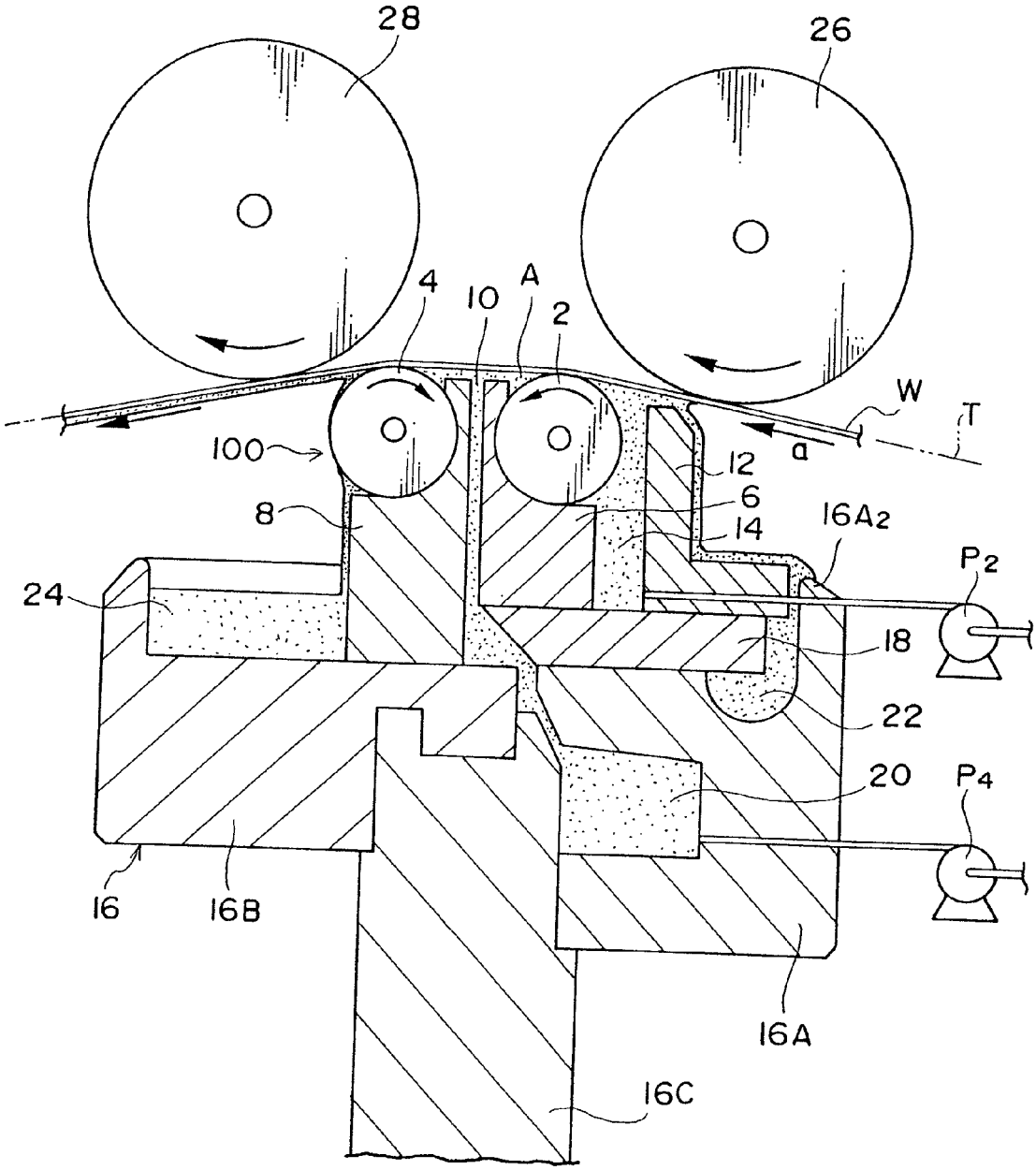
FIG. 1 is a sectional view showing a structure of one embodiment of a coating apparatus of the invention.

FIG. 1 shows a construction of a first embodiment of the coating apparatus of the invention for coating a support web W with a photosensitive layer forming liquid.

As shown in FIG. 1, a coating apparatus 100 of the first embodiment 1 comprises: a forward bar 2 for rotating in the same direction, while abutting against the support web W of aluminum traveling in the same direction a as that of the support web W; a backward bar 4 disposed downstream of the forward bar 2 for rotating in the opposite direction to the traveling direction a; a forward bar supporting member 6 disposed to have a top face confronting a traveling plane T or the traveling path of the support web W, for supporting the forward bar 2 on the lower side; and a backward bar supporting member 8 disposed adjacent to the forward bar supporting member 6 to have a top face confronting the traveling plane T, for supporting the backward bar 4 on the lower side.

Both the forward bar 2 and the backward bar 4 are arranged widthwise of the coating apparatus 100. Here, the width direction of the coating apparatus 100 is perpendicular to the traveling direction a of the support web W. The forward bar 2 and the backward bar 4 may be exemplified by smooth bars having surfaces finished smooth, by grooved bars having circumferential grooves formed at a constant interval in their surfaces or by wire bars having circumferential thin wires of stainless steel wound at a constant interval or densely on their surfaces.

Between the forward bar supporting member 6 and the backward bar supporting member 8, there is formed of a downstream liquid feed passage 10 which is extended along the width direction of the coating apparatus 100. The backward bar 4 corresponds to a metering device in the coating apparatus of the invention. When the support web W is to be coated with the photosensitive layer forming liquid, the photosensitive layer forming liquid is fed from the downstream liquid feed passage 10 to the support web W so that a coating liquid pool A is formed in the space which is defined by the support web W, the forward bar 2, the backward bar 4, the forward bar supporting member 6 and the backward bar supporting member 8.

Upstream of the forward bar 2, an upstream weir plate 12 is disposed, which extends toward the traveling plane T. Between the forward bar supporting member 6 and the upstream weir plate 12, there is formed a liquid feed passage 14 for feeding the photosensitive layer forming liquid to the upstream of the forward bar 2.

The forward bar supporting member 6 and the upstream weir plate 12 are fixed through a base plate 18 on an upstream platform 16A forming the upstream side of a platform 16 of the coating apparatus 100. The backward bar supporting member 8 is fixed on a downstream platform 16B forming the downstream side of the platform 16 of the coating apparatus 100.

The upstream platform 16A and the downstream platform 16B are jointed through a plate-shaped joint member 16C to form the platform 16. Between the joint member 16C and the upstream platform 16A, a liquid feed passage 20 is formed communicating with the downstream liquid feed passage 10.

In the vicinity of the upstream end edge of the upstream platform 16A, there is formed a rising bank 16$A_2$. Among this bank 16$A_2$, the base plate 18 and the upstream weir plate 12, an upstream coating liquid recovering passage 22 is formed. The passage 22 has a J-shaped section for recovering such one of the photosensitive layer forming liquid fed from the liquid feed passage 14 as has overflown to the upstream-side of the upstream weir plate 12.

In the downstream platform 16B, a downstream coating liquid recovering passage 24 is formed. The passage 24 is for receiving the photosensitive layer forming liquid having overflown downward the backward bar 4.

The liquid feed passage 14 is fed with the photosensitive layer forming liquid by a liquid feed pump $P_2$, and the downstream liquid feed passage 10 is fed with the photosensitive layer forming liquid by a liquid feed pump $P_4$ via the liquid feed passage 20.

Over the traveling plane T and upstream of the forward bar 2 and downstream of the backward bar 4, respectively, a pressure roller 26 and a pressure roller 28 are disposed. The rollers 26 and 28 are for pressurizing the support web W traveling over the coating apparatus 100 onto the forward bar 2 and the backward bar 4, respectively.

The actions of the coating apparatus 100 will be described in the following.

First of all, the photosensitive layer forming liquid is fed from the liquid feed pump $P_2$ via the liquid feed passage 14 to the upstream of the forward bar 2, and the coating liquid is fed from the liquid feed pump $P_4$ via the downstream liquid feed passage 10 to the coating liquid pool A.

In the forward bar 2, the support web W is coated with the photosensitive layer forming liquid by scooping up the liquid to splash the back of the support web W with it. The air, as entrained into the coating apparatus 100 by the back of the support web W, is released by splashing the photosensitive layer forming liquid scooped up by the forward bar 2 to the support web. On the other hand, the support web W is excessively coated with the photosensitive layer forming liquid.

The support web thus coated with the photosensitive layer forming liquid by the forward bar 2 then passes through the coating liquid pool A.

The pressure of the photosensitive layer forming liquid fed from the downstream liquid feed passage 10 prevails in the coating liquid pool A, and thus the entrained air is returned upstream by the liquid pressure even if the air is not released and remained by the forward bar 2. Moreover, ripples, if any at the forward bar 2, are leveled to disappear by the liquid pressure.

The support web W having passed through the coating liquid pool A then abuts against the backward bar 4. The backward bar 4 is rotating in the opposite direction of the traveling direction a of the support web W, as has been described hereinbefore. Thus, the photosensitive layer forming liquid having been excessively applied to the lower side of the support web W by the forward bar 2 is scooped off to a predetermined coating thickness by the backward bar 4.

The photosensitive layer forming liquid thus scooped up by the backward bar 4 is extruded at least partially thereof downstream by the pressure of the photosensitive layer forming liquid fed to the coating liquid pool A. The photosensitive layer forming liquid thus extruded downstream overflows the backward bar 4 downstream. The image forming liquid having overflown the backward bar 4 falls to the downstream coating liquid recovering passage 24.

In the coating apparatus 100 of the first embodiment, the downstream liquid feed passage 10 is formed into a narrow slit shape, and the coating liquid pool A communicating with the downstream liquid feed passage 10 includes a small volume. Even in a small quantity of the photosensitive layer forming liquid to be fed from the liquid feed pump $P_4$, therefore, the liquid pressure between the forward bar 2 and the backward bar 4 is allowed to be raised and the ripples generated at the forward bar 2 can disappear. Moreover, the avalanche heterogeneity can be effectively prevented by the entrained air which could not be completely removed at the forward bar 2.

Second Embodiment

Figure 2:
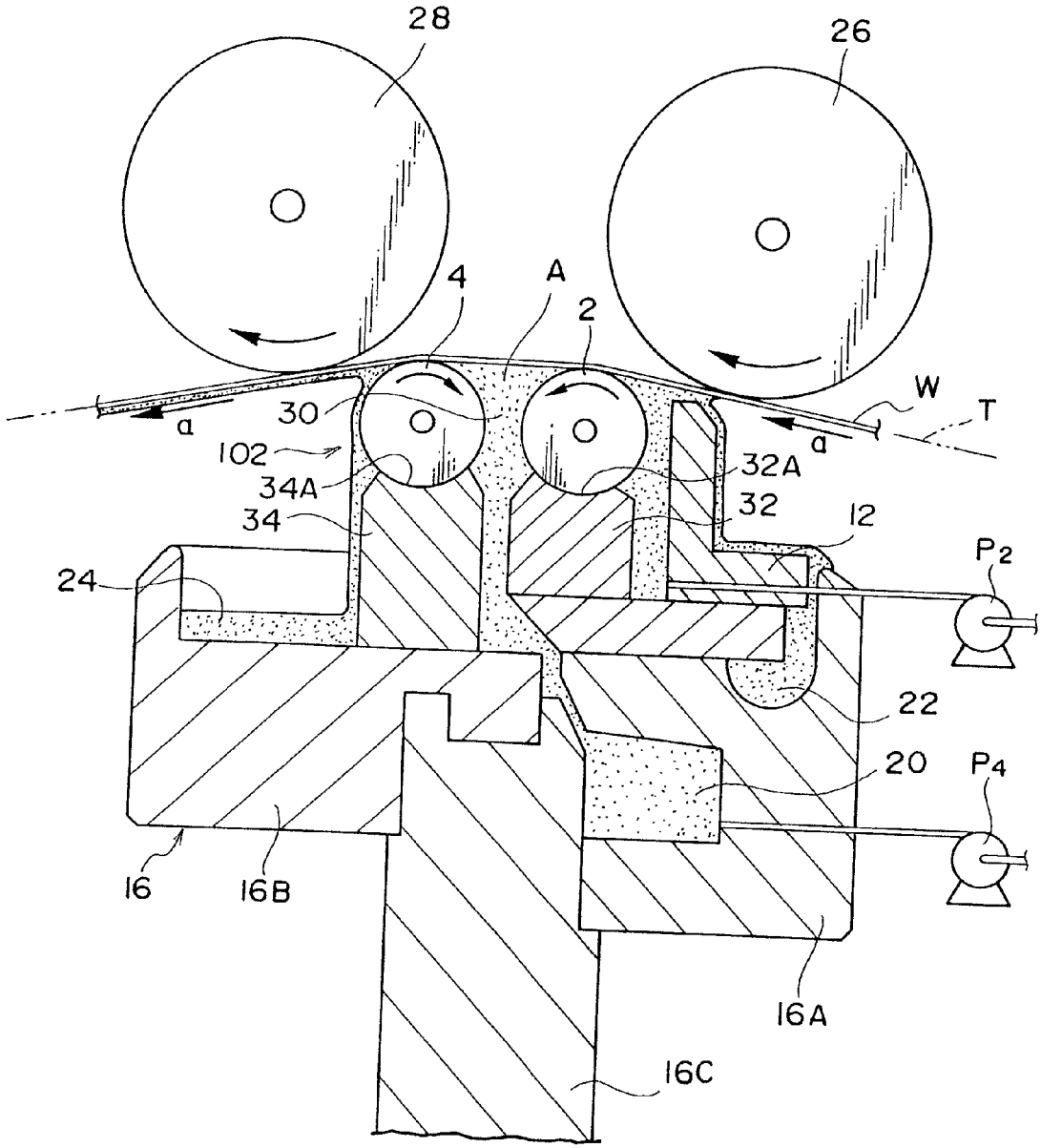
FIG. 2 is a sectional view showing a structure of another embodiment of the coating apparatus of the invention.

FIG. 2 shows a structure of a second embodiment of the coating apparatus of the invention for coating the support web W with the photosensitive layer forming liquid. In FIG. 2, the same reference numerals as those of FIG. 1 designate the same components as those shown in FIG. 1.

In a coating apparatus 102 of the second embodiment, the forward bar 2 and the backward bar 4 are disposed adjacent to each other across a downstream liquid feed passage 30, as will be described in the following.

A forward bar supporting member 32 for supporting the forward bar 2 from the lower side and a backward bar supporting member 34 for supporting the backward bar 4 from the lower side are provided with grooved recesses 32A and 34A for holding the forward bar 2 and the backward bar 4 on their respective top faces. The sections of the recesses 32A and 34A may be arcuate or V-shaped, but should not be limited to such shapes.

Between the forward bar 2 and the backward bar 4 and between the forward bar supporting member 32 and the backward bar supporting member 34, there is formed the downstream liquid feed passage 30 for feeding the photosensitive layer forming liquid to the coating liquid pool A. This downstream liquid feed passage 30 is connected at its lower end to the liquid feed passage 20.

Except these points, the coating apparatus 102 comprises a structure similar to that of the coating apparatus 100.

When the support web W is coated with the photosensitive layer forming liquid, as in the coating apparatus 100, the photosensitive layer forming liquid, as scooped up by the forward bar 2, splashes the support web, and the entrained air is released whereas the air portion left unreleased at the forward bar 2 is returned upstream in the coating liquid pool A. The ripples, if any at the forward bar 2, are leveled to disappear by the liquid pressure. Moreover, the photosensitive layer forming liquid, as excessively applied to the lower face of the support web W by the forward bar 2, is scraped off to a predetermined coating thickness by the backward bar 4.

The coating apparatus 102 includes features similar to those of the coating apparatus 100 of the first embodiment.

Third Embodiment

Figure 3:
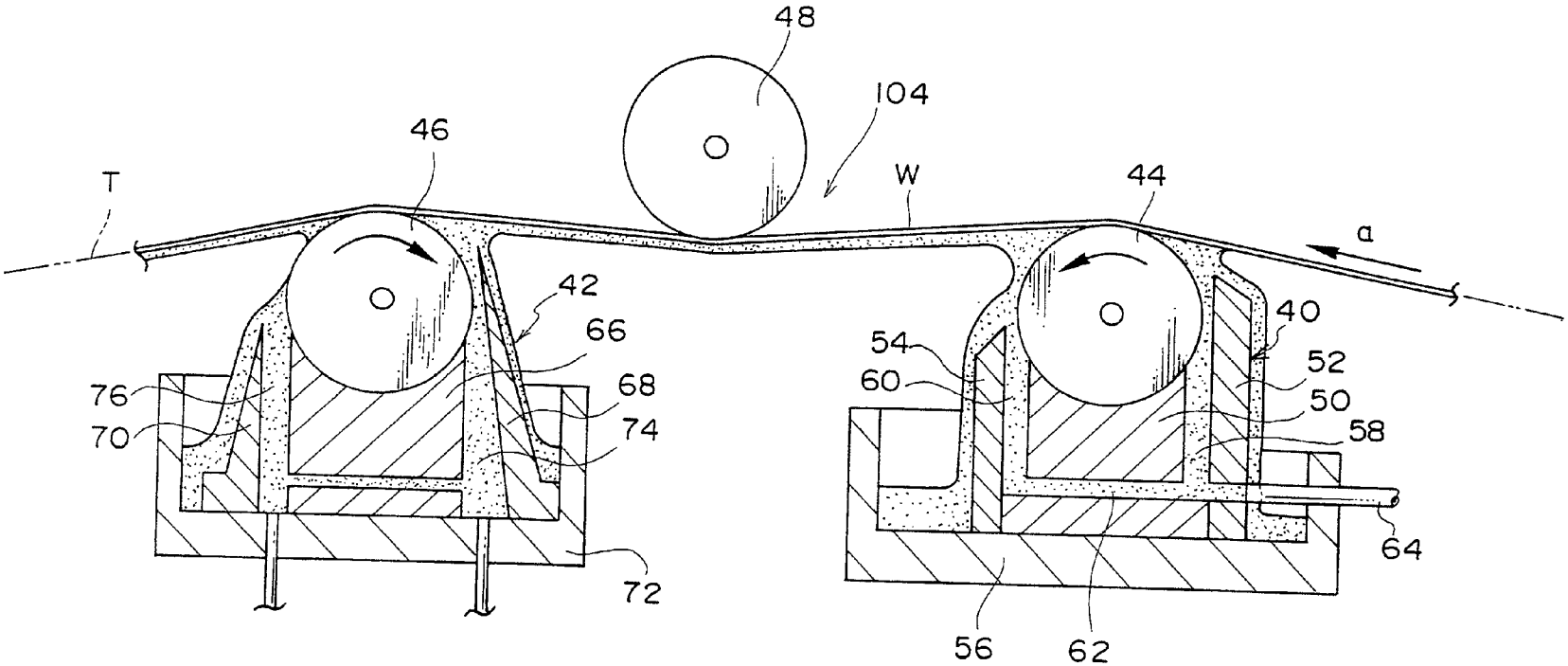
FIG. 3 is a sectional view showing a structure of still another embodiment of the coating apparatus of the invention.

FIG. 3 shows a structure of a third embodiment of the coating apparatus of the invention for coating the support web with the photosensitive layer forming liquid.

A coating apparatus 104 of Embodiment 3 is constructed, as shown in FIG. 3, to comprise: a forward bar coater 40 having a forward bar 44; and a backward bar coater 42 disposed downstream of the forward bar coater 40 and having a backward bar 46. Both the forward bar coater 40 and the backward bar coater 42 are disposed on the lower side of the traveling plane T of the support web W.

Above between the forward bar coater 40 and the backward bar coater 42, a pressure roller 48 is disposed. The roller 48 is for pressurizing the support web W on the upper side onto the forward bar 44 and the backward bar 46 when the photosensitive layer forming liquid is applied to the support web W.

The forward bar coater 40 includes, in addition to the forward bar 44: a forward bar supporting member 50 for supporting the forward bar 44 upward; an upstream weir plate 52 disposed upstream of the forward bar supporting member 50 and extending vertically toward the traveling plane T; a downstream weir plate 54 disposed downstream of the forward bar supporting member 50 and extending vertically toward the traveling plane T; and a platform 56 placing the forward bar supporting member 50 thereon.

Between the forward bar supporting member 50 and the upstream weir plate 52, an upstream liquid feed passage 58 is formed. The passage 58 is for feeding the photosensitive layer forming liquid to the upstream side of the forward bar 44. Between the forward bar supporting member 50 and the downstream weir plate 54, a downstream liquid feed passage 60 is formed for feeding the photosensitive layer forming liquid to the downstream side of the forward bar 44. The upstream liquid feed passage 58 and the downstream liquid feed passage 60 communicate at a communication passage 62 with each other below the forward bar supporting member 50. To the lower end of the upstream liquid feed passage 58, a liquid feed conduit 64 is connected for feeding the photosensitive layer forming liquid.

The backward bar coater 42 includes, in addition to the backward bar 46: a backward bar supporting member 66 for supporting the backward bar 46 upward; an upstream weir plate 68 disposed upstream of the backward bar supporting member 66 and extending obliquely upward toward the backward bar 46; and a downstream weir plate 70 disposed downstream of the backward bar supporting member 66 and extending vertically toward the traveling plane T.

The backward bar supporting member 66, the upstream weir plate 68 and the downstream weir plate 70 are placed on a platform 72.

Between the backward bar supporting member 66 and the upstream weir plate 68, an upstream passage 74 is formed for feeding/discharging the photosensitive layer forming liquid.

Between the backward bar supporting member 66 and the downstream weir plate 70, a downstream passage 76 is provided for feeding/discharging the photosensitive layer forming liquid.

The forward bar 44 rotates, like the forward bar 2 of the first and second embodiments, in the same direction as the traveling direction of the support web W. The forward bar 44 may be a smooth bar, a grooved bar or a wire bar, exemplified similarly to the forward bar 2.

The backward bar 46 rotates, like the backward bar 4 in Embodiments 1 and 2, in the opposite direction of the traveling direction of the support web W. The backward bar 46 is often a smooth bar.

The actions of the coating apparatus 104 will be described in the following.

In the forward bar coater 40, the photosensitive layer forming liquid is fed from the liquid feed passage 64 via the upstream liquid feed passage 58 to the upstream side of the forward bar 44. Simultaneously with this, the coating liquid is also fed via the downstream liquid feed passage 60 to the downstream side of the forward bar 44.

In the forward bar 44, the support web W is coated with the photosensitive layer forming liquid, as fed from the upstream liquid feed passage 58, by scooping up the liquid to splash the back of the support web W with it. The air, as entrained into the coating apparatus 104 by the back of the support web W, is released by the photosensitive layer forming liquid. The liquid is scooped up to splash the support web by the forward bar 44. On the other hand, the support web W is excessively coated with the photosensitive layer forming liquid.

The support web W thus coated with the photosensitive layer forming liquid by the forward bar 2 then passes over the backward bar coater 42. The backward bar 46 is rotating in the opposite direction of the traveling direction a of the support web W, as has been described hereinbefore, and the photosensitive layer forming liquid excessively applied by the forward bar coater 40 is scooped off and metered to a predetermined coating thickness by the backward bar 46.

In the coating apparatus 104 of the third embodiment, even when the support web W is coated with the photosensitive layer forming liquid by causing it to travel at a high speed, the air entrained into the coating apparatus 104 by the support web W, can be released by the forward bar coater 40. Therefore, the coating can be stabilized without any various defects that might otherwise be caused on the coating film by the entrained air.

Moreover, either the forward bar coater 40 or the backward bar coater 42 may be a bar coater of the prior art. Thus, the coating apparatus 104 can be advantageously constructed at a low cost.

EXAMPLE 1

By using the coating apparatus shown in FIG. 1, an aluminum web having a width of 150 mm was coated with a solvent type photosensitive layer forming liquid having a viscosity of 20 cp and a surface tension of 24 dynes/cm. The coating apparatus had a width of 300 mm. The aluminum web was an example of the support web W.

The liquid feed passage 14 was fed with the photosensitive layer forming liquid at a feed rate of 500 cc/min. from the liquid feed pump $P_2$. The downstream liquid feed passage 10 was fed with the photosensitive layer forming liquid at a feed rate V (cc/min.), as expressed by the following equation, by changing the speed of the liquid feed pump $P_4$:

$$V=76.043\times r+221.57$$

(r: the speed (rpm) of the liquid feed pump $P_4$).

The forward bar 2 had a diameter of 13 mm, and the backward bar 4 had a diameter of 13 mm. The forward bar 2 was rotated at a speed of 700 rpm in the same direction as the traveling direction a of the support web W, and the backward bar 4 was rotated at a speed of 5 rpm in the opposite direction of the traveling direction a of the support web W. A smooth bar was used as the backward bar 4.

When the smooth bar was used as the forward bar 2, there occurred neither the liquid runout, in which the photosensitive layer forming liquid was not applied, nor the avalanche heterogeneity, when the feed rate V was at 3,188 cc/min. or higher. This corresponds to the condition when the liquid feed pump $P_4$ had a speed of 40 rpm or higher.

When the grooved bar was used as the forward bar 2, there occurred neither the liquid runout nor the avalanche heterogeneity, when the feed rate V was at 2,442 cc/min. or higher. This corresponds to the condition when the liquid feed pump $P_4$ had a speed of 30 rpm or higher.

When the photosensitive layer forming liquid was applied by setting the speed of the liquid feed pump $P_4$ within a range of neither the liquid runout nor the avalanche heterogeneity, these unfavorable phenomena were hardly found even if the transfer speed of the aluminum web was raised to 155 m/min.

[Comparison 1]

An aluminum web similar to that of the first embodiment was coated with the photosensitive layer forming liquid by using a coating apparatus having a construction similar to that of the coating apparatus 100 shown in FIG. 1 except the backward bar 4.

As a result, neither the liquid runout nor the coating heterogeneity was prevented even when the feed data in the downstream liquid feed passage was raised to 6,245 cc/min. This corresponds to the speed of the liquid feed pump $P_4$ of about 815 rpm.

Of the invention, as has been described hereinbefore, there are provided the coating apparatus and the coating method, by which the coating can be stabilized without any of the various defects in the coated film even when a web such as the support web is coated by causing it to travel at a high speed.

Fourth Embodiment

Figure 4:
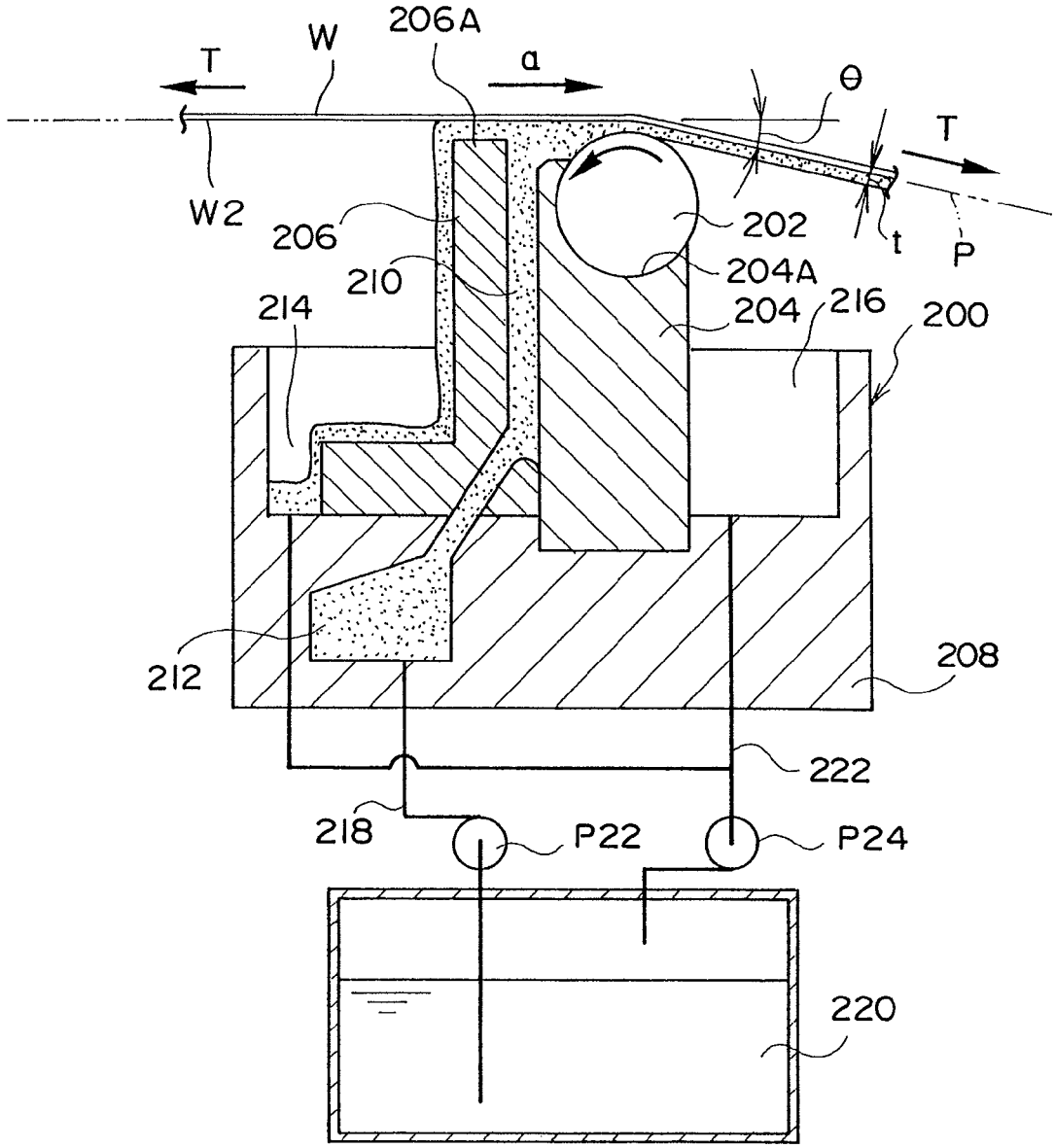
FIG. 4 is a sectional view showing a construction of a further embodiment of the coating apparatus of the invention.

FIG. 4 shows a structure of a fourth embodiment of the coating apparatus of the invention.

The coating apparatus 200 shown in FIG. 4 is used to form a printing plate layer on a roughed surface W2, i.e., the face of the grained side of the support web W traveling in the direction a. The printing plate layer is formed by applying a printing plate layer forming liquid, as has been described in the section of "Description of the Related Art". The printing plate layer forming liquid is one example of the coating liquid in the invention.

As shown in FIG. 4, the coating apparatus 200 is constructed to comprise: a metering rod 202 having a flat surface and disposed in the width direction of the support web W to travel on a traveling plane P; a rod supporting member 204 for supporting the metering rod 202 upward; a weir plate 206 having a flat coating liquid flow forming face on its upper face; and a platform 208 fixing the rod supporting member 204 and the weir plate 206 thereon. The weir plate 206 is disposed upstream of and parallel with the rod supporting member 204.

The rotating direction of the metering rod 202 is opposed to the traveling direction a in the embodiment shown in FIG. 4. However, the rotating direction may be the same as the traveling direction a.

The support web W is normally made to run under a tension T on the metering rod 202 and it takes a "V-shape", in which it is bent downward at its portion to pass through the vicinity of the metering rod 202, as shown in FIG. 4. The lap angle θ, i.e., the angle made between the portions of the support web W upstream and downstream of the metering rod 202 is within a range of 3 to 18 degrees. This lap angle may be within a range of 5 to 10 degrees.

The rod supporting member 204 is a generally plate-shaped member, in which a groove 204A having an internal wall of a J-shaped section is formed in the upper face. The metering rod 202 is supported in a rotating manner upward in the groove 204A.

The upstream wall face of the rod supporting member 204, i.e., the wall face confronting the weir plate 206 is formed into a vertical shape.

The weir plate 206 is a plate-shaped member extending vertically toward the traveling plane P. The weir plate 206 is fixed at its lower end portion on the platform 208 and has a flat top face 206A.

Between the rod supporting member 204 and the weir plate 206, a slit liquid feed passage 210 is formed. This liquid feed passage 210 corresponds to a coating liquid applying device in the coating apparatus of the invention.

The liquid feed passage 210 communicates at its lower end with a liquid feed passage 212 formed in the platform 208. This liquid feed passage 212 is connected through a liquid feed conduit 218 to a tank 220. The liquid feed passage 212 is formed into a small chamber with a function to suppress fluctuations in the flow rate of the printing plate layer forming liquid in the liquid feed passage 210 when the flow of the printing plate layer forming liquid from the liquid feed passage 210 fluctuates. Here, a liquid feed pump $P_{22}$ is disposed in the liquid feed conduit 218.

Upstream of the weir plate 206 and downstream of the rod supporting member 204 in the platform 208, respectively, overflow liquid pools 214 and 216 are formed for receiving the printing plate layer forming liquid. These overflow liquid pools 214 and 216 are connected to the tank 220 via a return conduit 222 for returning the printing plate layer forming liquid received. A return pump $P_{24}$ is disposed in the return conduit 222.

The actions of the coating apparatus 200 will be described in the following.

As the support web W passes over the liquid feed passage 210, at least a portion of the printing plate layer forming liquid disposed upward from the liquid feed passage 210 attaches to the roughed surface W2 of the support web W and is carried downstream to pass through the metering rod 202. This metering rod 202 is finished to have a smooth surface, as has been described hereinbefore. Therefore, the printing plate layer forming liquid wetting the metering rod 202 is caught between the metering rod 202 and the support web W and the support web W receives an upstream force from the printing plate layer forming liquid to lift from the metering rod 202. As a result, the support web W is coated with the printing plate layer forming liquid while being untouched by the metering rod 202.

The remainder of the printing plate layer forming liquid flows backward (in the upstream direction) from the clearance between the support web W and the weir plate 206. As a result, the entrained air on the surface of the support web W is returned back upstream.

The coating amount of the printing plate layer forming liquid to the support web W, i.e., the coating thickness t can be controlled by the lap angle θ, the traveling speed of the support web W, the viscosity of the printing plate layer forming liquid, the tension T to be applied to the support web W, and the diameter and the speed of the metering rod 202. The relations of the coating thickness t to the lap angle θ, the traveling speed of the support web W, the viscosity of the printing plate layer forming liquid, the tension T, and the diameter and the speed of the metering rod 202 have been presented in the section of "Summary of the Invention".

In the coating apparatus 200 of the fourth embodiment, as has been described hereinbefore, the printing plate layer forming liquid is applied to the roughed surface W2 without letting the metering rod 202 touch the roughed surface W2 of the support web W, and thus the roughed surface W2 is not damaged. When the coating apparatus 200 is used, therefore, it is possible to manufacture non-defective planographic printing plates stably.

By controlling the lap angle θ, the traveling speed of the support web W, the viscosity of the printing plate layer forming liquid, the tension T to be applied to the support web W, and the diameter and the speed of the metering rod 202, as has been described hereinbefore, the printing plate layer forming liquid can be applied with the predetermined coating thickness t.

By the pressure of the printing plate layer forming liquid to flow backward out of the clearance between the support web W and weir plate 206, moreover, the air entrained by the support web is pushed backward at the weir plate 206 so that it is not carried to the liquid feed passage 210 and the metering rod 202. Therefore, it is possible to prevent the occurrence of the coating avalanche heterogeneity, as might otherwise be caused by the entrained air.

Fifth Embodiment

Figure 5:
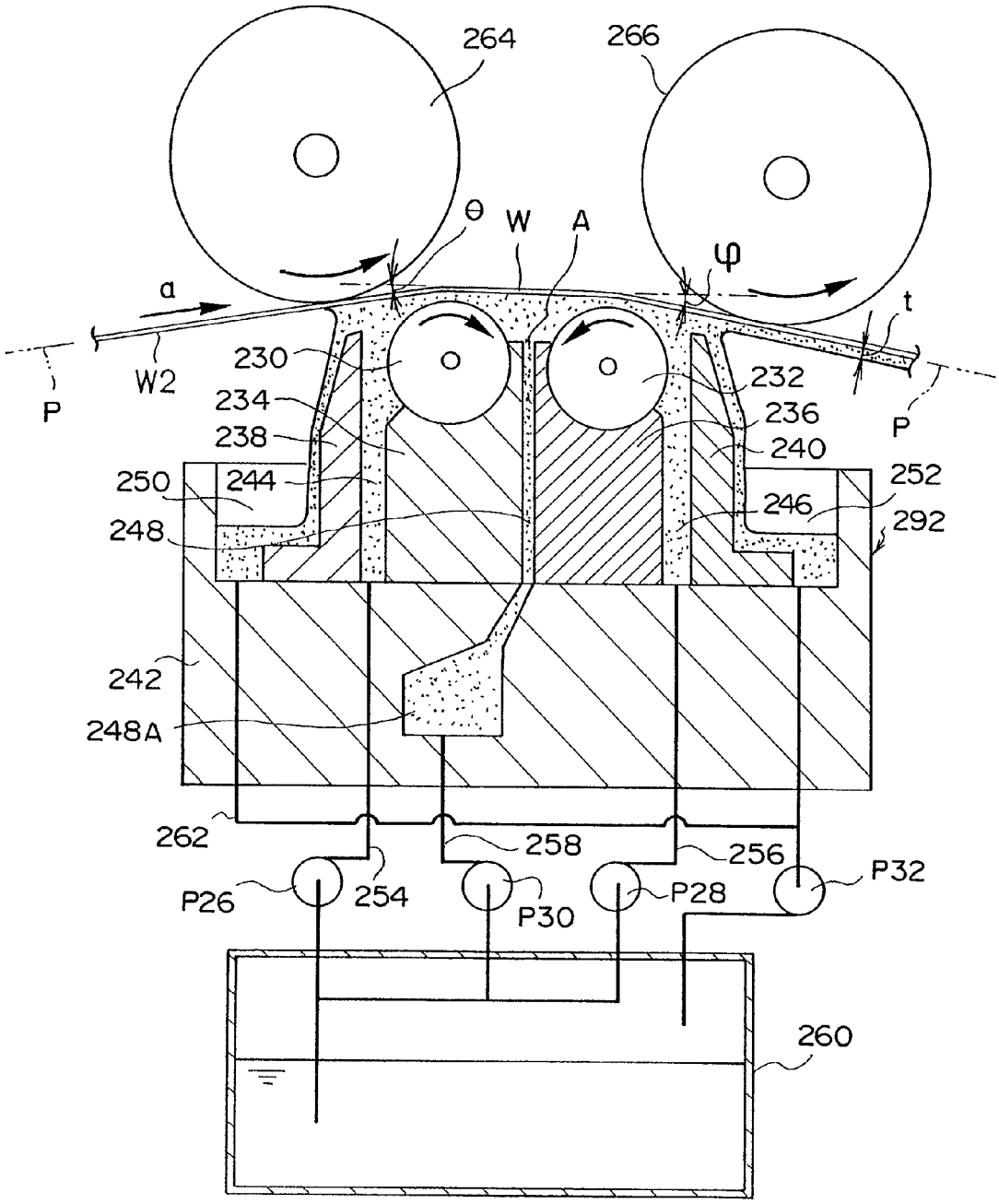
FIG. 5 is a sectional view showing a construction of a further embodiment of the coating apparatus of the invention.

FIG. 5 shows a fifth embodiment of the coating apparatus of the invention.

The coating apparatus 202 shown in FIG. 5 is also used for coating the roughed surface W2 of the support web W with the printing plate layer forming liquid to form the printing plate layer.

A coating apparatus 202 of the fifth embodiment is constructed to comprise: a main metering rod 230 and an auxiliary metering rod 232 arranged along the width direction of the support web W to travel on the traveling plane P; a plate-shaped main metering rod holding member 234 for rotatably holding the main metering rod 230 upward; a plate-shaped auxiliary metering rod holding member 236 for rotatably holding the auxiliary metering rod 232 upward; an upstream weir plate 238 erected upright toward the traveling plane P on the upstream side of the main metering rod holding member 234; and a downstream weir plate 240 erected upright toward the traveling plane P on the downstream side of the auxiliary metering rod holding member 236. The auxiliary metering rod 232 is arranged downstream of the main metering rod 230 parallel with and at the same level as that of the main metering rod 230. The auxiliary metering rod holding member 236 is arranged downstream of and adjacent to the main metering rod holding member 234. The main metering rod 230 and the auxiliary metering rod 232 correspond to the metering rod and the auxiliary metering rod in the coating apparatus of the invention, respectively.

Both the main metering rod 230 and the auxiliary metering rod 232 are made to include smooth surfaces. The main metering rod holding member 234, the auxiliary metering rod holding member 236, the upstream weir plate 238 and the downstream weir plate 240 are fixed on a platform 242.

Between the main metering rod holding member 234 and the upstream weir plate 238, a slotted upstream liquid feed passage 244 is formed for feeding the printing plate layer forming liquid to the upstream side of the main metering rod 230. Between the auxiliary metering rod holding member 236 and the downstream weir plate 240, a slotted downstream liquid feed passage 246 is formed for feeding the printing plate layer forming liquid to the downstream side of the auxiliary metering rod 232.

Between the main metering rod holding member 234 and the auxiliary metering rod holding member 236, a slot-like auxiliary liquid feed passage 248 is formed for feeding the printing plate layer forming liquid to between the main metering rod 230 and the auxiliary metering rod 232. The auxiliary liquid feed passage 248 corresponds to the auxiliary coating liquid feed device in the coating apparatus of the invention.

All the upstream liquid feed passage 244, the downstream liquid feed passage 246 and the auxiliary liquid feed passage 248 are slit at their upper ends along the width direction of the support web W to run over the traveling plane P.

At the lower end portion of the auxiliary liquid feed passage 248, a buffer chamber 248A is formed. This buffer chamber 248A buffers the discharge of the printing plate layer forming liquid coming from the auxiliary liquid feed passage 248, to a constant amount, when the feed flow of the printing plate layer forming liquid to be fed to the auxiliary liquid feed passage 248 fluctuates, by absorbing the fluctuations.

The platform 242 is provided, on the upstream side of the upstream weir plate 238, with an upstream overflow liquid pool 250 for receiving the printing plate layer forming liquid overflown the upstream weir plate 238. The platform 242 is further provided, on the downstream side of the downstream weir plate 240, with a downstream overflow liquid pool 252 for receiving the printing plate layer forming liquid overflown the downstream weir plate 240.

The upstream liquid feed passage 244, the downstream liquid feed passage 246 and the auxiliary liquid feed passage 248 are connected via liquid feed conduits 254, 256 and 258, respectively, to a printing plate layer forming liquid tank 260 for containing the printing plate layer forming liquid. The liquid feed conduits 254, 256 and 258 are provided with liquid feed pumps $P_{26}$, $P_{28}$ and $P_{30}$ respectively, for feeding the printing plate layer forming liquid to the upstream liquid feed passage 244, the downstream liquid feed passage 246 or the auxiliary liquid feed passage 248.

The overflow-liquid pools 250 and 252 are connected via a liquid return conduit 262 to the printing plate layer forming liquid tank 260. In the liquid return conduit 262, there is disposed a return pump $P_{32}$ for returning the printing plate layer forming liquid to the printing plate layer forming liquid tank 260.

Above the coating apparatus 202 across the traveling plane P, arranged pressure rollers 264 and 266 are arranged for pressurizing the support web W toward the main metering rod 230 and the auxiliary metering rod 232.

As shown in FIG. 5, the rotating direction of the main metering rod 230 is the same direction as the traveling direction a, but the rotating direction of the auxiliary metering rod 232 is the opposite direction to the traveling direction a.

The support web W is normally made to run under the tension on the main metering rod 230 and the auxiliary metering rod 232 so that it takes the "V-shape", i.e., the shape in which it is bent downward at its portion to run on the main metering rod 230 and the auxiliary metering rod 232, as shown in FIG. 5.

The upstream lap angle θ, i.e., the angle made between the portions of the support web W upstream and downstream of the main metering rod 230 may be within a range of 3 to 18 degrees. This lap angle θ may also be within a range of 5 to 10 degrees.

The downstream lap angle ϕ, i.e., the angle made between the portion of the support web W between the main metering rod 230 and the auxiliary metering rod 232 and the portion downstream of the auxiliary metering rod 232 may be within either a range from 3 to 18 degrees or from 5 to 10 degrees.

The larger the upstream lap angle θ and the downstream lap angle ϕ become, the smaller the coating thickness t of the printing plate layer forming liquid will become. The closer the upstream lap angle θ and the downstream lap angle ϕ come to 0, the larger the coating thickness t of the printing plate layer forming liquid will become.

The operations of the coating apparatus 292 will be described in the following.

The main metering rod 230 rotates in the same direction as the traveling direction a of the support web W, as has been described hereinbefore, and thus the rod 230 on the upstream side rotates clockwise in FIG. 5. Therefore, the printing plate layer forming liquid, as discharged upward in the upstream liquid feed passage 244, is scooped up by the main metering rod 230 to splash the roughed surface W2 of the support web W. As a result, the printing plate layer forming liquid is excessively applied to the support web W, and the air, as entrained by the roughed surface W2 and carried into the coating apparatus 292, is released.

The support web W thus coated with the printing plate layer forming liquid in the upstream liquid feed passage 244 then passes over the main metering rod 230. This main metering rod 230 is formed to have the smooth surface, as has been described hereinbefore, and the printing plate layer forming liquid applied to the support web W cannot escape from between the support web W and the main metering rod 230. Therefore, the support web W is floated from the surface of the main metering rod 230 by the pressure of the printing plate layer forming liquid so that the web W can travel over the main metering rod 230 without abutting against the main metering rod 230.

Next, the support web W travels toward the auxiliary metering rod 232.

Between the main metering rod 230 and the auxiliary metering rod 232, the liquid pool A is formed by feeding the printing plate layer forming liquid from the auxiliary liquid feed passage 248 to the support web W, and the support web W passes through the liquid pool A. The printing plate layer forming liquid in the liquid pool A is caused not only to receive the upward pressure by the printing plate layer forming liquid newly fed from the auxiliary liquid feed passage 248 but also to receive the downstream pressure by the main metering rod 230 and to receive the upstream pressure by the auxiliary metering rod 232. When the support web W passes through the liquid pool A, therefore, the roughed surface W2 receives the liquid pressure having the summed high level of those of the aforementioned pressures from the printing plate layer forming liquid. Therefore, the entrained air is returned upstream by the liquid pressure even if the air is unreleased and left by the main metering rod 230. Moreover, the ripples or the widthwise extending heterogeneous waves, if any at the main metering rod 230, are rolled to disappear by the liquid pressure.

The support web W having passed through the liquid pool A then passes over the auxiliary metering rod 232. This auxiliary metering rod 232 rotates in the opposite direction to the traveling direction a, as has been described hereinbefore. Therefore, the printing plate layer forming liquid discharged upward from the downstream liquid feed passage 246 is scooped up by the auxiliary metering rod 232 to splash the roughed surface W2 of the support web W and to form a barrier for preventing entraining air from the downstream side.

The support web W is floated from the auxiliary metering rod 232 by the liquid pressure from the liquid pool A and by the pressure of the printing plate layer forming liquid scooped up by the auxiliary metering rod 232 so that the web W can pass over the auxiliary metering rod 232 without touching of the auxiliary metering rod 232. Moreover, the coating thickness t of the printing plate layer forming liquid is controlled by the size of the clearance between the support web W and the auxiliary metering rod 232.

Similarly to the coating apparatus 200 of the fourth embodiment, the coating apparatus 202 is neither scrubbed nor damaged by the main metering rod 230 and the auxiliary metering rod 232.

By controlling the upstream lap angle θ, the downstream lap angle ϕ, the traveling speed of the support web W, the viscosity of the printing plate layer forming liquid, the tension T to be applied to the support web W, and the diameters and the speeds of the main metering rod 232 and the auxiliary metering rod 232, the printing plate layer forming liquid can be applied with the predetermined coating thickness t.

Another advantage is that no coating heterogeneity of the printing plate layer forming liquid is caused by the entrained air even if the support web is made to travel at a high speed.

EXAMPLE 2

The invention will be described more specifically in connection with Example 2.

The coating apparatus 200 shown in FIG. 4 was used for Example 2 to apply the support web with a pseudo-VNN liquid with a composition similar to that of the photosensitive layer forming liquid, a type of the printing plate layer forming liquid. The lap angle θ was set to 4 degrees. The changes in the coating amount of the pseudo-VNN liquid were examined when the viscosity of the pseudo-VNN liquid was varied within a range from 20 to 304 cp and when the traveling speed of the support web W was varied within a range from 20 to 100 m/min. The results are plotted in FIG. 6.

Figure 6:
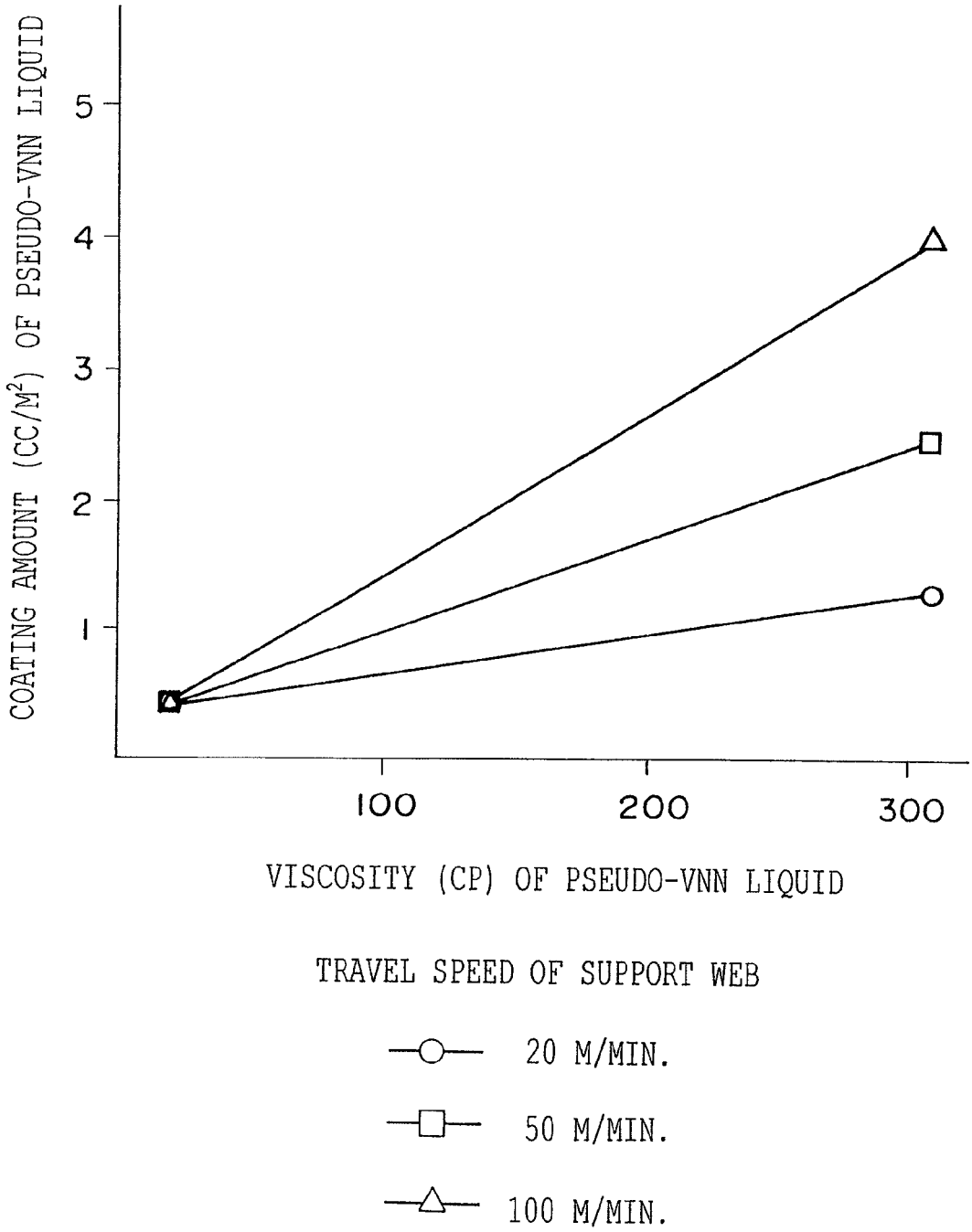
FIG. 6 is a graph plotting the amounts of a pseudo-VNN liquid against the viscosity of the pseudo-VNN liquid and the traveling speed of a support web W in the embodiments.

It has been found from FIG. 6 that the coating amount of the pseudo-VNN liquid increased either when the viscosity of the pseudo-VNN liquid rose or when the traveling speed of the support web rose.

EXAMPLE 3

The coating apparatus 200 shown in FIG. 4 was also used for Example 3. The pseudo-VNN liquid used had a viscosity of 304 cp, and the changes in the coating amount of the pseudo-VNN liquid were examined by setting the traveling speed of the support web W to 50 m/min. and by varying the tension T applied to the support web W within a range of 2,200 to 3,700 N/m. The results are plotted in FIG. 7.

Figure 7:
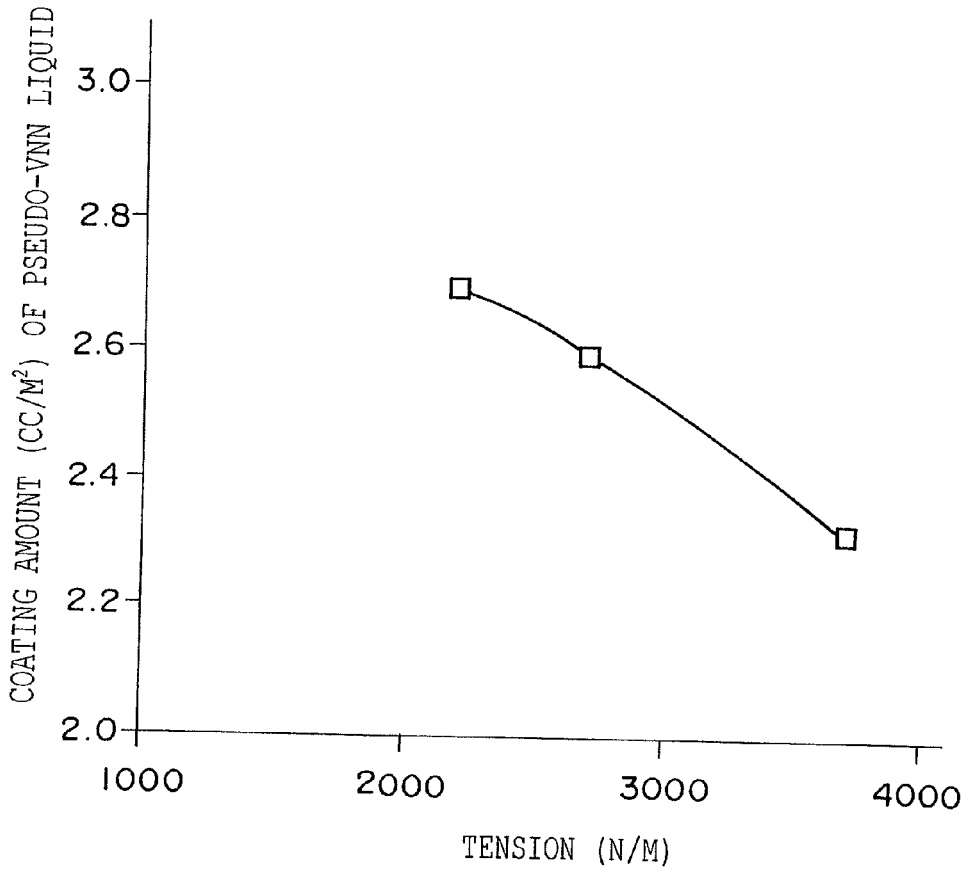
FIG. 7 is a graph plotting the amount of the pseudo-VNN liquid against a tension T of a range of 2,200 to 3,600 N/m to be applied to the support web W when the pseudo-VNN liquid used had a viscosity of 304 cp and the traveling speed of the support web W was set to 50 m/min.

It has been found from FIG. 7 that the coating amount of the pseudo-VNN liquid decreased when the tension T rose.

EXAMPLE 4

The coating apparatus 200 shown in FIG. 4 was used in Example 4. The pseudo-VNN liquid used had a viscosity of 304 cp, and the changes in the coating amount of the pseudo-VNN liquid were examined by setting the traveling speed of the support web W to 50 m/min., by setting the tension T applied to the support web W to 2,800 N/m and by varying the lap angle θ from 1 to 9 degrees. The results are plotted in FIG. 8.

Figure 8:
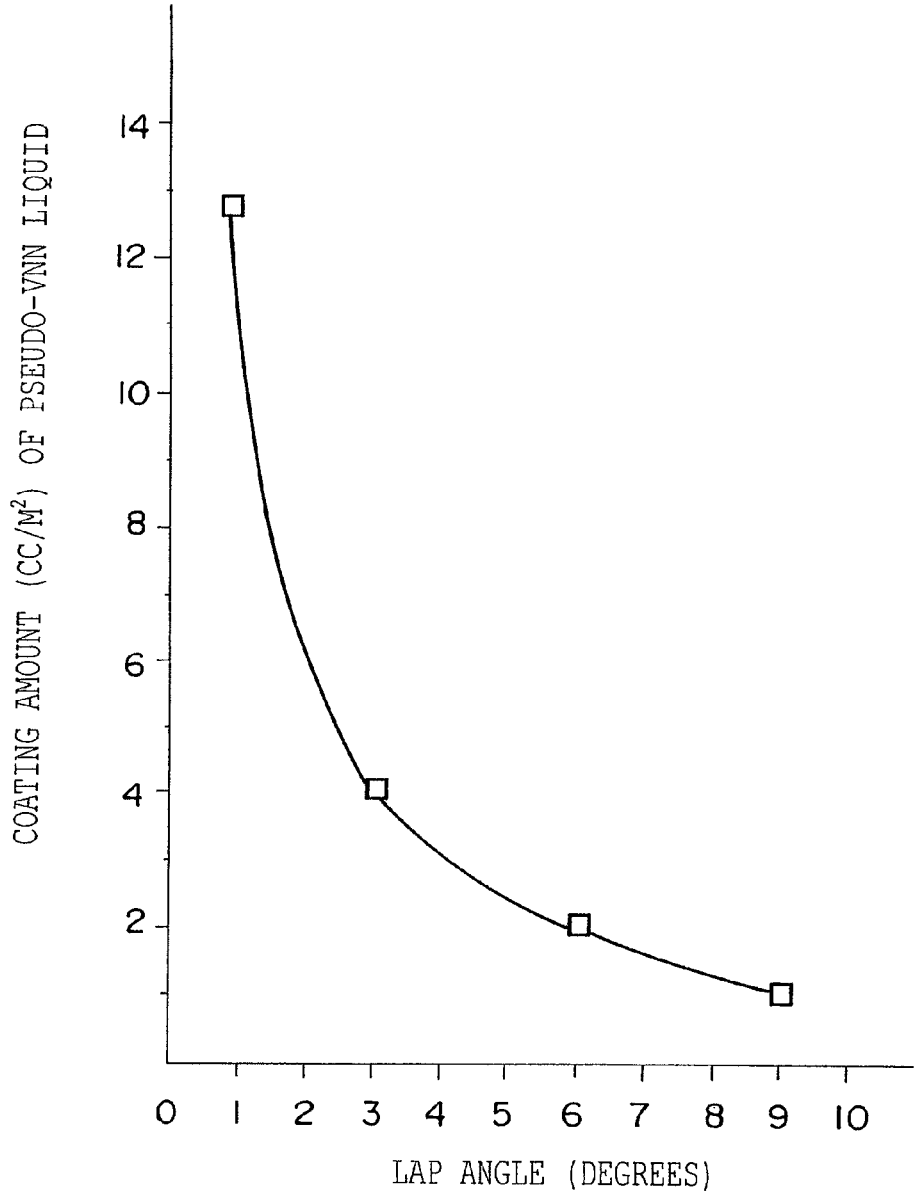
FIG. 8 is a graph plotting the amount of the pseudo-VNN liquid against a lap angle θ when the pseudo-VNN liquid used had a viscosity of 304 cp and when the tension T to be applied to the support web W was set to 2,800 N/m by setting the traveling speed of the support web W to 50 m/min.

It has been found from FIG. 8 that the coating amount of the pseudo-VNN liquid decreased when the lap angle θ increased.

Of the invention, as has been described hereinbefore, it is possible to provide a coating method and a coating apparatus, which can manufacture the planographic printing plate having a multi-layered printing plate layer without damaging the performed layer of the support web or the grained surface of the support web.

Sixth Embodiment

Figure 9:
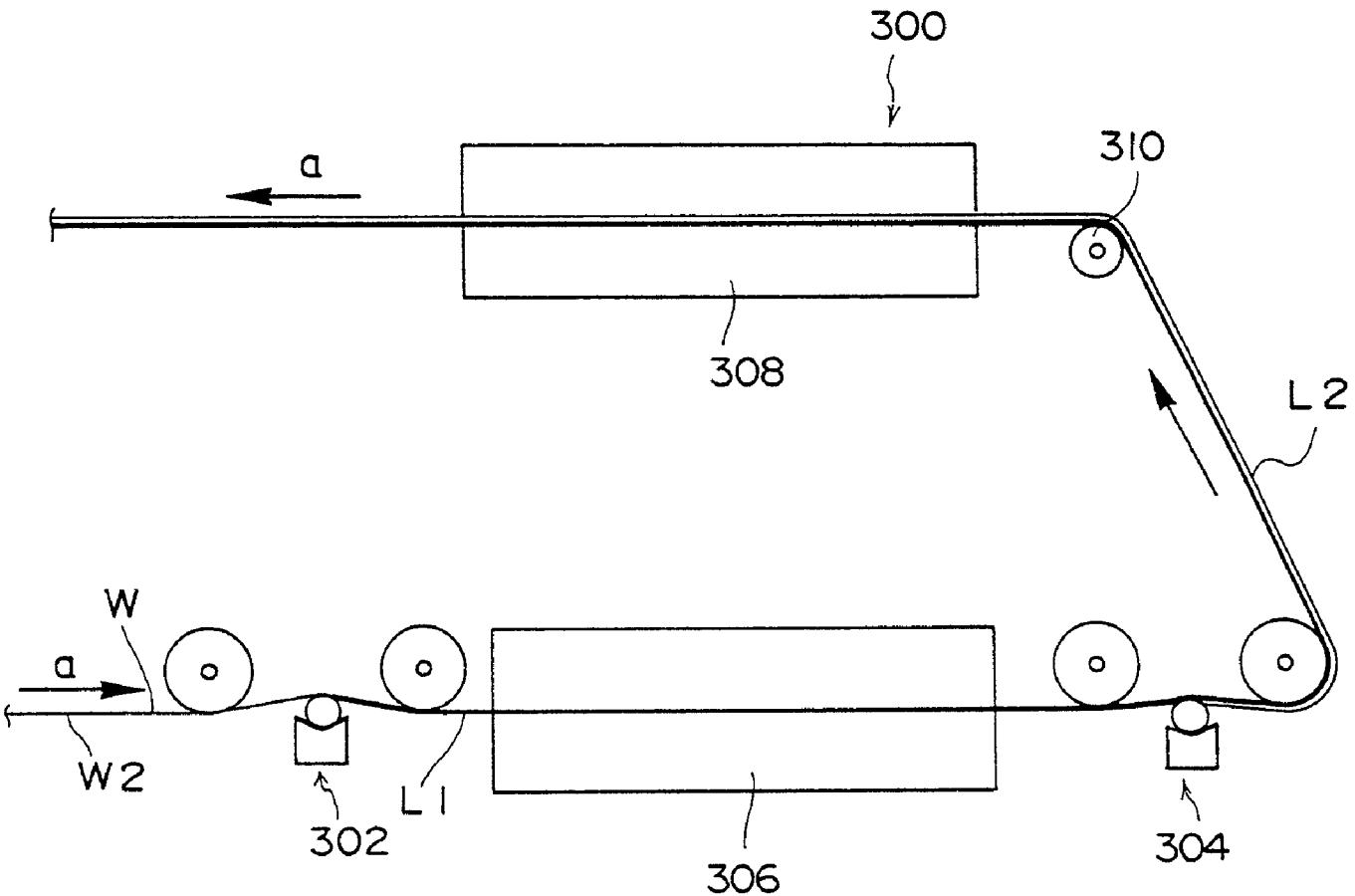
FIG. 9 is a schematic diagram showing a structure of a further embodiment of the coating apparatus of the invention.

FIG. 9 shows the construction of another embodiment of the coating apparatus of the invention.

A coating apparatus 300 of the sixth embodiment coats the support web W, one example of the article to be coated, in the invention, sequentially with two different kinds of photosensitive layer forming liquids, i.e., a first photosensitive layer forming liquid and a second photosensitive layer forming liquid, to form a first layer L1 (a first photosensitive layer), and a second layer L2 (a second photosensitive layer). These first photosensitive layer forming liquid and second photosensitive layer forming liquid correspond to a layer forming liquid and the other layer forming liquid in the invention.

The coating apparatus 300 is constructed, as shown in FIG. 9, to comprise: a bar coater 302 disposed on the most upstream side with respect to the traveling direction a of the support web W, for coating the grained surface of the support web W, i.e., the roughed surface W2 with the first photosensitive layer forming liquid to form the first layer L1; and a rod coater 304 disposed downstream of the bar coater 302 with respect to the traveling direction a, for coating the first layer L1 with the second photosensitive layer forming liquid to form the second layer L2. Here, the "downstream with respect to the traveling direction a" will be simply referred to as the "downstream", and the "upstream with respect to the traveling direction a" will be simply referred to as the "upstream".

Between the bar coater 302 and the rod coater 304, a first layer dryer 306 is arranged for drying the first layer L1 formed by the bar coater 302. Downstream of the rod coater 304, a second layer dryer 308 is arranged for drying the second layer L2 formed by the rod coater 304. The first layer drier 306 and the second layer drier 308 correspond to the first layer drying device and the second layer drying device respectively in the coating apparatus of the invention. These dryers may be hot-air drying devices using hot air, contact heat transfer type drying devices using the heating by heating rollers, or induction-heating type drying devices using the induction-heating from electromagnetic coils.

Between the rod coater 304 and the second layer drier 308, there is disposed a feed roller 310 for introducing the support web W having the second layer L2 by the rod coater 304 into the second layer drier 308.

Figure 10:
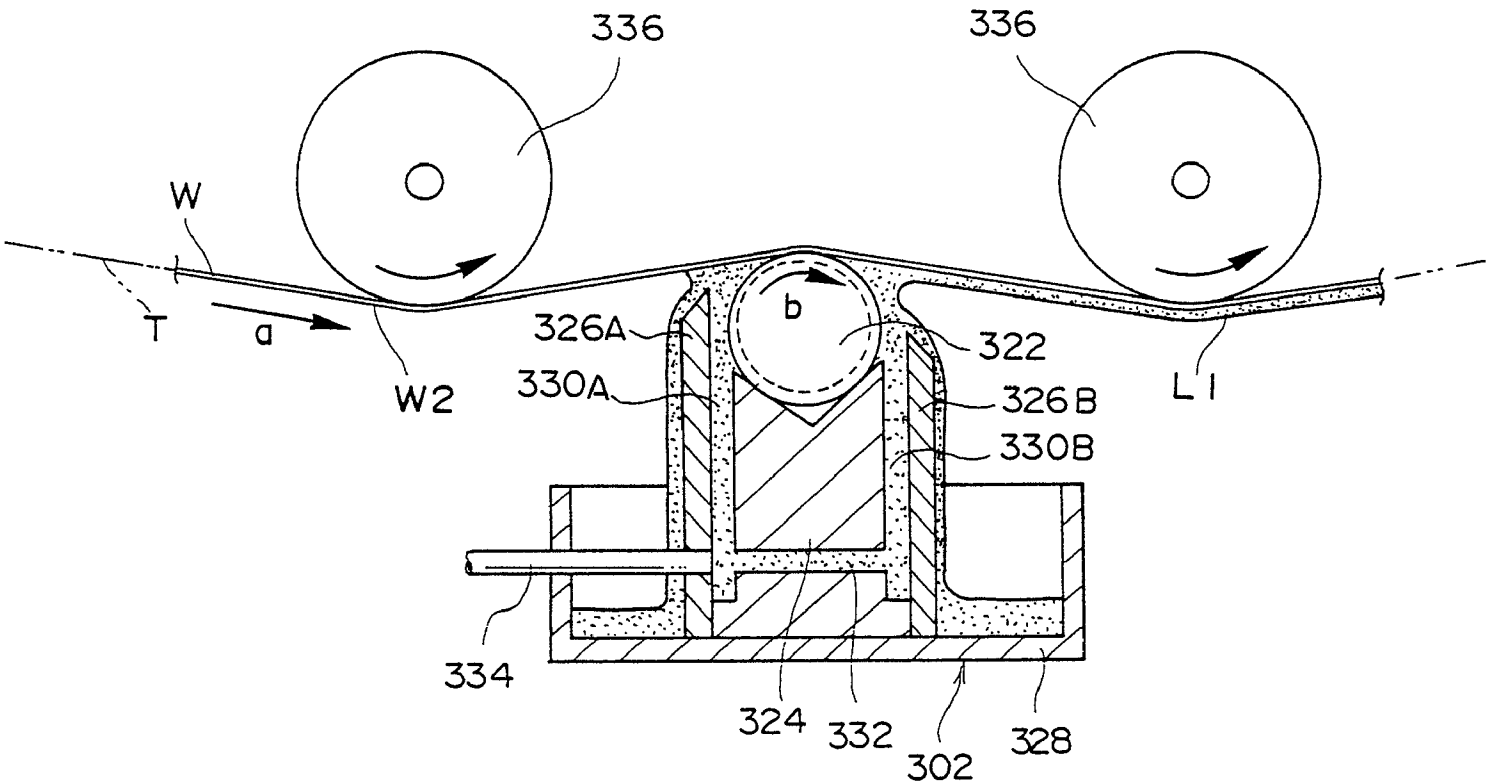
FIG. 10 is a sectional view showing a structure of a bar coater belonging to the coating apparatus shown in FIG. 9.

FIG. 10 shows a structure of the bar coater 302. The bar coater 302 is constructed to include: a bar 322 for rotating in the same direction, as indicated by arrow b in FIG. 10, as the traveling direction a of the support web W; a bar supporting member 324 or a plate-shaped member for supporting the bar 322 upward with V-shaped grooves formed in the top face; an upstream weir plate 326A erected upstream of the bar supporting member 324 and extending vertically toward the traveling plane T or the traveling path of the support web W; a downstream weir plate 326B erected downstream of the bar supporting member 324 and extending vertically toward the traveling plane T; and a platform 328 fixing the bar supporting member 324, the upstream weir plate 326A and the downstream weir plate 326B thereon.

Between the bar supporting member 324 and the upstream weir plate 326, there is formed an upstream liquid feed passage 330A. This upstream liquid feed passage 330A feeds the first photosensitive layer forming liquid to the upstream side of the bar 322. Between the bar supporting member 324 and the downstream weir plate 326B, there is formed a downstream liquid feed passage 330B. This downstream liquid feed passage 330B feeds the first photosensitive layer forming liquid to the downstream side of the bar 322. The upstream liquid feed passage 330A and the downstream liquid feed passage 330B communicate with each other via a communication passage 332 which is formed below the bar supporting member 324.

To the lower end portion of the upstream liquid feed passage 330A, there is connected a liquid feed conduit 334 for feeding the first photosensitive layer forming liquid.

Above the traveling plane T, there are arranged a pair of web pressure rollers 336 which are driven to rotate about their axes to pressurize the support web W toward the bar 322 at the time of applying the first photosensitive layer forming liquid.

Figure 11:
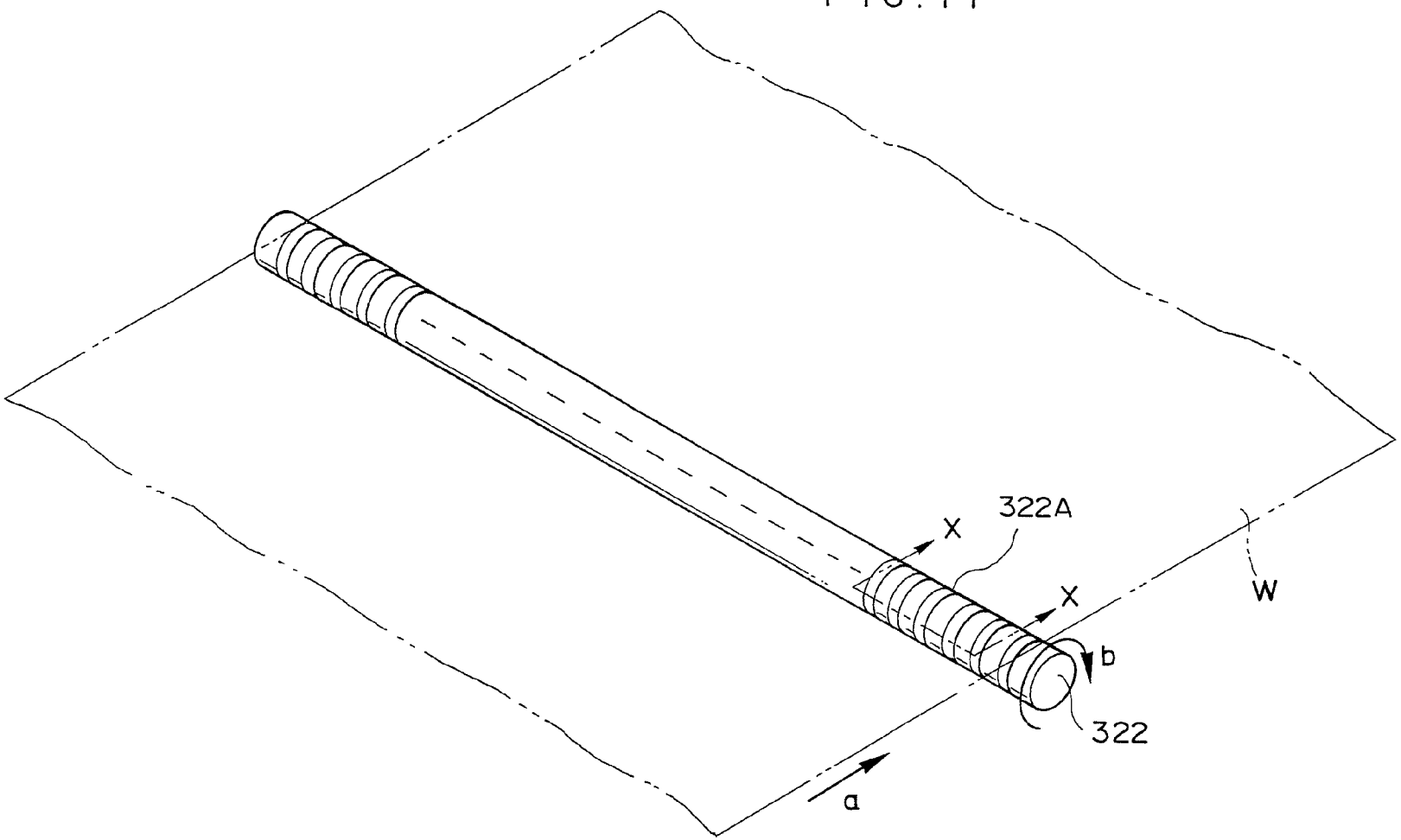
FIG. 11 is a perspective view showing the whole shape of a bar belonging to the bar coater shown in FIG. 10.
Figure 12:
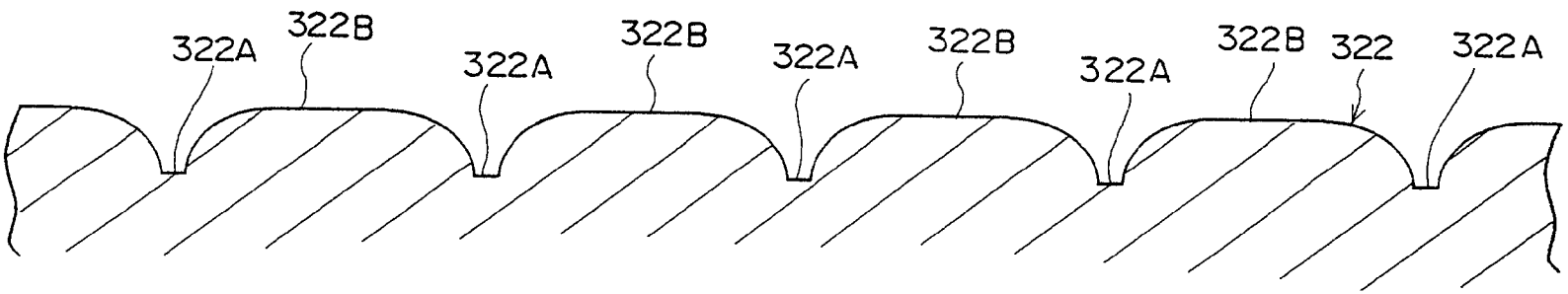
FIG. 12 is a sectional view of a bar shown in FIG. 11.

The detail of the bar 322 is shown in FIGS. 11 and 12. Here, FIG. 12 is a sectional view of the bar 322 taken along arrows X-X of FIG. 11.

As shown in FIGS. 11 and 12, grooves 322A having generally triangular sections are formed in the surface of the bar 322 at a predetermined interval along the circumferential direction. The edge portions of the grooves 322A are formed to have arcuate sections or curved shapes. Between the two adjoining grooves 322A, there are formed ridges 322B having flat sections at their crests. Here, the bar 322 may be formed to have a wave shape in which the grooves 322A are so formed close to each other as to have a generally sinusoidal shape.

The rotating speed of the bar 322 at the time of applying the first photosensitive layer forming liquid gives little damage to the roughed surface W2 of the support web W when the rotating speed of the bar 322 is not less than 90% and not more than 110% of the traveling speed of the support web W.

Figure 13:
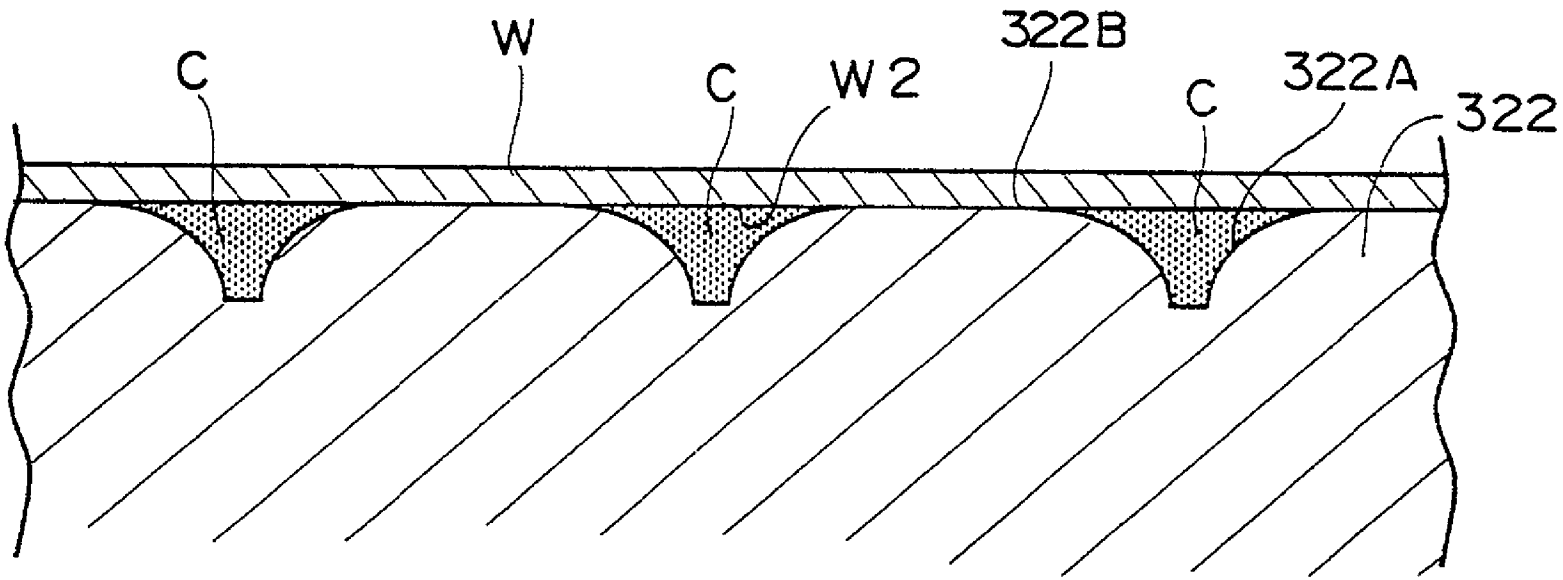
FIG. 13 is a sectional view showing the positional relation between the support web and the bar shown in FIG. 11, when a first photosensitive layer forming liquid is coated in the coating apparatus shown in FIG. 9.

FIG. 13 shows the relation between the support web W and the bar 322 while the support web W is being coated with the first photosensitive layer forming liquid.

At this coating time, the bar 322 abuts against the support web W at its ridges 322B and passages C for the first photosensitive layer forming liquid are formed between the support web W and the grooves 322A, as shown in FIG. 13.

Therefore, the first photosensitive layer forming liquid, as fed from the upstream liquid feed passage 330A to the upstream of the bar 322, wets the roughed surface W2 of the support web W and flows out via the passages C to the downstream side of the bar 322 so that it merges into the first photosensitive layer forming liquid which has been fed from the downstream liquid feed passage 330B to the downstream side of the bar 322.

Therefore, the coating thickness of the first photosensitive layer forming liquid is controlled to fall within a predetermined range and the first layer L1 is formed.

The rod coater 304 will be described in the following.

Figure 14:
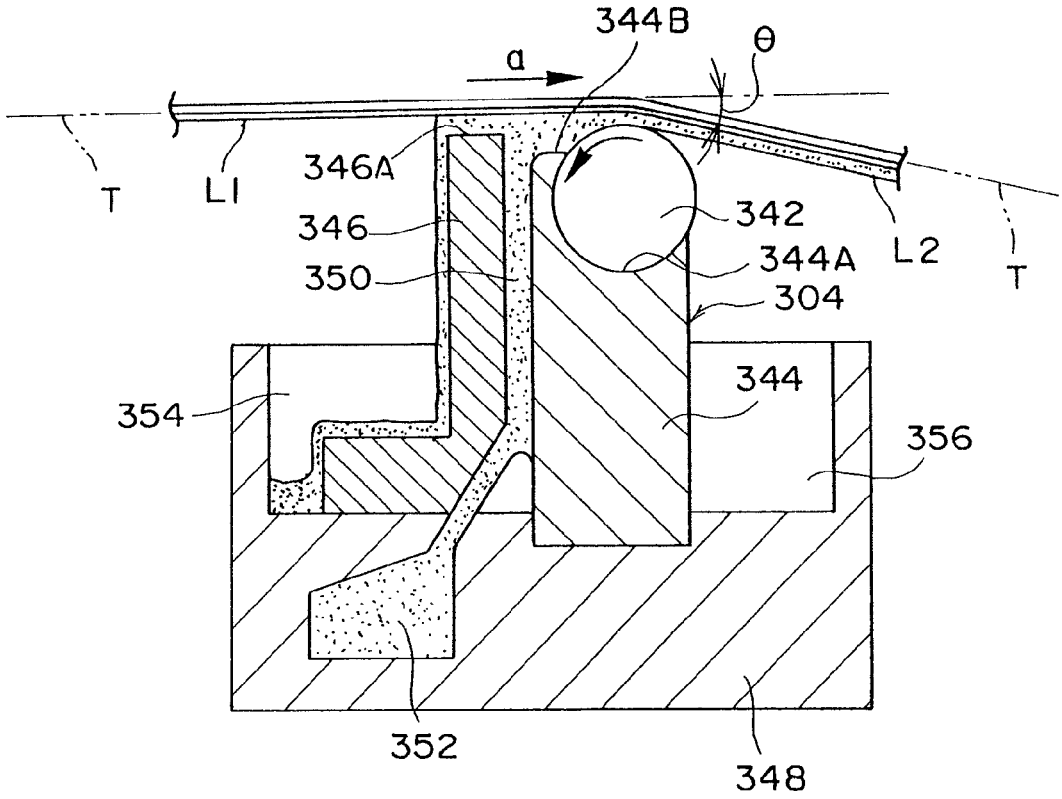
FIG. 14 is a sectional view showing a structure of a rod coater belonging to the coating apparatus shown in FIG. 9.

FIG. 14 shows a structure of the rod coater 304. The rod coater 304 is constructed to include: a rod 342 with a smooth surface; a rod supporting member 344 for supporting the rod 342 upward; a weir plate 346 disposed upstream of the rod supporting member 344 and parallel with the rod supporting member 344 and having a flat coating liquid flow establishing face on its upper face; and a platform 348 fixing the rod supporting member 344 and the weir plate 346 thereon.

The rotating direction of the rod 342 is opposite to the traveling direction a in the embodiment shown in FIG. 14 but may be the same direction as the traveling direction a.

The support web W is tensed to run on the rod 342 and bend downward in the shape of letter "V" around a portion of the web W passing near the rod 342, as shown in FIG. 14. The angle θ, as made between the portions of the support web W upstream and downstream of the rod 342, may be not less than 3 degrees and not more than 18 degrees or not less than 5 degrees and not more than 10 degrees.

The rod supporting member 344 is a generally plate-shaped member in which a groove 344A having an internal wall of a J-shaped section is formed in the upper face. The rod 342 is rotatably supported upward in the groove 344A.

The rod supporting member 344 includes a top face 344B positioned upstream of the groove 344A and formed at a lower level than the traveling plane T of the support web W. The upstream wall face of the rod supporting member 344, i.e., the wall face on the side to confront the weir plate 346 is made vertical.

The weir plate 346 is a plate-shaped member extending vertically toward the traveling plane T and fixed on the platform 348 at its lower end portion and is formed to have a flat top face 346A.

Between the rod supporting member 344 and the weir plate 346, there is formed a slit liquid feed passage 350. This liquid feed passage 350 communicates at its lower end with a liquid feed passage 352 which is formed in the platform 348. This liquid feed passage 352 is connected to a passage for feeding the second photosensitive layer forming liquid from an unshown tank. The liquid feed passage 352 is formed into a small chamber having a function to suppress the fluctuations of the passage of the second photosensitive layer forming liquid in the liquid feed passage 350 when the flow of the second photosensitive layer forming liquid fed from the passage fluctuates.

In the platform upstream of the weir plate 346 and downstream of the rod support member 344, respectively, there are formed overflow liquid pools 354 and 356 for receiving the second photosensitive layer forming liquid.

Moreover, these overflow liquid pools 354 and 356 are connected to the aforementioned tank via unshown conduits for returning the second photosensitive layer forming liquid received.

In the rod coater 304, the second photosensitive layer forming liquid fed from the liquid feed passage 352 and the liquid feed passage 350 applies an upward force to the support web W. The rod 342 is finished to have the smooth surface. Therefore, the support web W is slightly floated from the rod 342 by that upward force, and a portion of the second photosensitive layer forming liquid flows out downstream through the aforementioned clearance. As a result, the support web W is coated with the second photosensitive layer forming liquid of a predetermined thickness without touching of the rod 342, and the second layer L2 is formed.

The remaining portion of the first photosensitive layer forming liquid flows out upstream from the clearance between the support web W and the weir plate 346. As a result, the entrained air on the surface of the support web W is returned upstream.

The operations of the coating apparatus 300 will be described in the following.

The support web W is conveyed by a suitable conveyor, and the bar 322 of the bar coater 302 abuts against the roughed surface W2, as shown in FIG. 9. As a result, the first photosensitive layer forming liquid is applied to the roughed surface W2 to form the first layer L1.

The support web W thus having the first layer L1 formed in the bar coater 302 passes through the first layer drier 306, and the first layer L1 is dried.

The support web W having passed through the first layer drier 306 then passes over the rod coater 304, and the second photosensitive layer forming liquid is applied to the first layer L1 by the rod coater 304 to form the second layer L2 over the first layer L1.

The support web W thus having the second layer L2 formed then passes through the second layer drier 308, and the second layer L2 is dried.

Here, the sixth embodiment has been described on the example in which the photosensitive layers are formed as the first layer L1 and the second layer L2. However, the first layer L1 may be a heat-sensitive layer, and the second layer L2 may be a photo-thermal conversion layer.

In the coating apparatus 300, because the second layer L2 is formed in the untouched manner by the rod coater 304, the first layer L1 is not scraped off during forming the second layer L2.

Therefore, chips stripped from the first layer L1 neither migrate into the coated film of the second layer L2 nor separate out to contaminate the second photosensitive layer forming liquid, and a visible light exposure type planographic printing plate having the printing plate layer of a multi-layered structure can be stably manufactured.

Moreover, the bar 322 of the bar coater 302 rotates in the same direction as the traveling direction a of the support web W so that its relative speed to that of the support web W is low. Therefore, the roughed surface W2 of the support web W is less damaged by the grooves 322A than that of the coating apparatus of the prior art.

Seventh Embodiment

Figure 15:
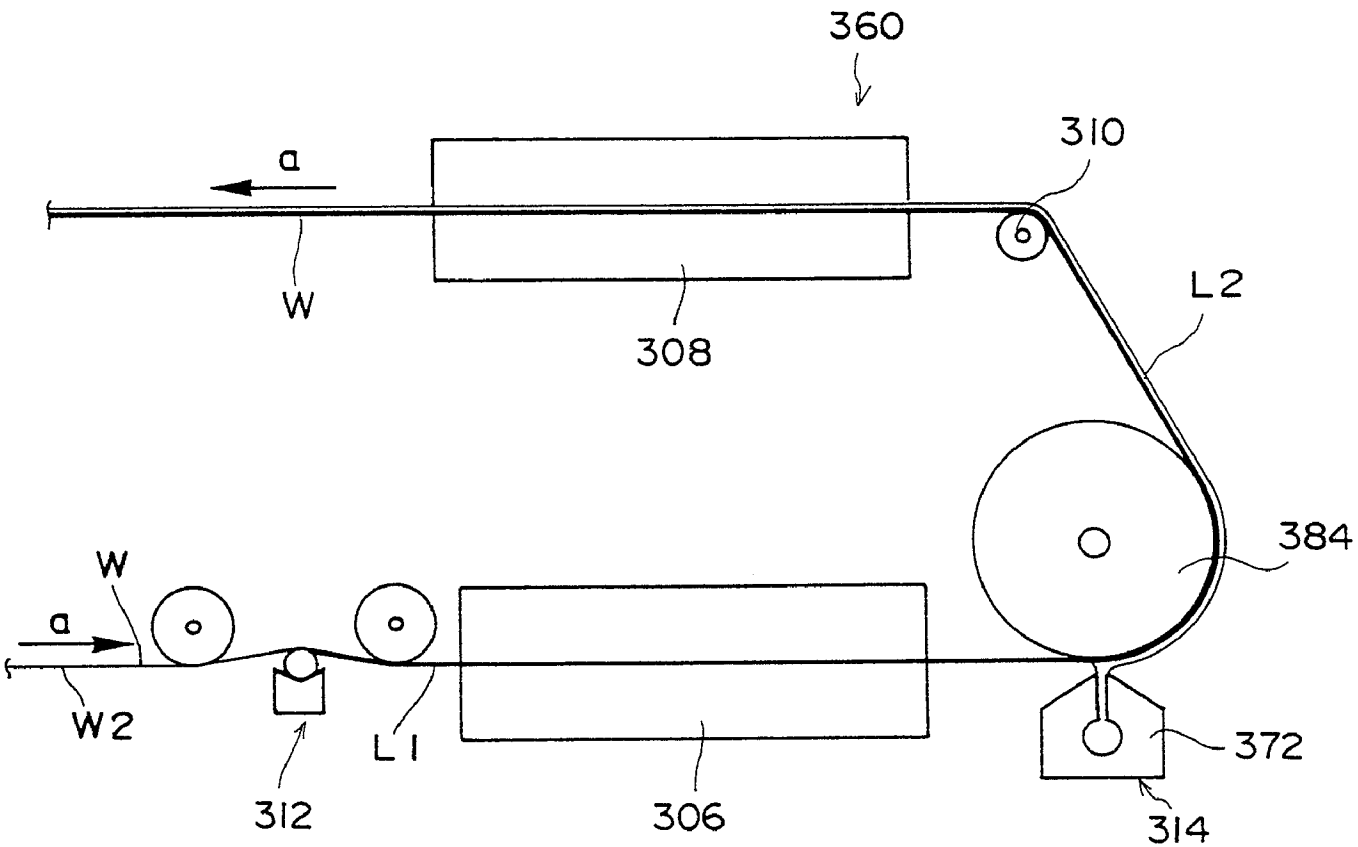
FIG. 15 is a schematic diagram showing a construction of a coating apparatus of a further embodiment of the invention.

FIG. 15 shows a construction of another embodiment of the coating apparatus of the invention. The same reference numerals in FIG. 15 as those of FIG. 9 designate the same components as those shown in FIG. 9.

Like the coating apparatus 300 of the sixth embodiment, a coating apparatus 360 of the seventh embodiment forms a printing plate layer comprising two photosensitive layers by applying two different kinds of photosensitive layer forming liquids sequentially to the support web W.

The coating apparatus 360 is constructed to comprise: a rod coater 312 arranged on the most upstream side with respect to the traveling direction a, for coating the roughed surface W2 of the support web W with the first photosensitive layer forming liquid to form the first layer L1; and an extrusion coater 314 disposed downstream of the rod coater 312, for applying the second photosensitive layer forming liquid to over the first layer L1 to form the second layer L2. Here, the rod coater 312 corresponds to the first layer rod coater in the coating apparatus of the invention.

The first layer drier 306 is arranged between the rod coater 312 and the extrusion coater 314. The second layer drier 308 is arranged downstream of the extrusion coater 314.

The individual components of the coating apparatus 360 will be described in the following.

The rod coater 312 has the same structure as that of the rod coater 304 belonging to the coating apparatus 300 of the sixth embodiment.

Figure 16:
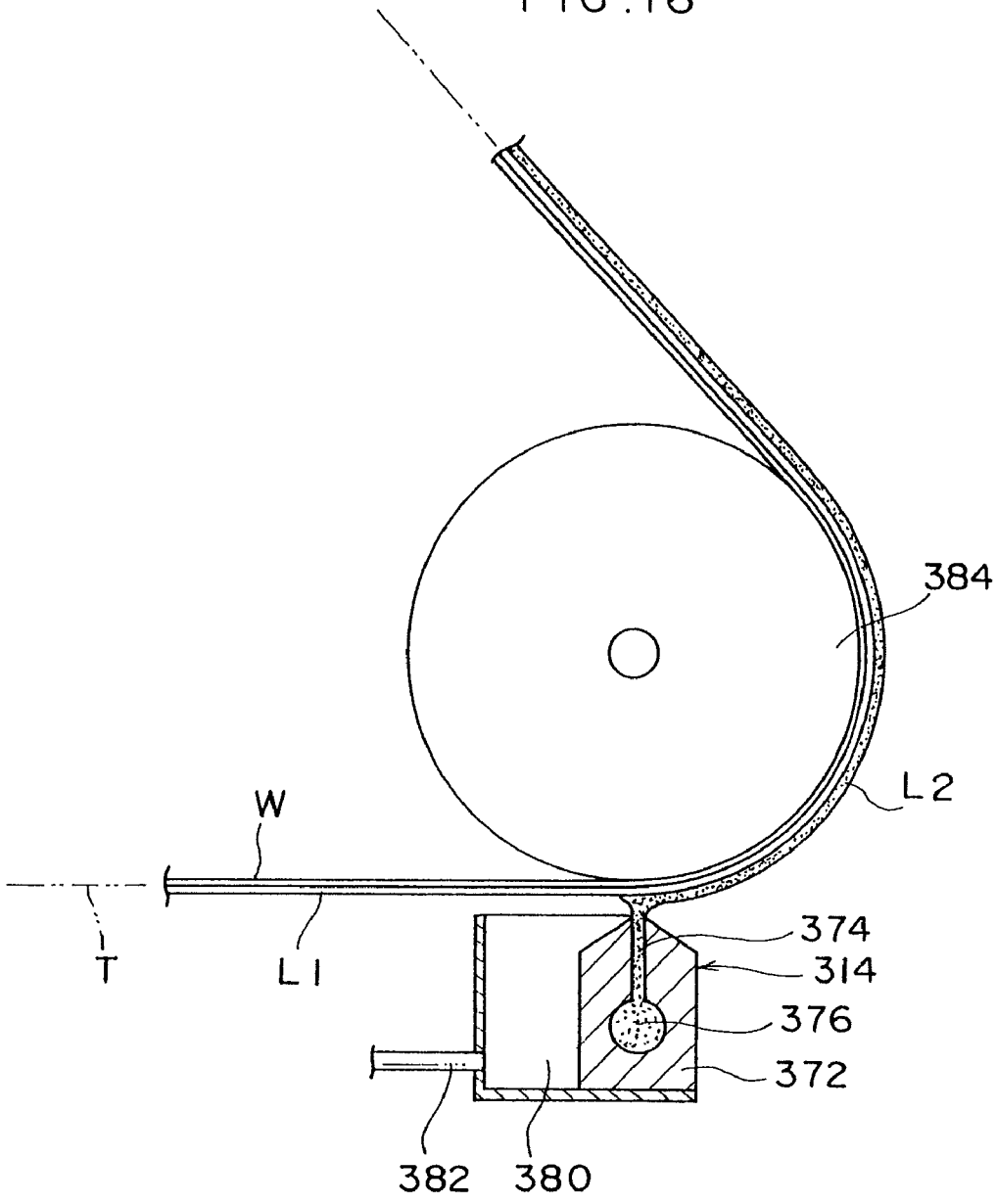
FIG. 16 is an enlarged sectional view showing an extrusion coater belonging to the coating apparatus shown in FIG. 15 and the vicinity of the extrusion coater.

As shown in FIGS. 15 and 16, the extrusion coater 314 is constructed to include: a body 372 of a plate shape having a wedge-shaped section converging toward the top portion and arranged below the traveling plane T; a discharge slit passage 374 opened in the longitudinal direction in the top portion of the body 372; a liquid feed passage 376 formed in the body 372 for feeding the second photosensitive layer forming liquid to the discharge slit passage 374; and a vacuum chamber 380 disposed upstream of the body 372. This body 372 is disposed at such a level that its top portion is untouched by the first layer L1 of the support web W. Moreover, the vacuum chamber 380 is provided with a vacuum conduit 382 for depressurizing the inside thereof.

On the other side of the body 142 of the extrusion coater 314 across the traveling plane T, there is disposed a backup roller 154 for conveying the support web W thereon.

As shown in FIG. 8, the second photosensitive layer forming liquid, as fed from the liquid feed passage 146, is discharged upward from the discharge slit passage 144 and the liquid wets the surface of the first layer L1 to form the second layer L2. Therefore, the extrusion coater 314 forms the second layer L2 free from touching the first layer L1.

The operations of the coating apparatus 360 will be described in the following.

In the coating apparatus 360, the rod coater 312 applies the first photosensitive layer forming liquid to the support web W to form the first layer L1.

The first layer L1 formed in the rod coater 312 is dried while the support web W is passing through the first layer drier 306.

The support web W having passed through the first layer drier 306 then passes over the extrusion coater 314 and is coated on the first layer L1 dried by the first layer drier 306, with the second photosensitive layer forming liquid to form the second layer L2.

The second layer L2 thus formed in the extrusion coater 314 is fitted while the support web W is passing through the second layer drier 308.

In the coating apparatus 360, the first photosensitive layer forming liquid is applied to the support web W by the rod coater 312.

In case a layer forming liquid such as the first photosensitive layer forming liquid is applied by the rod coater to an object such as the support web W, as has been described in connection with the sixth embodiment, the coating object is floated from the rod of the rod coater by the pressure of the layer forming liquid thereby to form a clearance between the object and the rod. Moreover, the layer forming liquid flows out downstream through the clearance and the liquid is applied while being metered to a predetermined thickness.

In the rod coater 312, therefore, the support web W is coated with the first photosensitive layer forming liquid while being untouched by the rod.

While the second layer L2 is being formed, therefore, the first layer L1 is prevented from being scraped off and scraped chips of the layer L1 neither migrate into the coating film of the second layer L2 nor separate out to contaminate the second photosensitive layer forming liquid. During forming the first layer L1, moreover, the rod of the rod coater 312 is prevented from touching and damaging the roughed surface W2 of the support web W.

Of the coating apparatus 360, therefore, an excellent visible light exposure type or a laser exposure type planographic printing plate having the printing plate layer of the multi-layered structure can be manufactured more easily than the coating apparatus 300 of the sixth embodiment.

Eighth Embodiment

Figure 17:
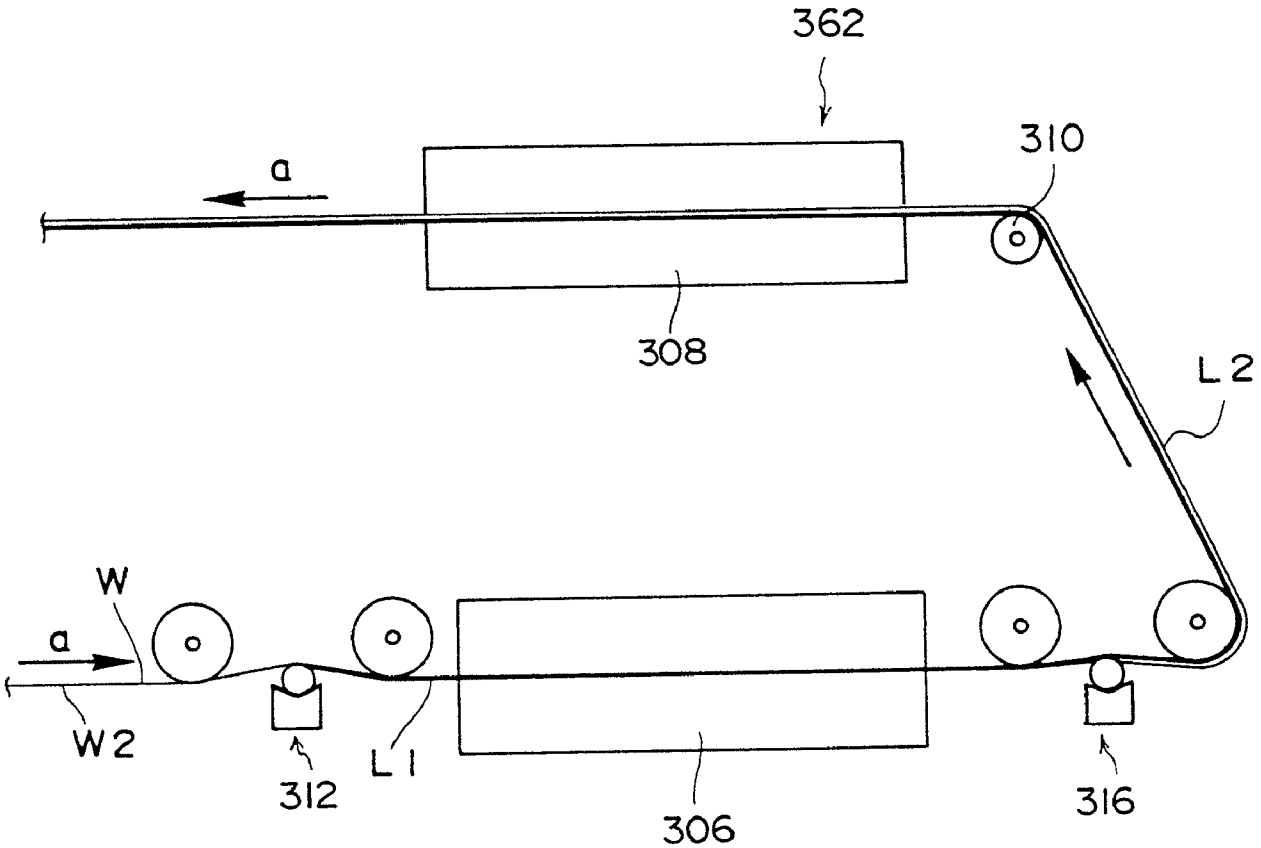
FIG. 17 is a schematic diagram showing a construction of a coating apparatus of a further embodiment of the invention.

FIG. 17 shows a construction of another embodiment of the coating apparatus of the invention. The same reference numerals in FIG. 17 as those of FIGS. 9 to 15 designate the same components as those shown in FIGS. 9 to 15.

Like the coating apparatus 300 of the sixth embodiment, too, a coating apparatus 362 of the eighth embodiment forms a printing plate layer composed of two photosensitive layers by applying two different kinds of photosensitive layer forming liquids sequentially to the support web W.

The coating apparatus 362 has a construction similar to that of the coating apparatus 360 of the seventh embodiment except a rod coater 316 used in place of the extrusion coater 314 in the coating apparatus 360 of the seventh embodiment.

The rod coater 316 has a construction similar to that of the rod coater 304 in the coating apparatus 300 of the sixth embodiment.

In the coating apparatus 362, the first photosensitive layer forming liquid is applied by the rod coater 312 to the roughed surface W2 of the support web W to form the first layer L1. The support web W thus having the first layer L1 formed passes through the first layer drier 306 and the first layer L1 is dried.

As the support web W passes over the rod coater 316, moreover, the second photosensitive layer forming liquid is applied to the dried first layer L1 of the support web W to form the second layer L2.

The support web W thus having the second layer L2 formed passes through the second layer drier 308 and the second layer L2 is dried.

In the coating apparatus 362, both the first layer L1 and the second layer L2 are formed by applying the first photosensitive layer forming liquid and the second photosensitive layer forming liquid by the rod coaters. As has been described in connection with the sixth embodiment and the seventh embodiment, therefore, the first photosensitive layer forming liquid or the second photosensitive layer forming liquid is applied by the rod coater 312 and the rod coater 316 while the rods do not touch the support web.

Of the coating apparatus 362, therefore, an excellent visible light exposure type of planographic printing plates with the printing plate layer of the multi-layered structure can be easily manufactured like the coating apparatus 360 of the seventh embodiment.

Ninth Embodiment

Figure 18:
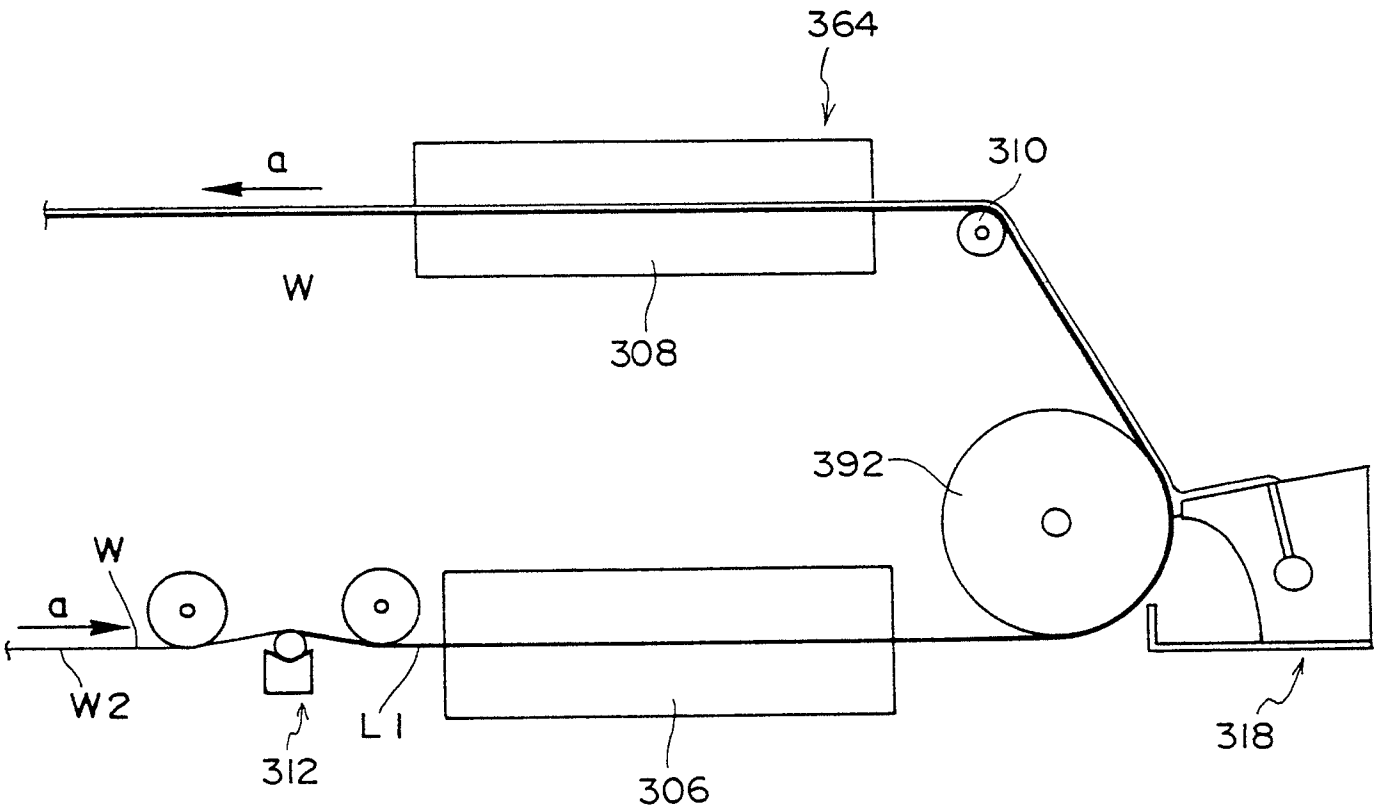
FIG. 18 is a schematic diagram showing a construction of a coating apparatus of a further embodiment of the invention.

FIG. 18 shows a construction of still another embodiment of the coating apparatus of the invention. In FIG. 18, the same reference numerals as those of FIGS. 9 to 15 designate the same components as those shown in FIGS. 9 to 15.

A coating apparatus 364 of the ninth embodiment has a construction similar to that of the coating apparatus 360 of the seventh embodiment except a slide bead coater 318 used as a non-contact coating apparatus in place of the extrusion coater 314 in the coating apparatus 360 of the seventh embodiment.

Figure 19:
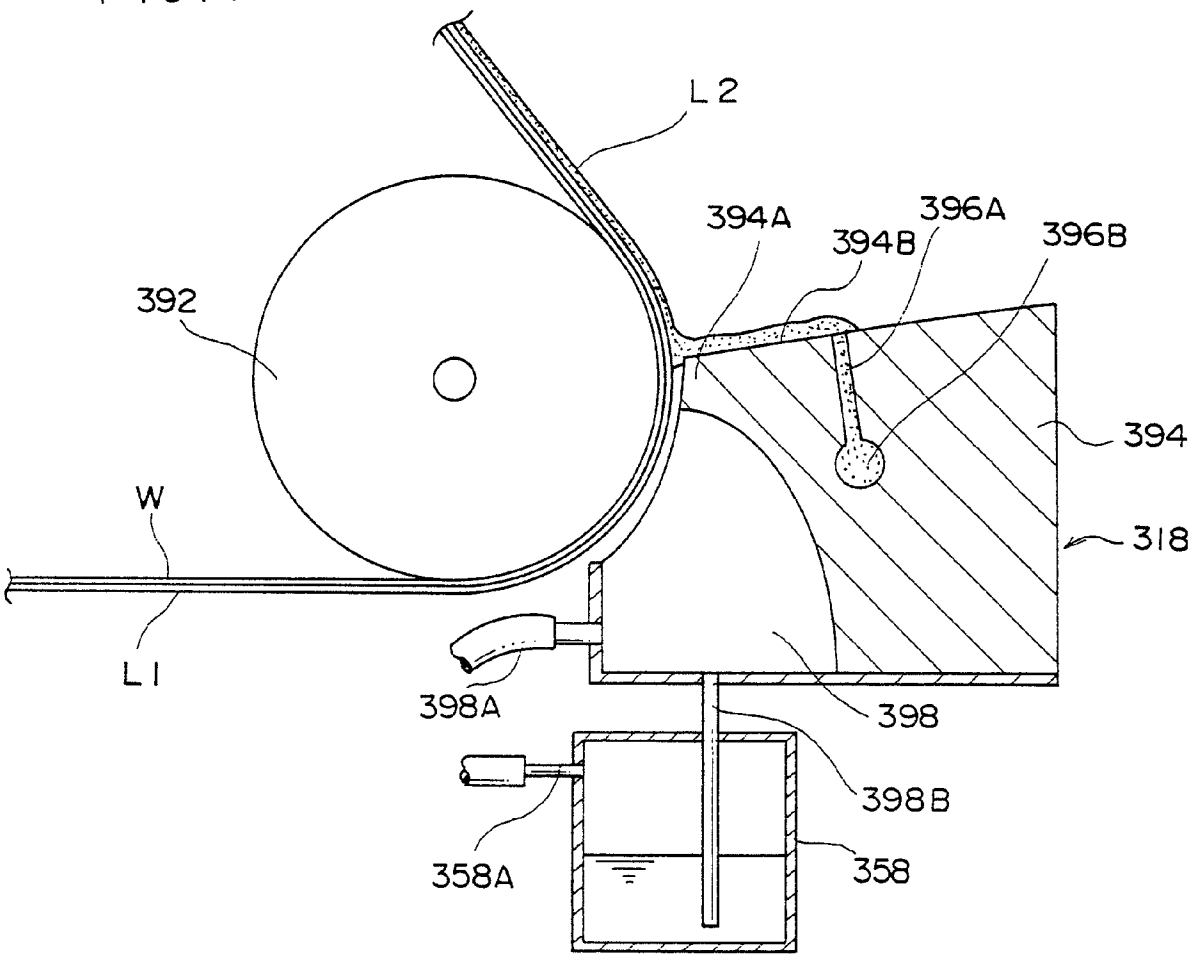
FIG. 19 is an enlarged sectional view showing a slide bead coater belonging to the coating apparatus shown in FIG. 18 and the vicinity of the slide bead coater.

Next, FIG. 19 shows the slide bead coater 318 and its vicinity.

The slide bead coater 318 is constructed to include: a backup roller 392 for rotating counter-clockwise to cause the support web W having the first layer L1 to run thereon thereby to convey the support web W; and a slide bead coater body 394 for applying the second photosensitive layer forming liquid to the support web W being made to run on the backup roller 392.

The slide bead coater body 394 is formed into a generally rectangular parallelepiped block having a leading end portion 394A protruding toward the backup roller 392. This leading end portion 394A has an end edge formed parallel with the backup roller 392. The slide bead coater body 394 is arranged to establish a clearance of about 0.1 to 1 mm normally between the end edge of the leading end portion 394A and the first layer L1 of the support web W when the support web W is to be coated with the second photosensitive layer forming liquid. However, the size of the clearance can be determined of the thickness of the first layer L1 to be formed on the support web W.

On the upper face of the slide bead coater body 394, a slide face 394B or a plane is formed sloping downward from a discharge slit 396A toward the end edge of the leading end portion 394A. In the central portion of the slide face 394B, there is formed the discharge slit 396A which extends parallel with the end edge of the leading end portion 394A for discharging the second photosensitive layer forming liquid upward. In the slide bead coater body 394 and below the discharge slit 396A, there is formed a liquid feed passage 396B for feeding the second photosensitive layer forming liquid to the discharge slit 396A. This discharge slit 396A may be provided in plurality when a third layer, a fourth layer and so on are to be formed over the second layer L2.

In the slide bead coater body 394 and below the leading end portion 394A, a vacuum chamber 398 is formed. This vacuum chamber 398 is provided in its bottom portion with a vacuum tube 398A for depressurizing the inside thereof and on its bottom face with a drain tank 358 extending downward for draining the second photosensitive layer forming liquid reserved therein. Below the vacuum chamber 398, there is disposed a drain tank 358 for reserving the second photosensitive layer forming liquid drained via the drain pipe 398B. The drain tank 358 is provided near its ceiling with a vacuum tube 358A for depressurizing the inside thereof.

When the second photosensitive layer forming liquid is to be applied to the support web W, the inside of the vacuum chamber 398 is depressurized to about 0.5 to 10 cm water-column, for example, by a vacuum pump or an aspirator connected to the vacuum tube 398A. Moreover, the inside of the drain tank 358 is also depressurized to a level nearly equal to that in the vacuum chamber 398 via the vacuum tube 358A.

In the slide bead coater 318, the second photosensitive layer forming liquid is so discharged from the discharge slit 396A of the slide bead coater body 394 as to fall on the slide face 398B and coating beads may be formed between the end edge of the leading end portion 398A and the first layer L1 in the support web W thereby to apply the second photosensitive layer forming liquid. As a result, the second layer L2 is formed in the non-contact manner.

In the coating apparatus 364 of the ninth embodiment, both the first layer L1 and the second layer L2 are formed in the non-contact manner. While the second layer L2 is being formed, therefore, the first layer L1 is not scraped off, the chips of the first layer L1 neither migrate into the coating film of the second layer L2 nor separate out to contaminate the second photosensitive layer forming liquid. While forming the first layer L1, moreover, the rod of the rod coater 312 is kept away from touching the roughed surface W2 not to damage the roughed surface W2 of the support web W.

Of the invention exemplified by the coating apparatus 364, therefore, an excellent visible light exposure type planographic printing plate having the printing plate layer of the multi-layered structure can be manufactured more easily than the coating apparatus 300 of the sixth embodiment.

The invention will be described more specifically in connection with the following Examples 5-7.

EXAMPLE 5

A layer forming liquid, as enumerated in Table 1, was prepared as Example 5.

TABLE 1

| LFL | Viscosity (cp) | Surface Tension | Main Components |
|---|---|---|---|
| 1st PLFL | 50 | 23 dynes | SS of PR |
| 2nd PLFL | 300 | 23 dynes | SS of PR |

In Table 1:

LFLLayer Forming Liquid;

PLFLPhotosensitive Layer Forming Liquid; and

SS of PRSolvent Solution of Photosensitive Resin.

The support web W was made by graining one face of an aluminum web having a width of 700 to 1,500 mm by an ordinary method and by anodizing the grained surface.

By using the coating apparatus 300 shown in FIG. 9, the printing plate layers composed of the two layers of the first layer L1 and the second layer L2 were laminated over the support web W to form the planographic printing plate.

The conveyor speed of the support web W was set to 60 m/min.

The bar coater 302 applied the first photosensitive layer forming liquid to form the first layer L1, and the rod coater 304 applied the second photosensitive layer forming liquid to form the second layer L2. The bar 322 was rotated forward in the bar coater 302, and the rod 342 was rotated backward in the rod coater 304.

The hot-air drying devices were used as the first layer dryer 306 and the second layer dryer 308. A wind direction was to suck the air into the devices. Between the bar coater 302 and the first layer dryer 306 and between the second layer dryer 308 and the rod coater 304, there were interposed baffles for eliminating any heterogeneity of the flow velocity and the distribution of the hot air in the first layer dryer 306 and the second layer dryer 308.

The periodic observations of the first layer L1 and the second layer L2 after the start of the coating operations detected no deposit of a solid substance on the second layer L2. Small nicks, as formed from the sand pattern by the grooves 322A of the bar 322, were found in the roughed surface W2 of the support web W. Despite this finding, the nicks hardly affected the quality of the planographic printing plate obtained adversely, and the planographic printing plate quality successfully satisfied the standards.

EXAMPLE 6

In Example 6, a planographic printing plate was manufactured by coating the support web W with the first photosensitive layer forming liquid and the second photosensitive layer forming liquid in accordance with procedures similar to those of Example 5 except the use of the coating apparatus 360 shown in FIG. 15.

The observations of the first layer L1 and the second layer L2 after the start of the coating operations detected no deposit of a solid substance on the second layer L2. No nick, as might otherwise have been formed as a result of the scrubbing of the rod of the rod coater 312, was found in the roughed surface W2. The planographic printing plate obtained had a stable quality.

EXAMPLE 7

In Example 7, a planographic printing plate was manufactured by coating the support web W with the first photosensitive layer forming liquid and the second photosensitive layer forming liquid in accordance with procedures similar to those of Example 5 excepting the use of the coating apparatus 362 shown in FIG. 17.

The observations of the first layer L1 and the second layer L2 after the start of the coating operations could find no separation of a solid substance on the second layer L2. No nick, as might otherwise have been formed as a result of the scrubbing of the rod of the rod coater 312, was found in the roughed surface W2. The planographic printing plate obtained had a stable quality.

[Comparison 2]

As Comparison 2, in Example 5, the bar 322 of the bar coater 302 was rotated backward, and the rod coater 304 was replaced by such a bar coater similar to the bar coater 302 as has a forward rotating bar. Except these operations, the first photosensitive layer forming liquid and the second photosensitive layer forming liquid were applied as in Embodiment 5.

Before long after the start of the coating operations, a powdery solid substance appeared in the second photosensitive layer forming liquid. The analysis of this photosensitive layer forming liquid revealed that the solid substance was identical to the photosensitive resin forming the first layer L1. From this, it is also found that the existing first layer L1 was scrubbed and scraped off with the bar of the second layer forming bar coater when the second layer L2 was to be formed by applying the second photosensitive layer forming liquid in the bar coater.

In the roughed surface W2 of the support web W, moreover, it is clearly confirmed that the sand pattern was crushed and broken with the grooves 322A in the bar 322 of the bar coater 302.

[Comparison 3]

As Comparison 3, a PS plate was manufactured as in Comparison 2 except rotating the bar 322 of the bar coater forward.

Before long after the start of the coating operations, a powdery solid substance appeared, although less than those of Comparison 1, in the second photosensitive layer forming liquid. The analysis of this photosensitive layer forming liquid revealed that the solid substance was identical to the photosensitive resin forming the first layer L1. From this, it was also found that the existing first layer L1 was scrubbed and scraped off with the bar of the second layer forming bar coater when the second layer L2 was to be formed by applying the second photosensitive layer forming liquid in the bar coater.

In the roughed surface W2 of the support web W, moreover, it was confirmed that the sand pattern was crushed and broken with the grooves 322A in the bar 322 of the bar coater 302, but the degree of breakage was less than that of Comparison 2.

Of the invention, as has been described hereinbefore, there are provided the coating apparatus and the coating method for forming the planographic printing plate having the laminated type printing plate layer stably.

Tenth Embodiment

Figure 20:
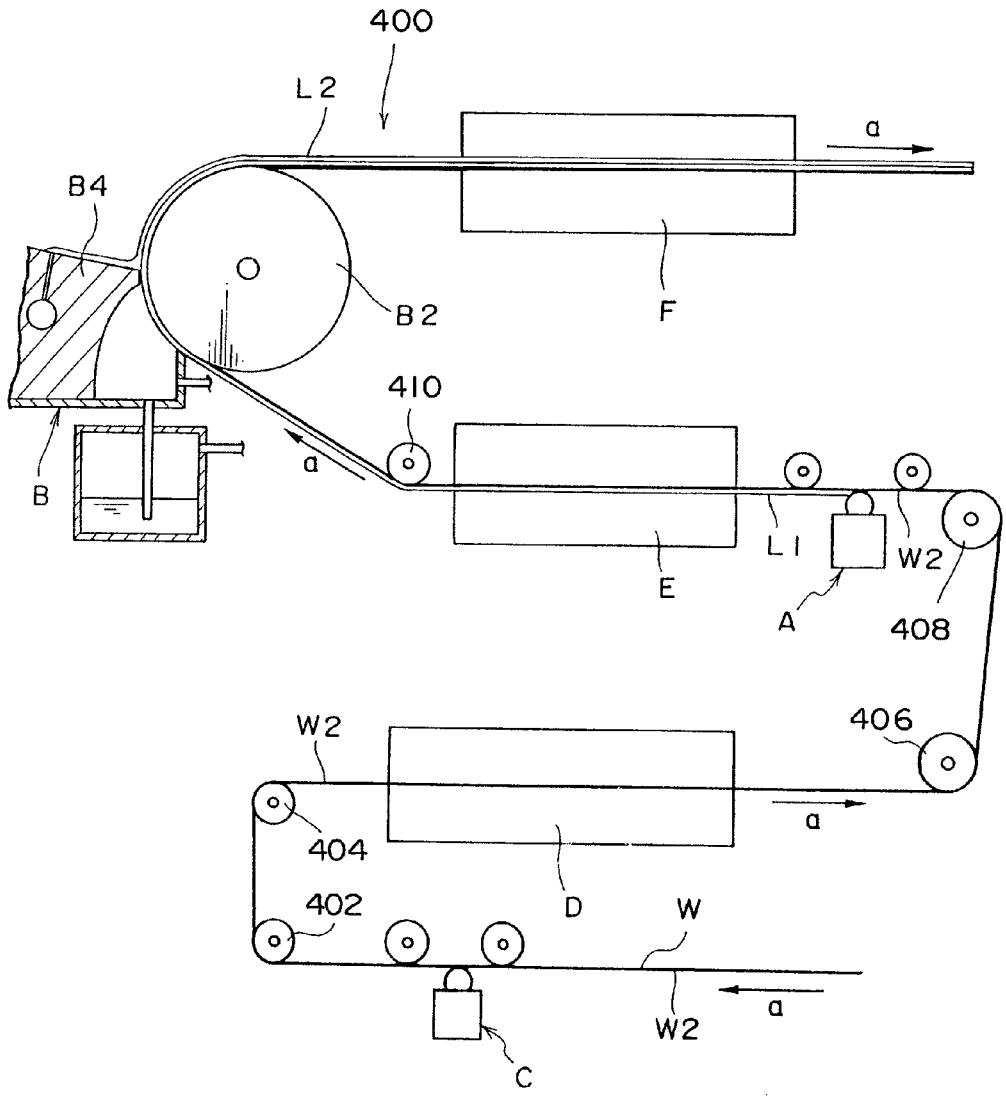
FIG. 20 is a schematic diagram showing a construction of a further embodiment of the coating apparatus of the invention.

FIG. 20 shows a construction of a coating apparatus of another embodiment of the invention.

A coating apparatus 400 of the tenth embodiment is constructed to comprise: conveyor rollers 402, 404, 406, 408 and 410 for conveying the support web W along the transfer direction a; and a bar coater C. This bar coater C is disposed on the most upstream side of the traveling direction a of the support web W for treating the surface of the support web W by coating the roughed surface of the support web W with the surface treating liquid which is composed mainly of a dilute solution of a hydrophilic vinyl polymer, as the hydrophilic compound treatment described in "Summary of the Invention". The coating apparatus 400 further comprises a bar coater A and a slide hopper type coater B. The bar coater A is disposed downstream of the bar coater C with respect to the traveling direction a, for coating the surface-treated side of the support web W with the first photosensitive layer forming liquid as a layer forming liquid, to form a first photosensitive layer as the first layer L1. The slide hopper coater B is disposed downstream of the bar coater A with respect to the traveling direction a, for coating the surface of the first layer L1 with the second photosensitive layer forming liquid containing a photosensitive resin different from that of the first photosensitive layer forming liquid, as a second layer forming liquid, to form a second photosensitive layer as the second layer L2. Here, the "downstream with respect to the traveling direction a" will be simply referred to as the "downstream", and the "upstream with respect to the traveling direction a" will be simply referred to as the "upstream". Moreover, the first photosensitive layer forming liquid corresponds to the first layer forming liquid in the invention, and the second photosensitive layer forming liquid corresponds to the second layer forming liquid.

Between the bar coater C and the bar coater A, a surface treating layer drying zone D is provided for drying the layer of the surface treating liquid applied in the bar coater C. Between the bar coater A and the slide hopper coater B, a first layer drying zone E is provided for drying the first layer L1 in the bar coater A. On the downstream side of the slide hopper coater B, a second layer drying zone F is provided for drying the second layer L2 formed in the slide hopper coater B. Conveyor rollers 402 and 404 are arranged between the bar coater C and the surface treating layer drying zone D. Conveyor rollers 406 and 408 are arranged between the surface treating layer drying zone D and the bar coater A. Moreover, conveyor roller 410 is arranged between the first layer drying zone E and the slide hopper coater B.

The support web W corresponds to the object to be coated by the coating apparatus of the invention.

Figure 21:
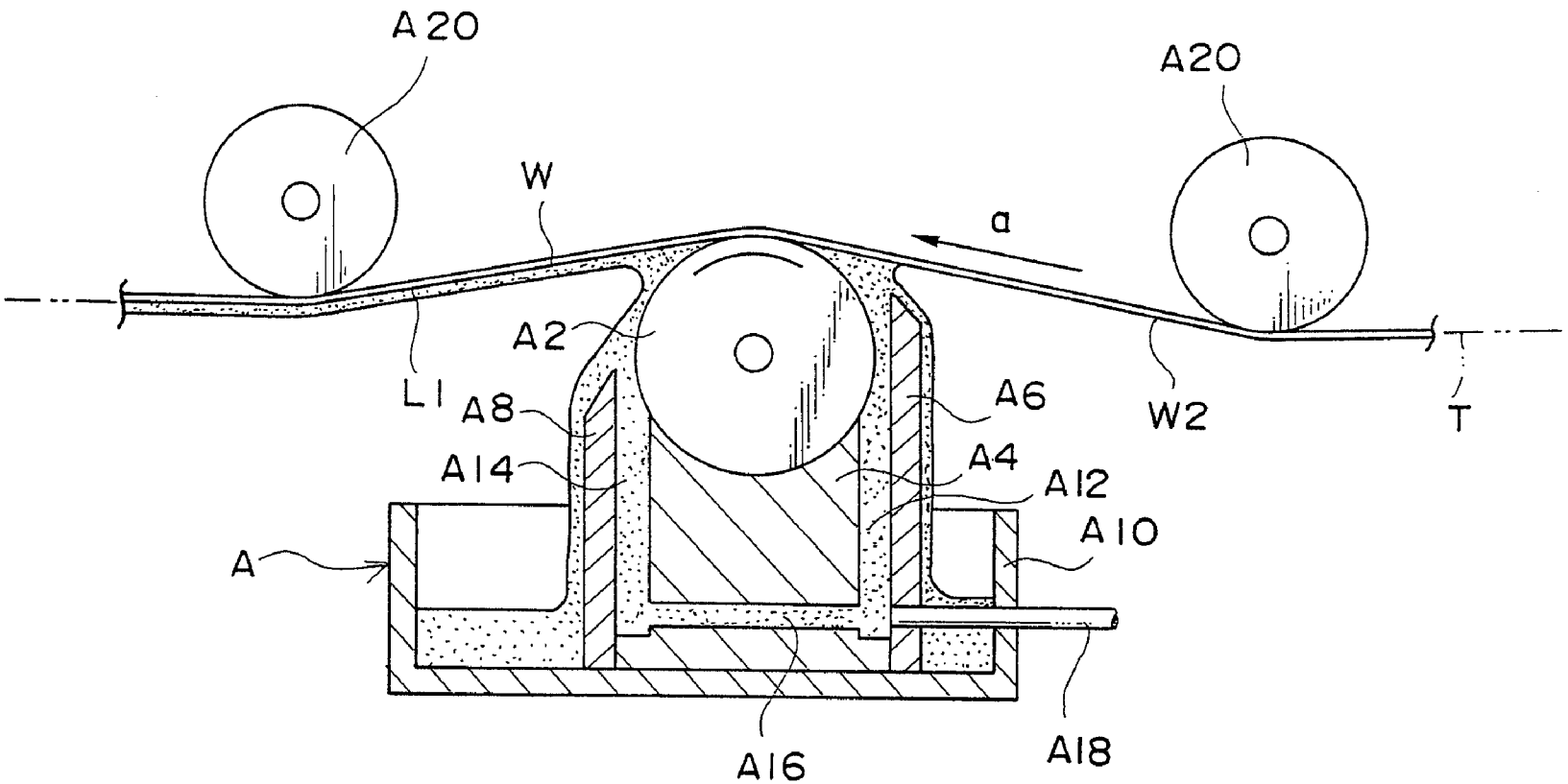
FIG. 21 is an enlarged view showing the detailed construction of a first layer forming bar coater belonging to the coating apparatus shown in FIG. 20.

The bar coater A and its vicinity are shown in FIG. 21. Here, the bar coater C has a similar construction.

As shown in FIG. 21, the bar coater A is constructed to include: a bar A2 for rotating about its axis while abutting against the roughed surface W2 of the support web W to coating the roughed surface W2 with the first photosensitive layer forming liquid; a bar supporting member A4 for supporting the bar A2 upward with grooves formed in its top face and having semicircular sections; an upstream weir plate A6 erected upstream of the bar supporting member A4 and extending vertically toward the traveling plane T or the conveyor path of the support web W; a downstream weir plate A8 erected downstream of the bar supporting member A4 and extending vertically toward the traveling plane T; and a platform A10 fixing the bar supporting member A4, the upstream weir plate A6 and the downstream weir plate A8 thereon.

Between the bar supporting member A4 and the upstream weir plate A6, there is interposed an upstream liquid feed passage A12 for feeding the first photosensitive layer forming liquid to the upstream side of the bar A2. Between the bar supporting member A4 and the downstream weir plate A8, there is interposed a downstream liquid feed passage A14 for feeding the first photosensitive layer forming liquid to the downstream side of the bar A2. The upstream liquid feed passage A12 and the downstream liquid feed passage A14 communicate with each other via a communication passage A16 formed below the bar supporting member A4.

To the lower end portion of the upstream liquid feed passage A12, there is connected a liquid feed conduit A18 for feeding the first photosensitive layer forming liquid.

Over the traveling plane T, a pair of web pressure rollers A20 are arranged for pressurizing the support web W toward the bar A2 while being rotated about their axes at the time of applying the first photosensitive layer forming liquid.

At the time of applying the first photosensitive layer forming liquid, while the bar A2 rotates in abutment against the roughed surface W2 of the support web W, the first photosensitive layer forming liquid is fed to the lower end portion of the upstream liquid feed passage A12.

A portion of the first photosensitive layer forming liquid is fed from the upstream liquid feed passage A12 to the upstream side of the bar A2 and the portion of the liquid excessively wets the roughed surface W2. The first photosensitive layer forming liquid having wetted the bar A2 is metered to a specified coating thickness to form the first layer L1.

The remaining portion of the first photosensitive layer forming liquid is fed via the communication passage A16 and the downstream liquid feed passage A14 to the downstream side of the bar A2 thereby to prevent the air from being entrained from the downstream side of the bar A2.

Figure 22:
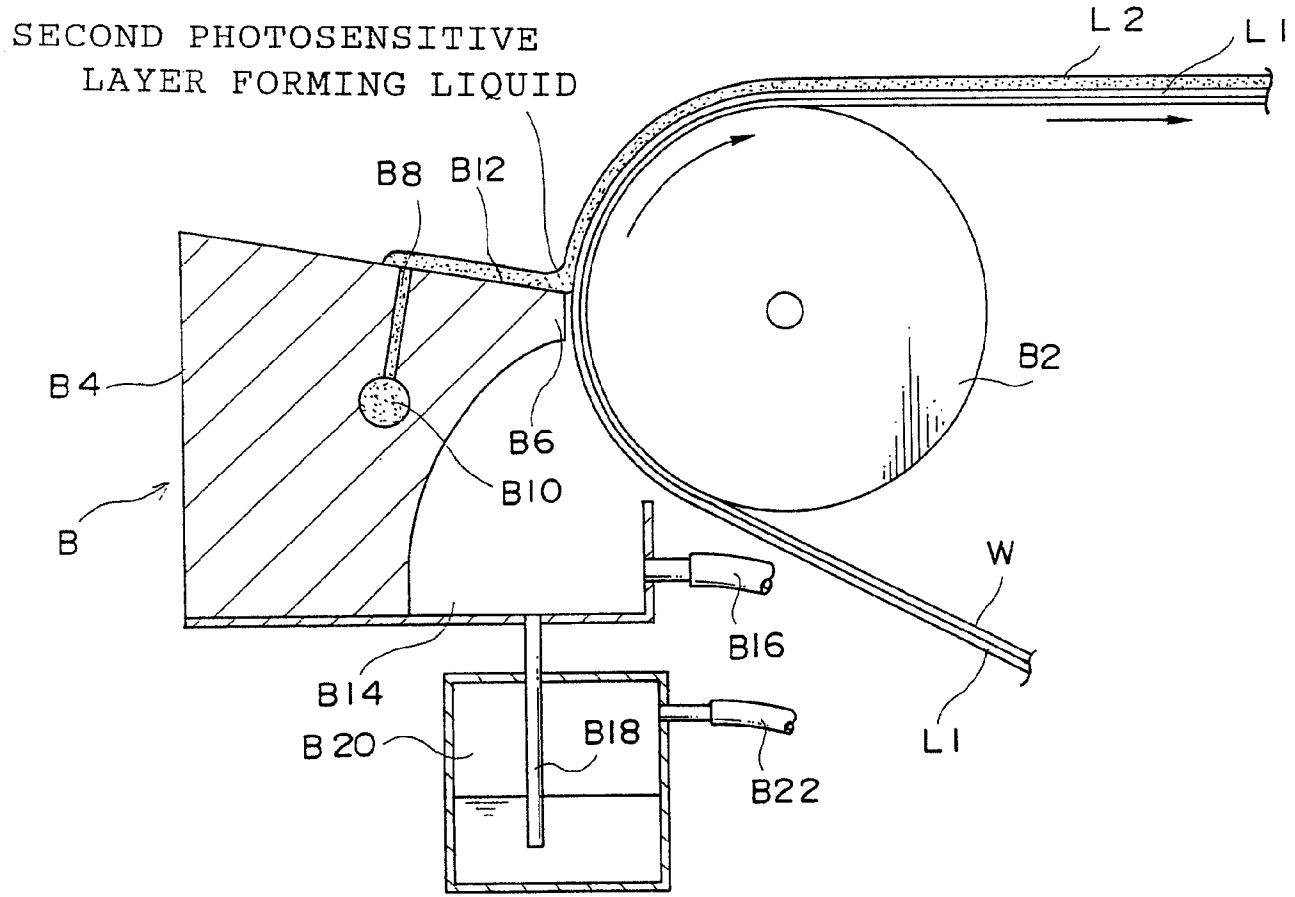
FIG. 22 is an enlarged view showing the detailed construction of a slide hopper type coater belonging to the coating apparatus shown in FIG. 20.

Next, the slide hopper coater B and its vicinity are shown in FIG. 22.

As shown in FIGS. 20 and 22, the slide hopper coater B is constructed to include: a backup roller B2 for rotating clockwise of FIG. 22 to cause the support web W having the first layer L1 to run thereon thereby to convey the support web W; and a slide bead coater B4 for applying the second photosensitive layer forming liquid to the support web W being made to run on the backup roller B2.

The slide bead coater B4 is formed into a generally rectangular parallelepiped block having a leading end portion B6 protruding toward the backup roller B2. This leading end portion B6 has an end edge formed parallel with the side face of the backup roller B2. The slide bead coater B4 is arranged to establish a clearance of about 0.1 to 1 mm normally between the end edge of the leading end portion B6 and the first layer L1 of the support web W when the support web W is to be coated with the second photosensitive layer forming liquid. The size of the clearance can be determined of the thickness of the first layer L1 to be formed on the support web W.

The slide bead coater B4 is provided with: a discharge slit B8 formed parallel with the end edge of the leading end portion B6 for discharging the second photosensitive layer forming liquid upward; a liquid feed passage B10 disposed below the discharge slit B8 for feeding the second photosensitive layer forming liquid to the discharge slit B8; and a slide face B12 sloping downward from the discharge slit B8 toward the end edge of the leading end portion B6, for providing a slope on which the second photosensitive layer forming liquid discharged from the discharge slit B8 falls. Here, this discharge slit B8 may be provided in plurality when a desired number of layers, i.e., third layer, a fourth layer and so on are to be formed over the second layer L2.

In the slide bead coater B4 and adjacent to below the leading end portion B6, a vacuum chamber B14 is formed. This vacuum chamber B14 is provided in its bottom portion with a vacuum tube B16 for depressurizing the inside thereof and on its bottom face with a drain tank B18 extending downward for draining the second photosensitive layer forming liquid reserved therein. Below the vacuum chamber B14, a drain tank B20 is disposed for reserving the second photosensitive layer forming liquid drained via the drain pipe B18. The drain tank B20 is provided near its ceiling with a vacuum tube B22 for depressurizing the inside thereof.

When the second photosensitive layer forming liquid is to be applied to the support web W, the inside of the vacuum chamber B14 is depressurized to about 0.5 to 10 cm water-column, for example, by a vacuum pump or an aspirator connected to the vacuum tube B16. Moreover, the inside of the drain tank B20 is also depressurized to a level nearly equal to that in the vacuum chamber B14 via the vacuum tube B22.

In the slide hopper coater B, the second photosensitive layer forming liquid is so discharged from the discharge slit B8 of the slide bead coater B4 as to fall on the slide face B12 and coating beads are formed between the end edge of the leading end portion B6 and the first layer L1 in the support web W thereby to apply the second photosensitive layer forming liquid.

By forming the coating beads, the second photosensitive layer forming liquid is applied to the surface of the first layer L1 to form the second layer L2.

In the surface treating layer drying zone D, the first layer drying zone E and the second layer drying zone F, there may be used the hot-air drying devices using hot air, the contact heat transfer type of drying devices using the heating by heating rollers, and the induction-heating type drying device using the induction-heating from electromagnetic coils.

The operations of the coating apparatus 400 will be described in the following.

In the coating apparatus 400, the support web is conveyed by the conveyor rollers 402, 404, 406, 408 and 410 and the web travels at a constant speed along the traveling direction a.

The support web is conveyed near the bar coater C with its roughed surface W2 facing downward, as shown in FIG. 20, and the bar of the bar coater C abuts against the roughed surface W2. Therefore, the roughed surface W2 is coated with the surface treating liquid.

The support web W with the roughed surface W2 coated with the surface treating liquid in the bar coater C is turned back in a U-shape by the conveyor rollers 402 and 404 and passes through the surface treating layer drying zone D. The surface treating liquid applied to the roughed surface W2 is dried in the surface treating layer drying zone D, and a coating film to improve the contactability with the first layer L1 is formed on the roughed surface W2.

Here, the hydrophilic vinyl polymer in the surface treating liquid has an extremely low density, and the surface treating liquid is substantially composed of the solvent. Thus, the coating film to be formed on the roughed surface W2 is extremely thin. Even if the surface of the roughed surface W2 is scrubbed with the bar A2 of the bar coater A, therefore, no chips due to scrubbing the surface W2 will happen to come out to contaminate the first photosensitive layer forming liquid to be applied by the bar coater or to deteriorate the surface state of the first layer L1.

The support web W passed through the surface treating liquid drying zone D is turned back again in the U-shape by the conveyor rollers 406 and 408 on the upstream side of the bar coater A, and the roughed surface W2 is turned downward again. Therefore, the roughed surface W2 comes into abutment against the bar A2 of the bar coater A, and the first photosensitive layer forming liquid is applied to the roughed surface W2 to form the first layer L1.

The support web W including the first layer L1 formed in the bar coater A then passes through the first layer drying zone E, and the first layer L1 is dried.

The support web W passed through the first layer drying zone E then passes through the slide hopper coater B, by which the second photosensitive layer forming liquid is applied to the first layer L1 to form the second layer L2 on the first layer L1.

The support web W having the second layer L2 formed then passes through the second layer drying zone F, and the second layer L2 is dried.

Here, the tenth embodiment has been described on the case in which the photosensitive layers are formed as the first layer L1 and the second layer L2. The first layer L1 may be the heat-sensitive layer, and the second layer L2 may be the photo-thermal conversion layer.

In the coating apparatus 400, the second layer L2 is formed in the untouched manner by the slide hopper coater B, and the first layer L1 is not scraped off while forming the second layer L2.

Accordingly, chips stripped from the first layer L1 neither migrate into the coated film of the second layer L2 nor separate out to contaminate the second photosensitive layer forming liquid. Thus, visible light exposure types of planographic printing plates with the printing plate layer of a multi-layered structure can be stably manufactured.

Eleventh Embodiment

Figure 23:
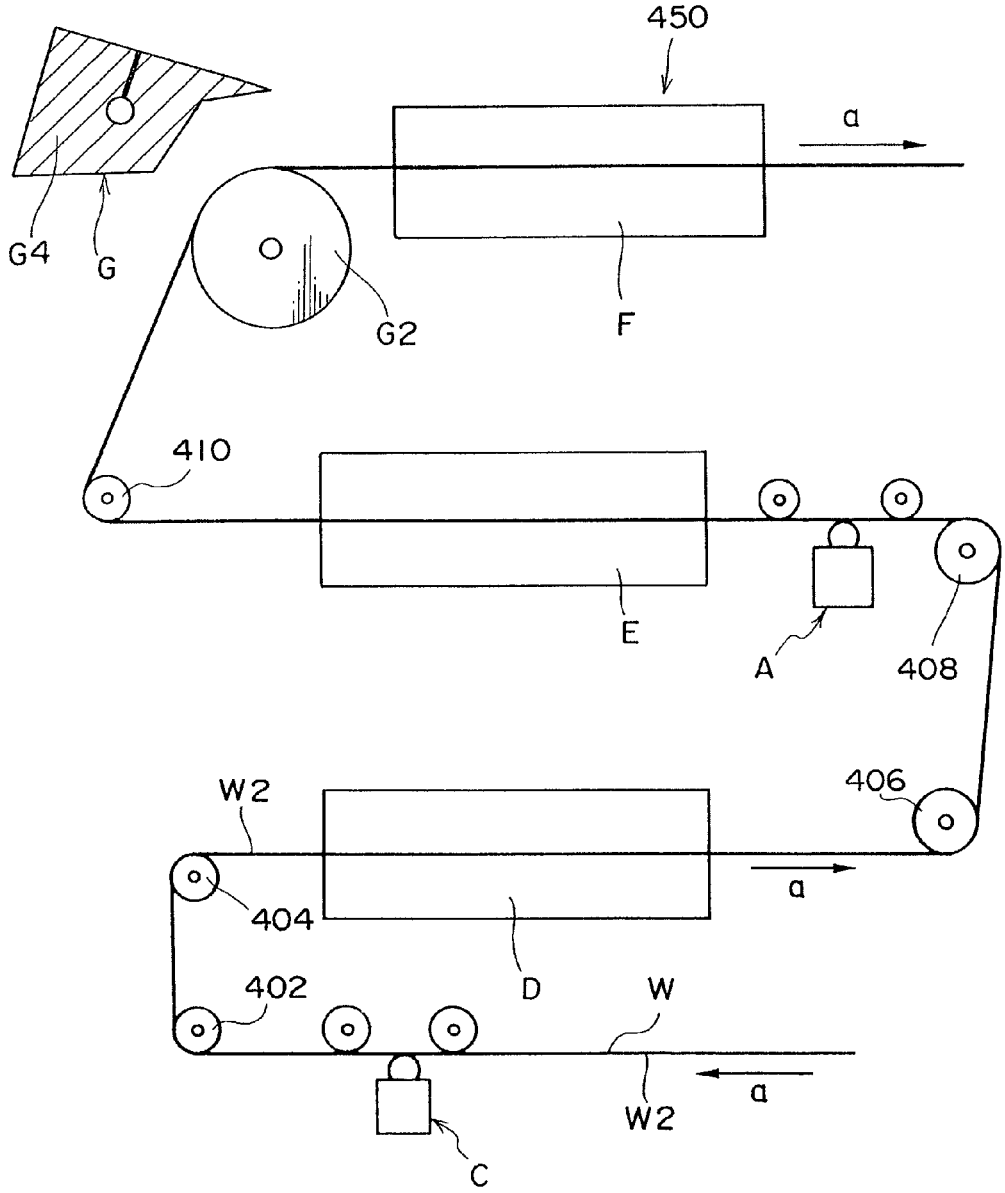
FIG. 23 is a schematic diagram showing a construction of a further embodiment of the coating apparatus of the invention.

FIG. 23 shows a construction of an eleventh embodiment of the coating apparatus of the invention. In FIG. 23, the same reference numerals as those of FIGS. 20 to 22 designate the same components as those shown in FIGS. 20 to 22.

A coating apparatus 450 of the eleventh embodiment comprises a construction similar to that of the coating apparatus 400 of the tenth embodiment except the slide hopper coater B substituted for a curtain type coater G between the first layer drying zone E and the second layer drying zone F.

Figure 24:
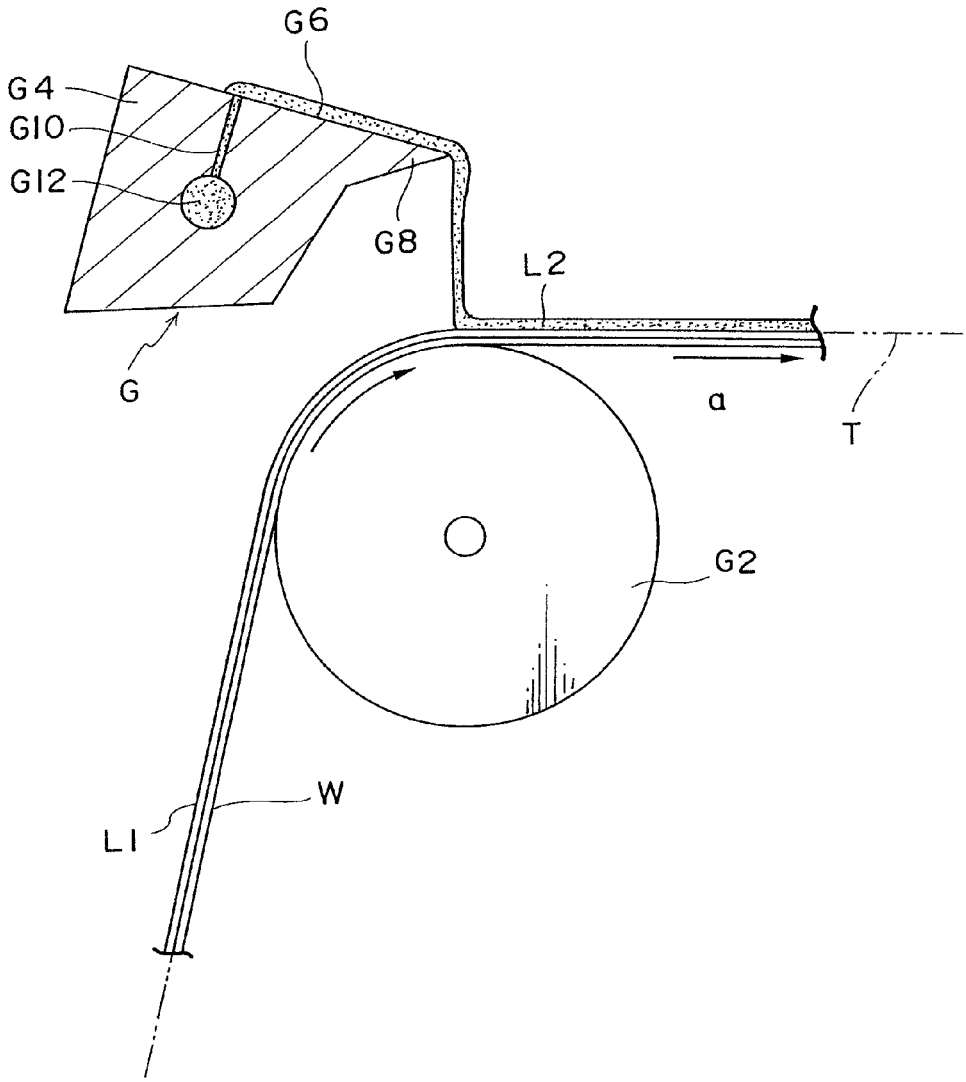
FIG. 24 is an enlarged view showing the detail of a structure of a curtain type coater belonging to the coating apparatus shown in FIG. 23.

The curtain coater G and its vicinity are shown in FIG. 24. As shown in FIGS. 23 and 24, the curtain coater G is constructed to include: a backup roller G2 for conveying the support web W thereon in the traveling direction a with the first layer L1 formed on the aluminum web W being on the outer side; and a curtain coater body G4 disposed over the backup roller G2 while facing the backup roller G2 across the traveling plane T.

The curtain coater body G4 is formed into a generally rectangular parallelepiped block and has such a slide face G6 formed on its upper face as slopes downward in the traveling direction a. The slide face G6 is provided at its lower end with a lip portion G8 protruding in a wedge shape in the traveling direction a. The lip portion G8 has an end edge formed to have a right angle with respect to the traveling direction a.

In the central portion of the slide face G6, a discharge slit G10 opens and extends perpendicularly of the traveling direction a for discharging the second photosensitive layer forming liquid upward.

In the curtain coater body G4 and below the discharge slit G10, a liquid feed passage G12 is provided for feeding the second photosensitive layer forming liquid to the discharge slit G10.

The second photosensitive layer forming liquid thus fed from the liquid feed passage G12 is discharged from the discharge slit G10 onto the slide face G6 and flows toward the lip portion G8.

The second photosensitive layer forming liquid flows downward in a curtain shape from the end edge of the lip portion G8.

As the support web W including the first layer L1 in the bar coater A travels on the backup roller G2 in the traveling direction a below the curtain coater body G, the second photosensitive layer forming liquid flows from the end edge of the lip portion G8 onto the surface of the first layer L1 of the support web W, as shown in FIG. 24, to form the second layer L2.

The operations of the coating apparatus 450 will be described in the following. In the coating apparatus 450, similarly to the coating apparatus 400 of the tenth embodiment, the roughed surface W2 of the aluminum web W is treated by the bar coater C and the surface treating layer drying zone D. In the bar coater A, moreover, the first layer L1 is formed over the roughed surface W2 treated and is dried in the first layer drying zone E. In the curtain coater G, moreover, the second photosensitive layer forming liquid is applied to form the second layer L2, which is then dried in the second layer drying zone F.

In the coating apparatus 450, the second layer L2 is formed in the untouched manner by the curtain coater G, and the first layer L1 is not scraped off while forming the second layer L2.

Therefore, chips stripped from the first layer L1 neither migrate into the coated film of the second layer L2 nor separate out to contaminate the second photosensitive layer forming liquid to form the second layer L2. Thus, a visible light exposure type planographic printing plate having the printing plate layer of a multi-layered structure can be stably manufactured.

Twelfth Embodiment

Figure 25:
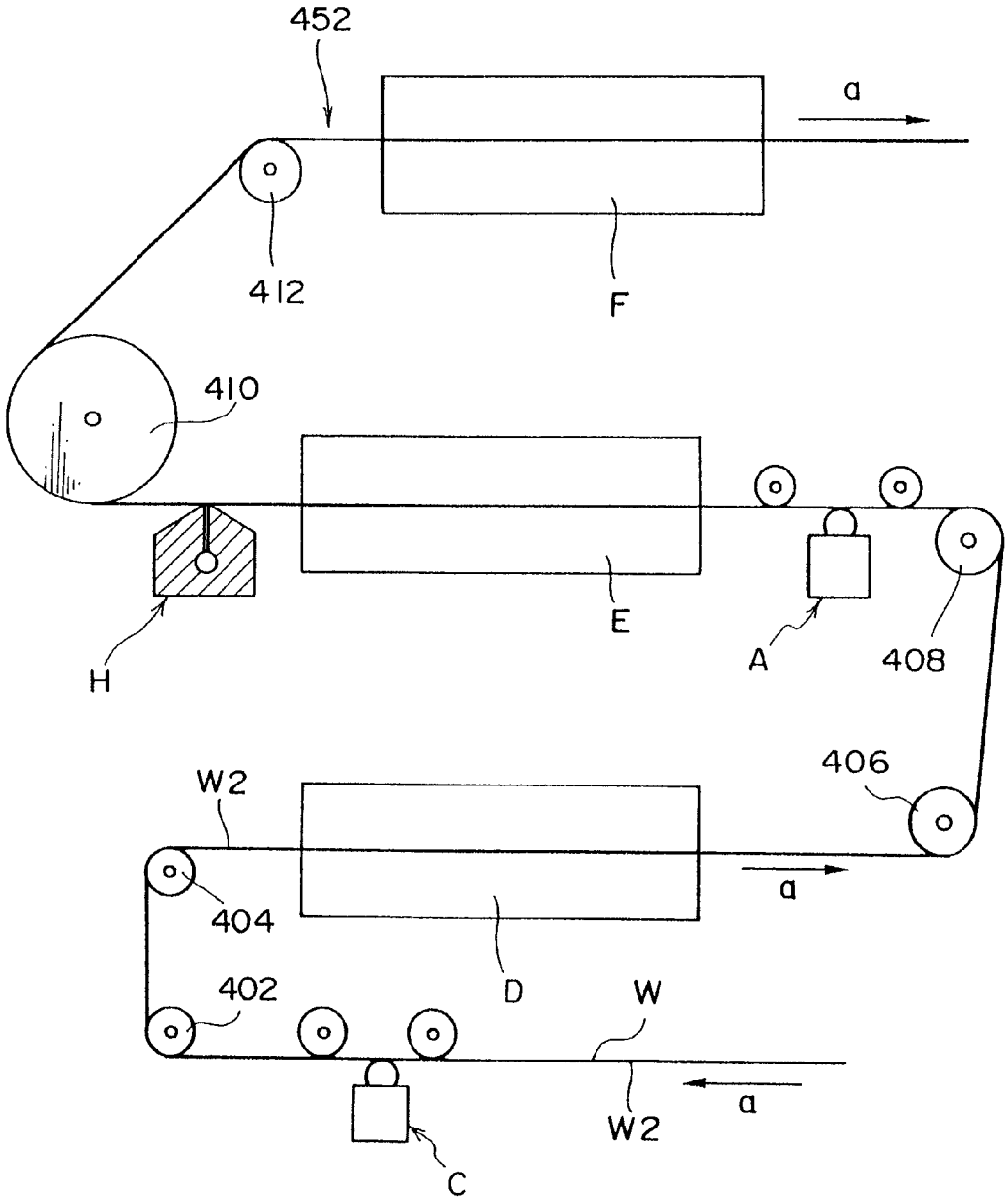
FIG. 25 is a schematic diagram showing a construction of a further embodiment of the coating apparatus of the invention.

FIG. 25 shows a construction of a twelfth embodiment of the coating apparatus of the invention. In FIG. 25, the same reference numerals as those of FIGS. 20 to 22 designate the same components as those shown in FIGS. 20 to 22.

A coating apparatus 452 of the twelfth embodiment has a construction similar to that of the coating apparatus 400 of the tenth embodiment except an extrusion coater H and a conveyor roller 412. The extrusion coater H is interposed as the non-contact coater between the first layer drying zone E and the conveyor roller 410, and the conveyor roller 412 is arranged between the conveyor roller 410 and the second layer drying zone F.

Figure 26:
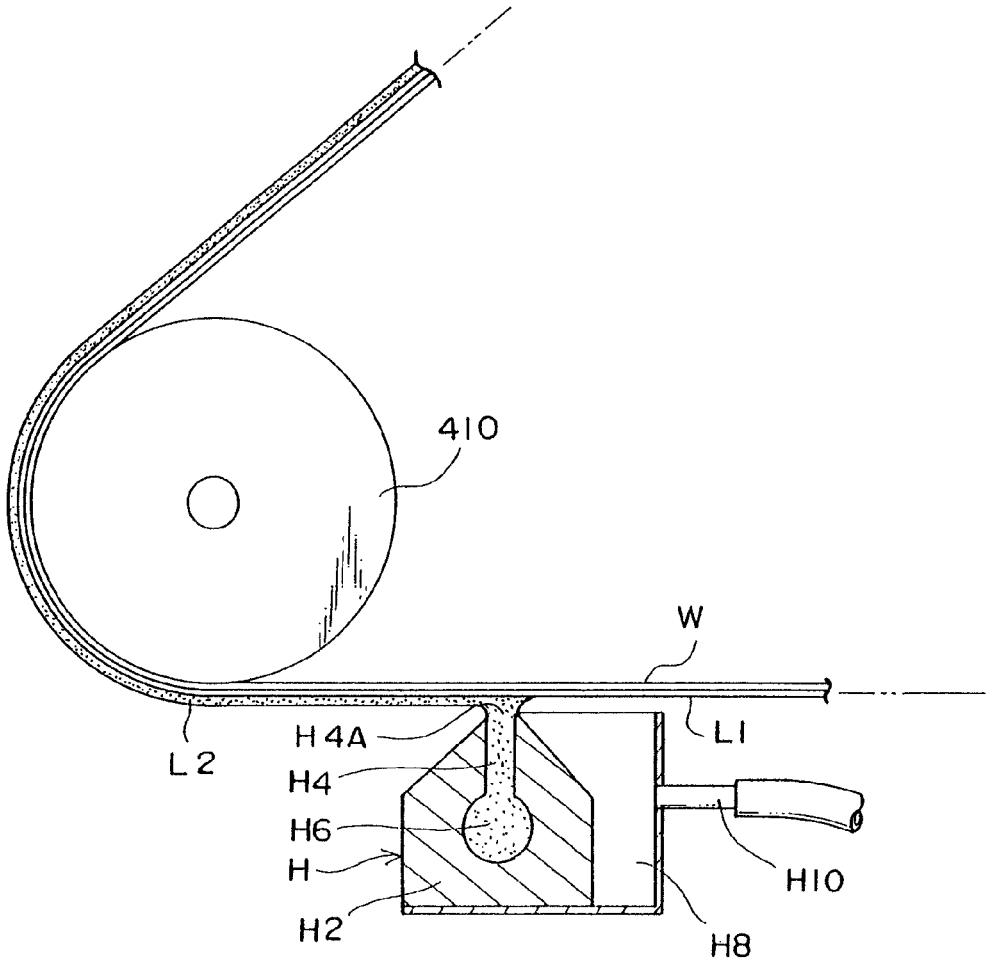
FIG. 26 is an enlarged view showing the detail of a construction of an extrusion type coater belonging to the coating apparatus shown in FIG. 25.
Figure 27:
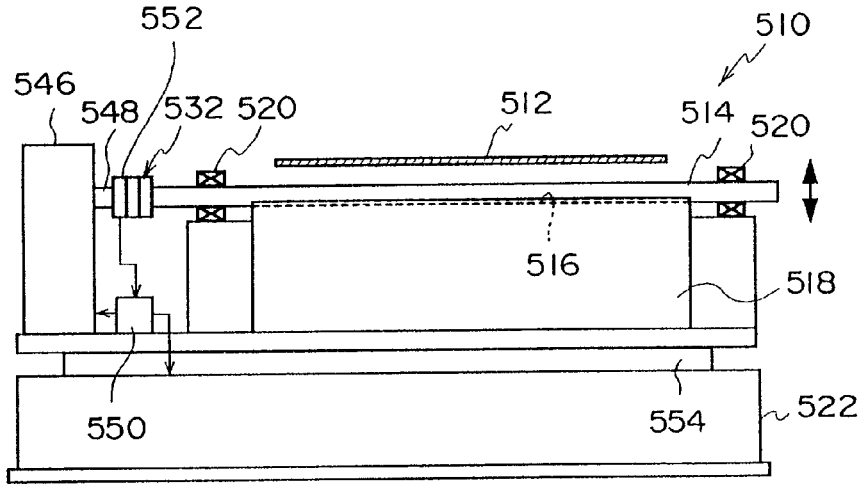
FIG. 27 is a front elevation of a rod coating apparatus of a further embodiment of the invention.
Figure 28:
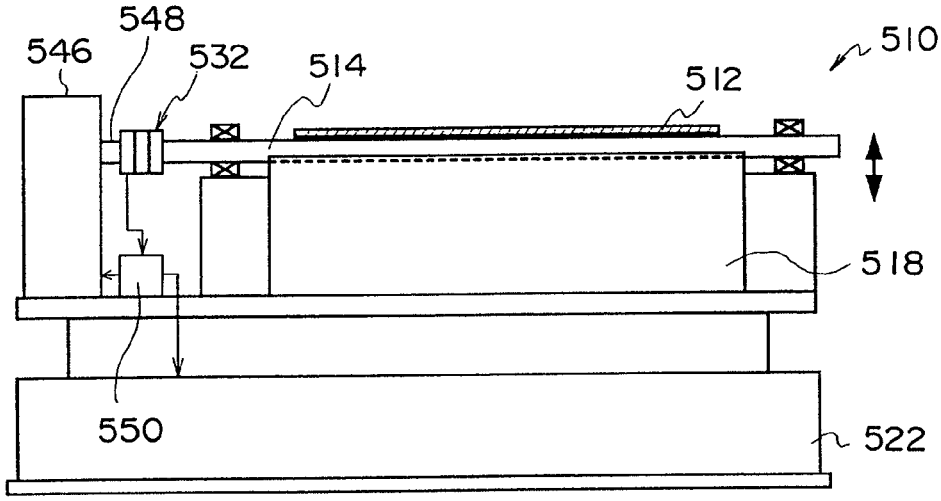
FIG. 28 is a front elevation of the rod coating apparatus of the further embodiment of the invention.
Figure 29:
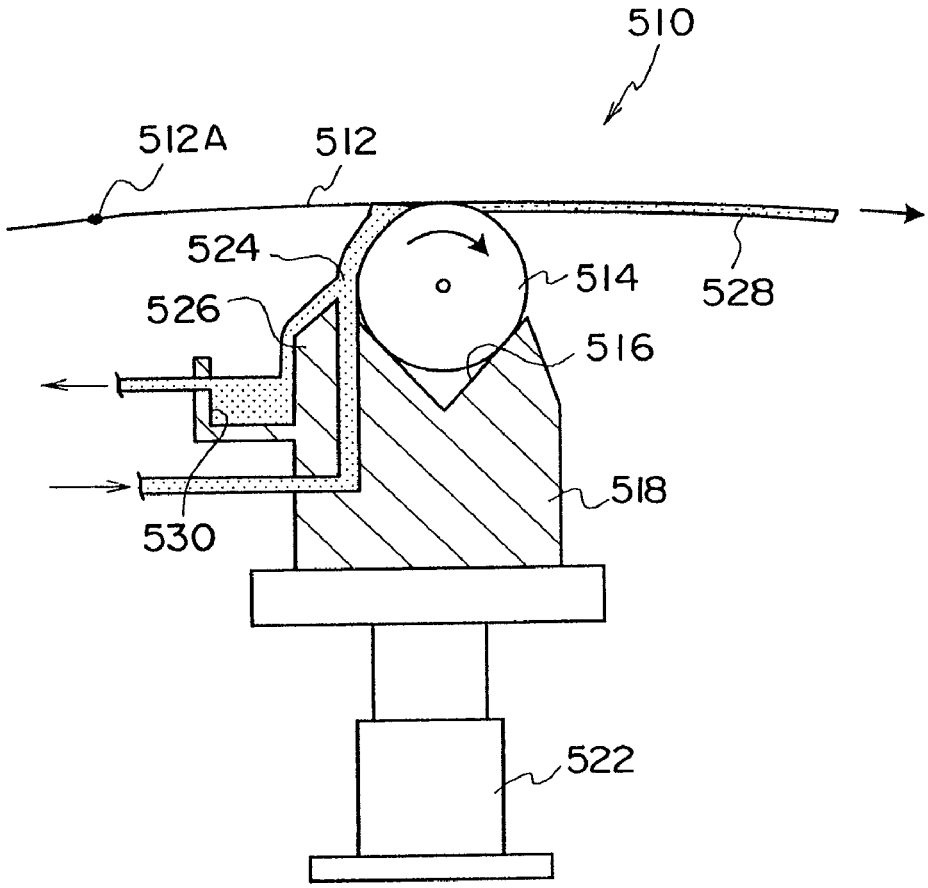
FIG. 29 is a side elevation for explaining the actions of the road coating apparatus of the further embodiment of the invention.

The extrusion coater H and its vicinity are shown in FIG. 26. The extrusion coater H is constructed to include: a body H of a plate shape having a wedge-shaped section converging toward the traveling plane T; a liquid feed passage H6 formed in the body H2 and extending in the longitudinal direction; a discharge slit passage H4 extending from the liquid feed passage H6 toward the top portion of the body H2 and including a discharge slit H4A opened in the top portion toward the traveling plane T; and a vacuum chamber H8 formed on the upstream side of the body H2. This body H2 is provided at a level not to come into contact with the first layer L1 of the support web W. Moreover, the vacuum chamber H8 is provided with a vacuum conduit H10 for depressurizing the inside thereof.

As shown in FIG. 26, the second photosensitive layer forming liquid fed from the liquid feed passage H6 is discharged upward from the discharge slit passage H4 so that it wets the surface of the first layer L1 to form the second layer L2. In the extrusion coater H, therefore, the second layer L2 is also formed not to touch the first layer L1.

In the coating apparatus 452, similarly to the coating apparatus 400 of the tenth embodiment, the roughed surface W2 of the aluminum web W is treated by the bar coater C and the surface treating layer drying zone D. Moreover, the first layer is formed over the treated roughed surface W2 by the bar coater A and is dried in the first layer drying zone E. In the curtain coater G, moreover, the second photosensitive layer forming liquid is applied to form the second layer L2 and is dried in the second layer drying zone F.

In the coating apparatus 452, the second layer L2 is formed without being touched by the extrusion coater H. While the second layer L2 is being formed, therefore, the first layer L1 is not scraped off, and the chips of scraping the first layer L1 neither migrate into the coating film of the second layer L2 nor separate out to contaminate the second photosensitive layer forming liquid.

EXAMPLE 8

The invention will be described more specifically in the following examples. The layer forming liquids were prepared as enumerated in Table 2.

TABLE 2

| LFL | Viscosity (cp) | Surface Tension | Specific Gravity |
|---|---|---|---|
| STL | 0.8 ± 0.2 | 23 ± 3 dynes | 0.792 ± 0.02 |
| 1st PLFL | 1.2 ± 0.5 | 23 ± 3 dynes | 0.92 ± 0.02 |
| 2nd PLFL | 8.5 ± 2 | 32 ± 2 dynes | 1.015 ± 0.002 |

| LFL | Main Component | Portion to Feed |
|---|---|---|

TABLE 2-continued

| | | |
|---|---|---|
| STL | DS of HP | Bar Coater C |
| 1st PLFL | SS of PR | Bar coater A |
| 2nd PLFL | AS of PVA | SH Coater B |

In Table 2:

LFLLayer Forming Liquid;

STLSurface Treating Liquid;

PLFLPhotosensitive Layer Forming Liquid;

DS of HPDilute Solution of Hydrophilic Polymer;

SS of PRSolvent Solution of Photosensitive Resin;

AS of PVAAqueous Solution of Polyvinyl Alcohol; and

SHSlide Hopper.

By using the coating apparatus 400 shown in FIG. 20, a planographic printing plate was manufactured by laminating a printing plate layer composed of two layers of the first layer L1 and the second layer L2 over the support web W including a width from 700 to 1,500 mm.

The conveyor speed of the support web W was set to 60 m/min. The first layer L1 was formed by applying the first photosensitive layer forming liquid in the bar coater A, and the second layer L2 was formed by applying the second photosensitive layer forming liquid in the slide hopper coater B.

Moreover, the liquid feed widths in the bar coater C, the bar coater A and the slide hopper coater B were set to 1,600 mm. In the bar coater C and the bar coater A, the bars were rotated forward, i.e., in the same direction as the traveling direction a of the support web W.

In the slide hopper coater B, the pressure in the vacuum chamber B14 was held at 0 to 35 mm water-column, and the second photosensitive layer forming liquid was applied at a coating rate of 12 to 50 cc/m$^2$.

The observations of the first layer L1 and the second layer L2 after the start of the coating operations found no deposit of a solid substance on the second layer L2, and the planographic printing plate obtained had a stable quality.

EXAMPLE 9

The coating apparatus 450 shown in FIG. 23 was used, and the second layer forming liquid was applied in the curtain coater G at a coating amount from 12 to 50 cc/m$^2$ by setting the distance from the leading end of the lip portion G8 to the first layer L1 in the support web W from 3 to 10 mm.

A planographic printing plate was manufacture by a procedure similar to that of Example 8 excepting the above-specified items.

The periodic observations of the first layer L1 and the second layer L2 after the start of the coating operations found no deposit of a solid substance on the second layer L2, and qualities of the planographic printing plate remained stable.

EXAMPLE 10

The coating apparatus 452 shown in FIG. 25 was used, and the second layer forming liquid was applied in the extrusion coater H at a coating amount of 12 to 50 cc/m$^2$ by holding the pressure in the vacuum chamber H8 at a level of 0 to 35 mm water-column.

A planographic printing plate was manufacture by a procedure similar to that of Example 8 except the above-specified items.

The periodic observations of the first layer L1 and the second layer L2 after the start of the coating operations found no deposit of a solid substance on the second layer L2, and qualities of the planographic printing plate remained stable.

[Comparison 4]

A planographic printing plate was manufactured as in Example 8 excepting that the second photosensitive layer forming liquid was applied by using the bar coater having a construction similar to that of the bar coater A in place of the slide hopper coater B, thereby to form the second layer. In that bar coater, the bar rotated backward, i.e., in the opposite direction to the traveling direction a of the support web W.

Before long after the start of the coating operations, a powdery solid substance appeared in the second photosensitive layer forming liquid, and nicks were found in the first layer. The analysis of this photosensitive layer forming liquid found that the solid substance was identical to the photosensitive resin forming the first layer L1. From this, it was also found that the existing first layer L1 was scrubbed and scraped off with the bar of the second layer forming bar coater when the second layer L2 was to be formed by applying the second photosensitive layer forming liquid in the bar coater.

Quality tests were done on the planographic printing plate obtained, and some qualities did not reach the required levels.

[Comparison 5]

A planographic printing plate was manufactured as in Comparison 4 except rotating the bar forward in the bar coater disposed downstream of the bar coater A.

Before long after the start of the coating operations, a powdery solid substance appeared a little in the second photosensitive layer forming liquid but was less than that in Comparison 4. Not nicks but streaks like pressed marks were found in the first layer. Quality tests were done on the planographic printing plate obtained, and some qualities did not reach the required levels.

The analysis of this photosensitive layer forming liquid found that the solid substance was identical to the photosensitive resin forming the first layer L1. From this, it was also found that the existing first layer L1 was scrubbed and scraped off with the bar of the bar coater when the second layer L2 was to be formed by applying the second photosensitive layer forming liquid in the bar coater.

Of the invention, as has been described hereinbefore, there are provided the coating apparatus and the coating method for forming the planographic printing plate having the printing plate layer of the multi-layered structure of two, three or more layers stably.

Thirteenth Embodiment

Here will be described a rod coating apparatus of a thirteenth embodiment.

As shown in FIGS. 27 to 31, a rod coater 510 is provided with a column-shaped rod 514 arranged in the width direction of a web 512 to travel or in the direction perpendicular to the web 512. The rod 514 may include a wire wound around its outer circumference as shown. The rod 514 is supported in a rotating manner all over the entire length of a support block 518 having a V-shaped groove 516 formed at its central portion. As a result, the rod 514 is prevented from warping by its own weight.

Moreover, the rod 514 is rotatably supported at its two ends by bearings 520 to be driven to follow and rotate by touching the web 512.

Moreover, the clearance formed by the wire as the rod 514 rotates carries a predetermined amount of coating liquid from a later-described liquid pool 524 so that the coating liquid is applied to the web 512 to form a coated layer 528.

Here, the wire may be made of a metal, but stainless steel is often used. The diameter of the rod 514 is usually within a range from 6 to 25 mm, or may be from 6 to 15 mm. Moreover, the rod 514 may be exemplified not only by winding the wire on its surface but also by forming a groove in the surface of the rod 514, by smoothing the surface of the rod 514 or by another.

The support block 518 is placed on a lifter 522. This lifter 522 moves up and down at a predetermined timing to bring the rod 514 toward and away from the web 512. On the lifter 522, moreover, there is arranged an L-shaped weir member 526 associated with the support block 518 to construct the liquid pool 524. A meniscus is formed between the top of the weir member 526 and the web 512.

To the lower portion of the weir member 526, a liquid feed tube is connected for feeding the coating liquid to the liquid pool 524. On the left-hand side of the weir member 526, an overflow bath 530 is disposed for receiving the coating liquid having overflown from the liquid pool 524.

Figure 32:
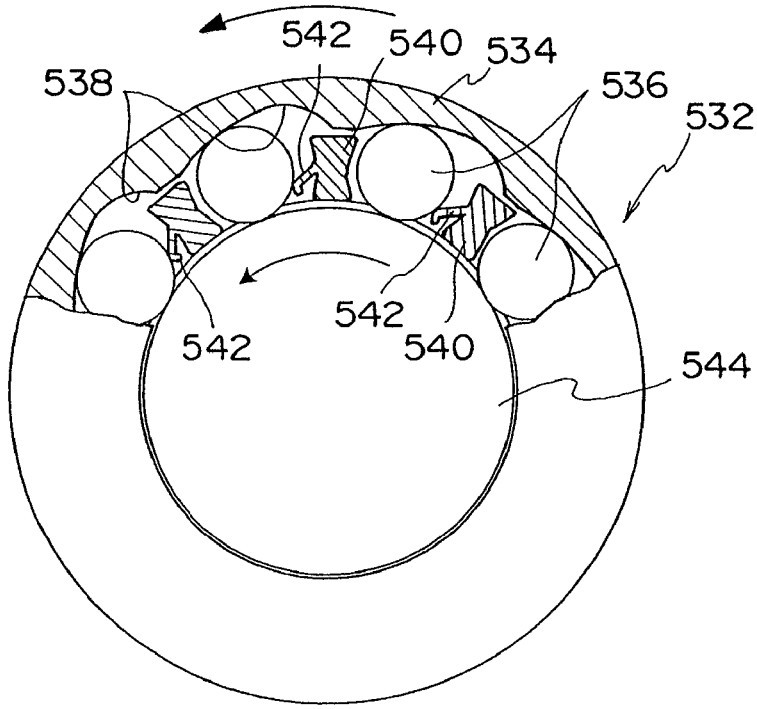
FIG. 32 is a partially sectional view of a one-way clutch.
Figure 33:
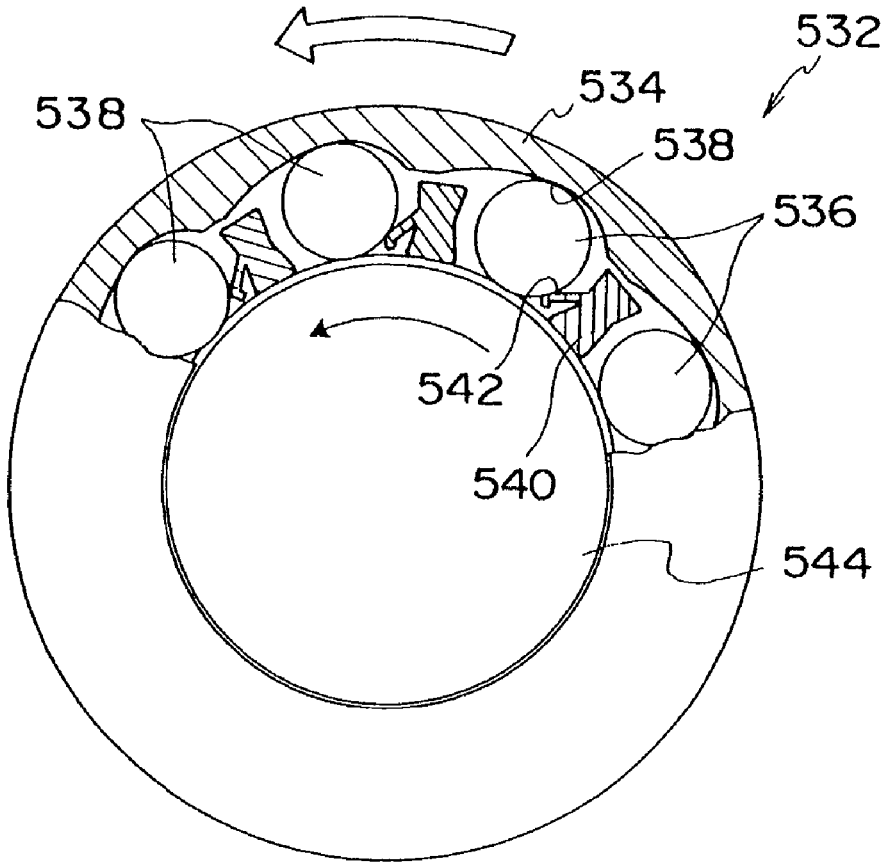
FIG. 33 is a partially sectional view of the one-way clutch.

To the end portion of the rod 514 protruding from the bearing 520, an outer ring 534 of a one-way clutch 532 is connected, as shown in FIGS. 32 and 33. The outer ring 534 is cemented and hardened to have sloped cam faces 538 formed on its radially inner face for rollers 536 to abut against.

Between the roller 536 and the roller 536, a cage 540 including a leaf spring 542 is interposed for supporting each roller 536. Therefore, all the rollers 536 abut against the cam faces 538 of the outer ring 534 simultaneously.

On the inner side of the outer ring 534, a shaft 544 is arranged for retaining the rollers 536 together with the outer ring 534. The shaft 544 of a drive motor 546 is connected to the drive shaft 548 of a drive motor 546, and thus the rotating force of the drive motor 546 is transmitted to the rod 514 through the shaft 544, the rollers 536 and the outer ring 534.

Moreover, the drive motor 546 is connected via a signal cable with a controller 550. This controller 550 controls not only the ascending/descending timings of the lifter 522 but also the ON/OFF of the drive motor 546.

The functions of the one-way clutch will be described in the following. As the shaft 544 rotates counter-clockwise, as shown in FIG. 32, the rollers 536 are pushed to the shaft 544 by the biasing forces of the leaf springs 542 of the cages 540. The rollers 536 advance to the positions, at which they abut against the cam faces 538 of the outer ring 534, and the outer ring 534 rotates together with the shaft 544.

When the outer ring 534 rotates counter-clockwise faster than the shaft 544, as shown in FIG. 33, the shaft 544 rotates clockwise relative to the outer ring 534. Therefore, the rollers 536 leave the shaft 544, and the outer ring 534 rotates idly relative to the shaft 544.

The actions of the rod coater 510 of the thirteenth embodiment will be described in the following.

Before the run of the rod coater 510 is started, the controller 550 constricts the piston 554 of the lifter 522 to lower the support block 518 thereby to move the rod 514 away from the web 512.

Then, the drive motor 546 is activated to rotate the rod 514 forcibly through the one-way clutch 532. When the controller 550 confirms it from a signal from an encoder 552 that the rotating speed has risen to a predetermined value, the controller 550 extends the piston 554 of the lifter 522 to raise the support block 518 thereby to bring the rod 514 into contact with the traveling web 512. As a result, the web 512 is coated with the coating liquid of the liquid pool 524 which is formed between the rod 514 and the web 512.

When the rod 514 comes into contact with the web 512, its rotating speed rises, the one-way clutch 532 rotates idly and the rod 514 follows the web 512 and rotates within a short time. Therefore, the web 512 is not scrubbed by the rod 514 while being coated even if the web 512 is conveyed at a high speed.

Figure 30:
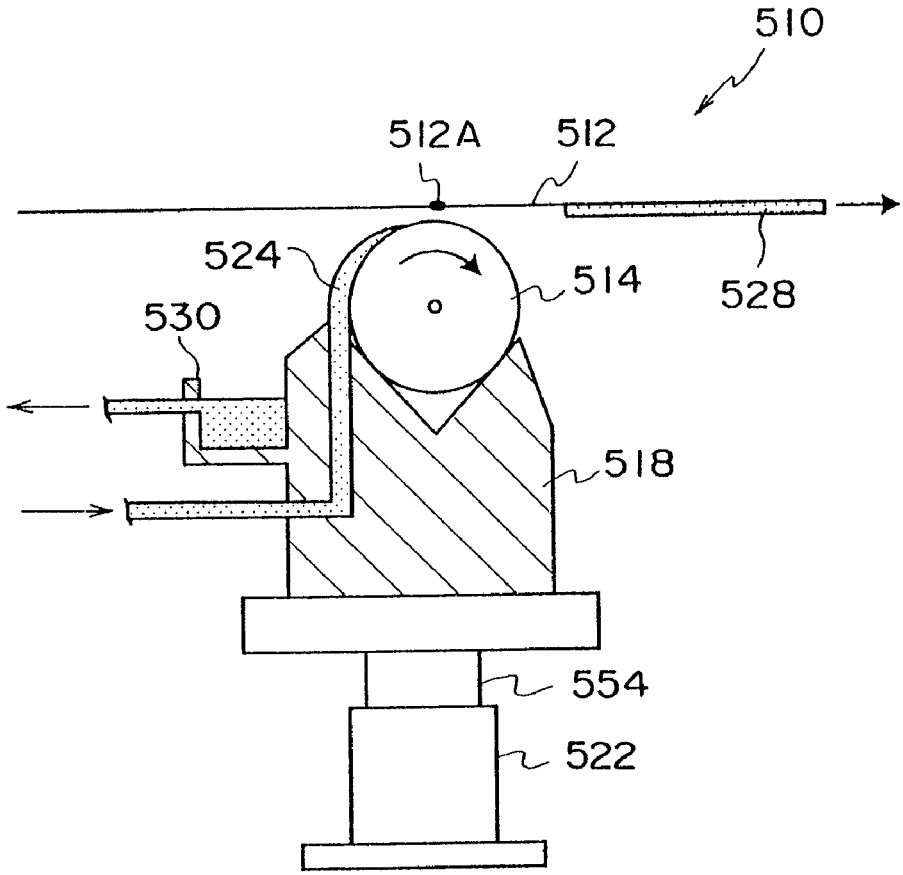
FIG. 30 is a side elevation for explaining the actions of the road coating apparatus of the further embodiment of the invention.

When a joint portion 512A to joint the webs 512 passes over the rod 514, as shown in FIG. 30, the lifter 522 is controlled by the controller 550 to lower the support block 518. Then, the rod 514 leaves the web 512 before the joint portion 512A passes over the rod 514.

As a result, the joint portion 512A of the webs 512 is prevented from impinging against the rod 514, and the rod 514 is not disturbed to cause fine vibrations. Therefore, the bubbles are not entrained by the coating liquid to eliminate the coating defects that the bubbles might otherwise be transferred to the coated film face of the web 512 and that the bubbles might otherwise reside in the coating liquid pool to cause streaks in the coated film face of the web 512.

Figure 31:
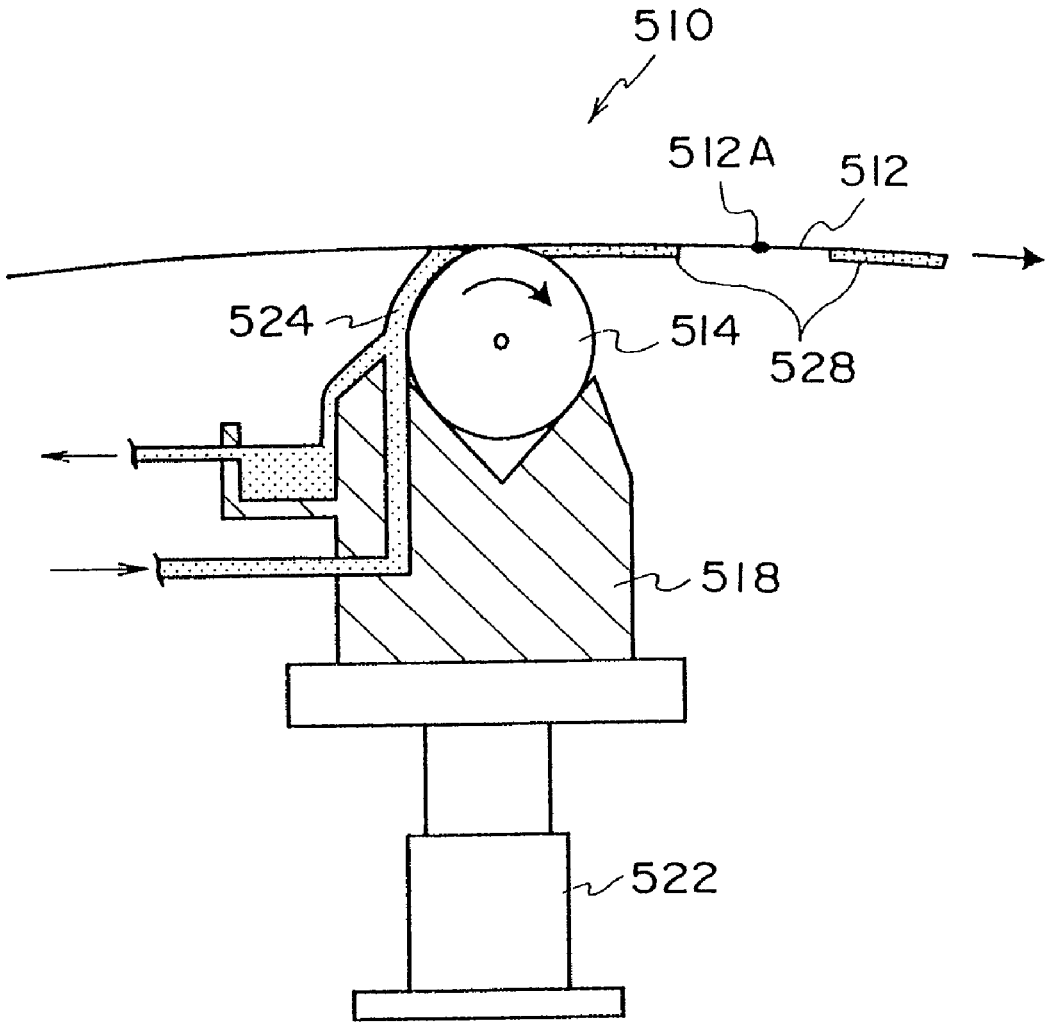
FIG. 31 is a side elevation for explaining the actions of the road coating apparatus of the further embodiment of the invention.

As shown in FIG. 31, moreover, the rod 514 is caused again to touch the web 512 after passes the joint portion 512A of the web 512. Before this second contact, the rod 514 is forced to rotate and touch the web 512. When the rod 514 touches the web 512, however, the one-way clutch 532 rotates idly, and the rod 514 follows the web 512 and rotates.

After the joint portion 512A of the web 512 passes, the forced revolution of the rod 514 will be continued till the next joint portion passes.

Thus, in the rod coater 510 of this embodiment, immediately after the rod 514 coming into contact with the web 512, it starts to follow the one-way clutch 532. Therefore, the time period for affecting the web adversely can be made shorter than that of the coater of the prior art in which the forced revolution of the rod is released in response to a breaking command of the forced drive transmission from the controller.

Here, the coating liquid to be used in the invention should not be particularly limited and may be an aqueous-solution or organic solution of a polymer, a pigment-dispersed liquid or a colloidal solution. The viscosity of the coating liquid should not be limited, but the lower viscosity to be applied does not exceed 100 cp or may not exceed 50 cp. The web 512 to be used in the invention may be made of metal, paper, plastic film, resin-coated paper or synthetic paper. The plastic material may be: polyolefin such as polyethylene or polypropylene; a vinyl polymer such as polyvinyl acetate, polyvinyl chloride or polystyrene; polyamide such as 6-6 nylon or 6-nylon; polyester such as polyethylene terephthalate, polyethylene-2 or 6-naphthalate; or cellulose acetate such as polycarbonate, cellulose triacetate or cellulose diacetate. Moreover, the resin to be used in the resin-coated paper is represented by polyolefin such as polyethylene, to which the resin should not necessarily be limited. Still moreover, the metal web may be an aluminum sheet.

EXAMPLE 11

In this example, coating tests were done on the web 512 having a low surface roughness by using the rod coater of the thirteenth embodiment and by using the rod coater of the prior art as Comparison 6.

Moreover, the operating conditions were that the rod 514 was forced to rotate forward by the drive motor 546 before it was brought into contact with the traveling web 512 and that the forced revolution by the drive motor 546 was released after this contact for causing the rod to follow the web.

Moreover, the used web was made of an aluminum support including 0.50 microns of treated surface roughness Ra. The traveling speed (or a line speed) was set to 100 m/min. The diameter of the wire wound on the surface of the rod and the lap angle between the web and the rod were adjusted to set the coating amount to 10 cc/$m^2$ of the coating liquid on the surface of the rod.

Moreover, the rod used had a diameter of 15 mm. In other words, the rotating speed for the rod to follow the web was 2,123 rpm. Here, the rotating speed of the rod before coming into contact with the web was set to 600 rpm.

As a result, in the case of Example 11, the length of period was 1 second until the rod came into contact with the web. The rod followed to rotate at a speed of 2,123 rpm. No streak was confirmed in the coated face of the web after the rod had come into contact with the web and before the rod followed the web to rotate, as enumerated in Table of FIG. 34.

Figure 35:
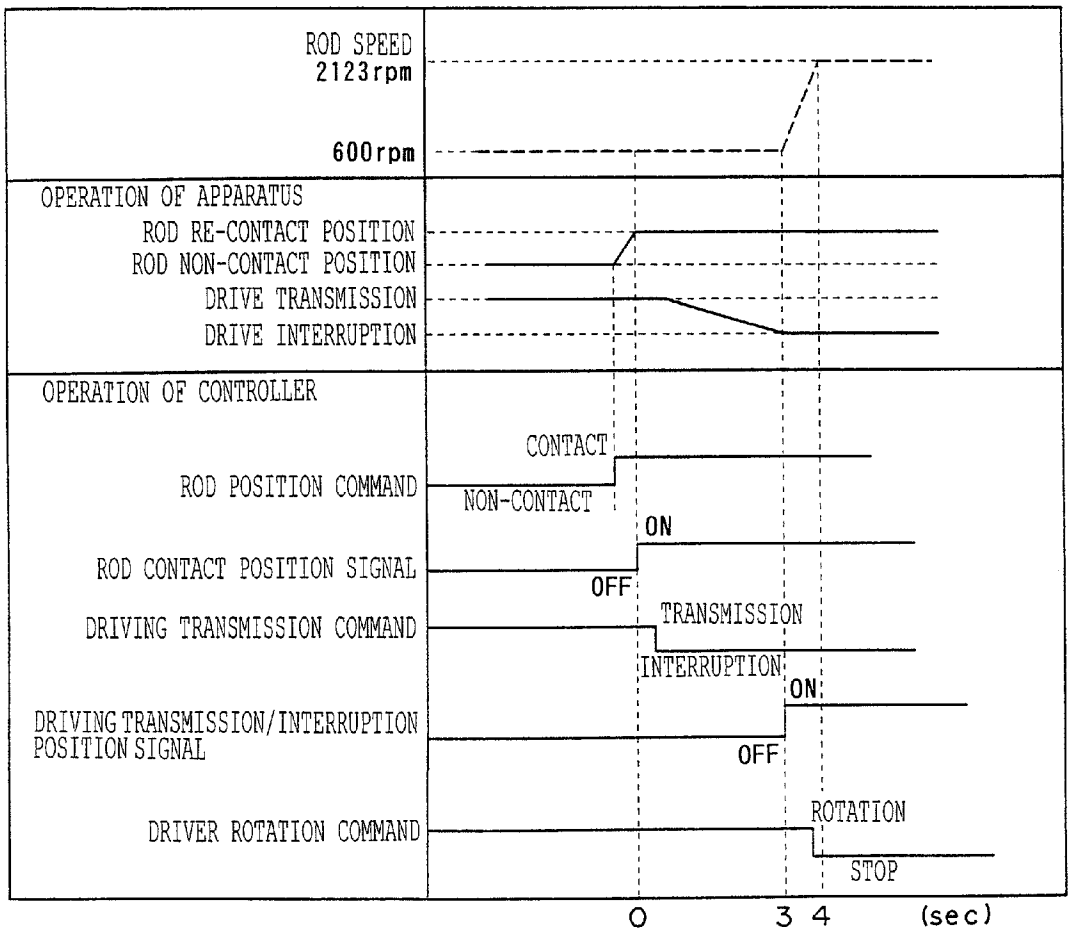
FIG.35 PRIOR ART
FIG. 35 is a time chart of a rod coating apparatus of the prior art.

In the case of Example 6, on the other hand, it took 3 seconds for the rod to touch the web thereby to interrupt the driving force of the drive motor, and it took totally 4 seconds for the rod to follow and rotate at the speed of 2,123 rpm, as enumerated in Table of FIG. 35. Moreover, streaks were confirmed in the coated face of the web after the rod had come into contact with the web and before the rod followed the web to rotate.

Figure 34:
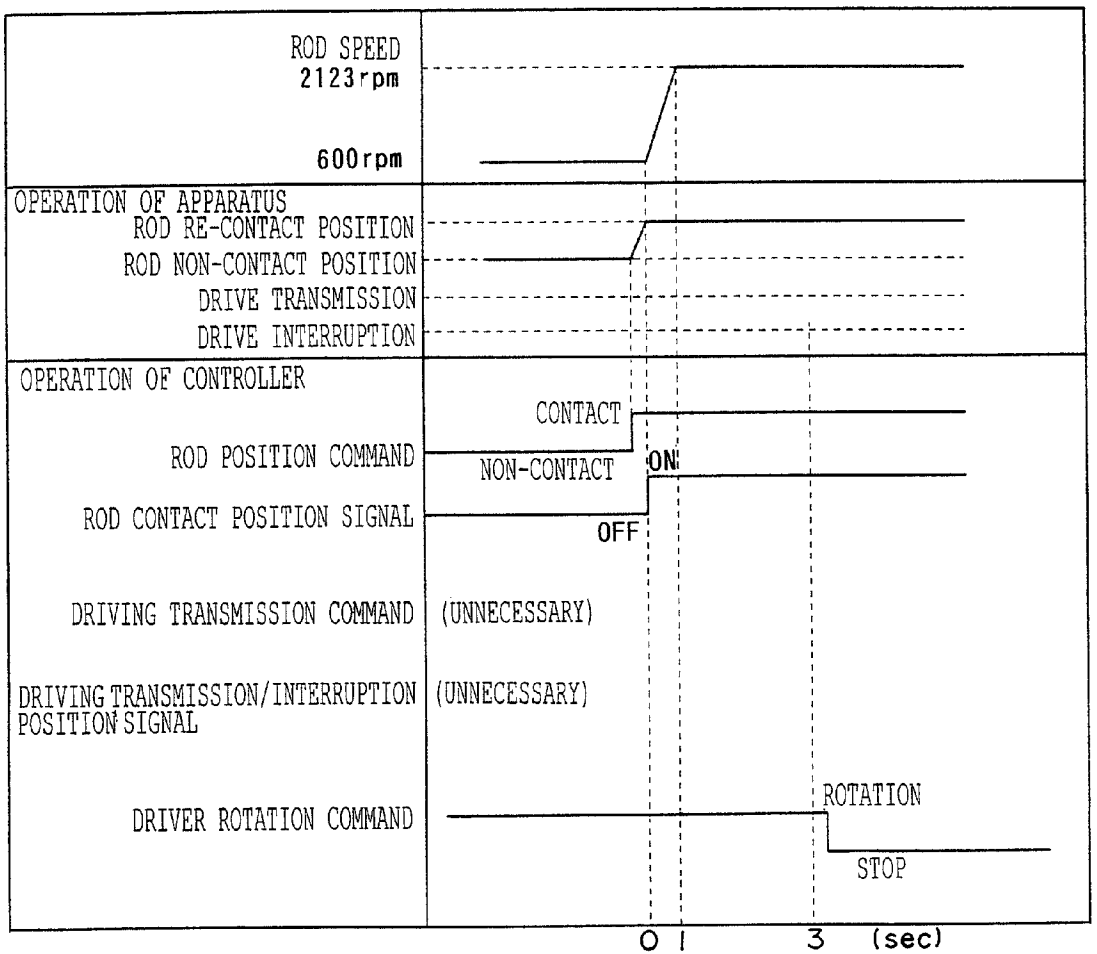
FIG. 34 is a time chart of the rod coating apparatus of the further embodiment of the invention.

In the lower columns of FIGS. 34 and 35, moreover, there are enumerated the action modes of the controller. In Example 11, it is not necessary to issue either the drive transmission command or the drive transmission interruption signal for confirming the drive interruption unlike the Comparison 6.

In Example 11, although the forced revolution of the rod was interrupted after about 3 seconds as in Comparison 6, the rod may be left rotating till a next rod contact command arrives.

Of the construction of the invention, as has been described hereinbefore, even a web with a small surface roughness can be coated by causing the web to travel at a high speed, without any streak while being coated. Therefore, the portions having been handled as defective ones before can be shipped as products to improve the yield.

Fourteenth Embodiment

Figure 36:
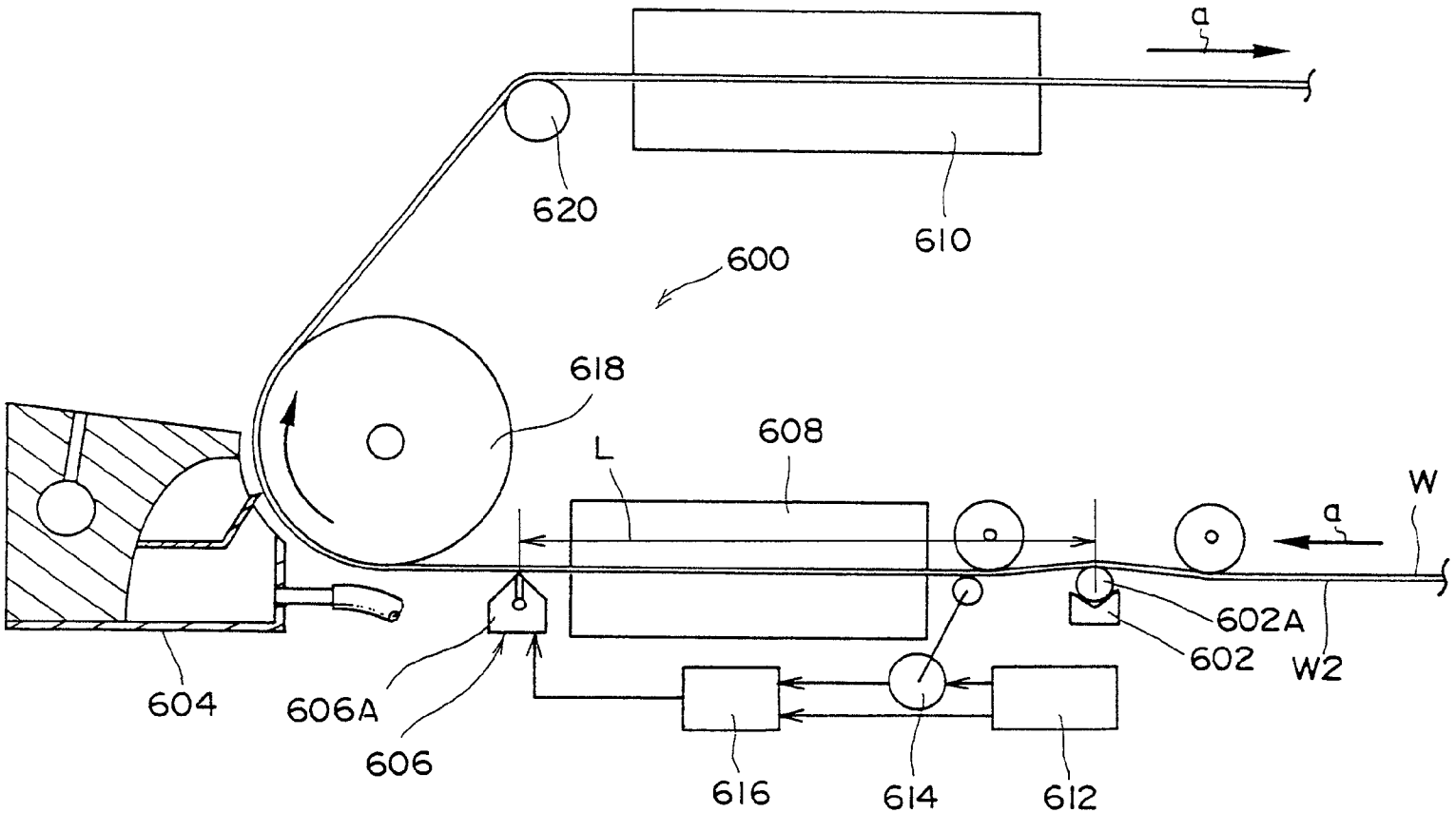
FIG. 36 is a schematic diagram showing a construction of a further embodiment of a coating apparatus of the invention for forming a photosensitive layer over a support web and an anti-oxidant layer over the surface of the photosensitive layer.

FIG. 36 shows a construction of a coating apparatus of a fourteenth embodiment of the invention for forming a photosensitive layer on the support web and an anti-oxidant layer on the surface of the photosensitive layer.

A coating apparatus 600 of the fourteenth embodiment is constructed to comprise a bar coater 602, a slide bead coater 604 and a pre-wet liquid coater 606. The bar coater 602 coats the support web W traveling continuously in the direction a, with a photosensitive layer forming liquid corresponding to a coating liquid of the invention, to form a photosensitive layer L1. The slide bead coater is disposed downstream of the bar coater 602 to coat the photosensitive layer L1 with an anti-oxidant layer forming liquid corresponding to the other coating liquid of the invention, to form an anti-oxidant layer L2. The pre-wet liquid coater 606 is upstream of and adjacent to the slide bead coater 604 to coat an uncoated portion of the photosensitive layer L1, if any, with an undercoating liquid, i.e., a pre-wet liquid. The bar coater 602, the slide bead coater 604 and the pre-wet liquid coater 606 correspond to the upstream coater, the downstream coater and the undercoating liquid applicator, respectively, of the coating apparatus of the invention.

In the vicinity of the slide bead coater 604, a backup roller 618 is disposed for rotating clockwise of FIG. 36 to convey the support web W.

Between the bar coater 602 and the pre-wet liquid coater 606, a hot-air type photosensitive layer drier 608 is interposed for drying the photosensitive layer L1 formed in the bar coater 602. On the downstream side of the slide bead coater 604, a hot-air type anti-oxidant layer dryer 610 is disposed for drying the anti-oxidant layer formed by the slide bead coater 604.

In the vicinity of the entrance of the anti-oxidant layer drier 610, a guide roller 620 is disposed for guiding the support web W to the entrance of the anti-oxidant layer drier 610.

The coating apparatus 600 further comprises a signal generator 612 and a pre-wet liquid coater control unit 616. The signal generator 612 generates a non-contact signal when the bar 602A of the bar coater 602 leaves the support web W. In response to the non-contact signal from the non-contact signal generator 612, an encoder 614 is activated to measure the travel distance of the support web W after the bar 602A of the bar coater 602 left the support web W. In response to the non-contact signal from the non-contact signal generator 612, the pre-wet liquid coater control unit 616 is activated, like the encoder 614, to start its actions. In response to such a signal from the encoder 614 as indicating that the uncoated portion formed in the support web W approaches the pre-wet liquid coater 606, the pre-wet liquid coater control unit 616 outputs instructs the pre-wet liquid coater 606 to execute the coating of the pre-wet liquid.

The individual components of the coating apparatus 600 will be described in detail in the following.

Figure 37:
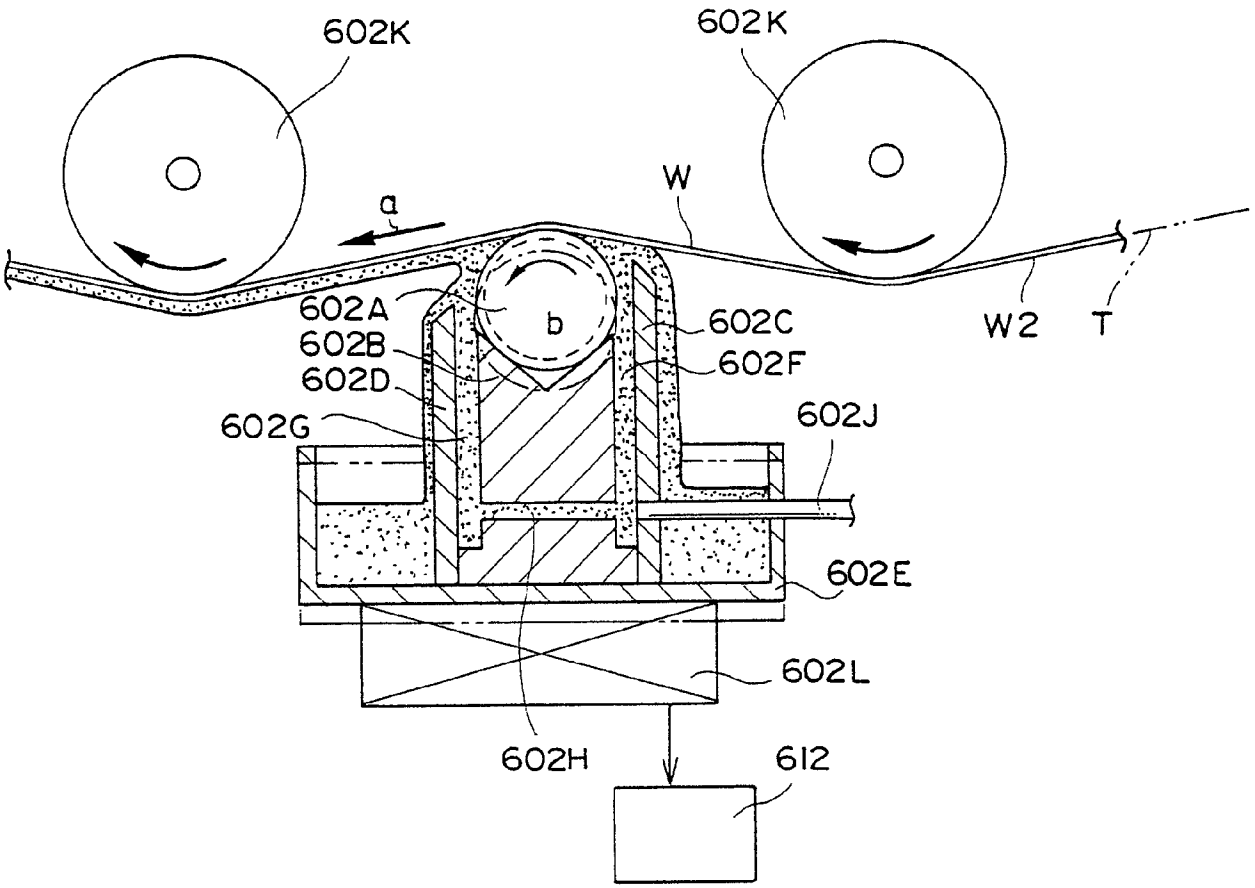
FIG. 37 is an enlarged diagram showing a portion of the structure of a bar coater belonging to the coating apparatus shown in FIG. 36.
Figure 38:
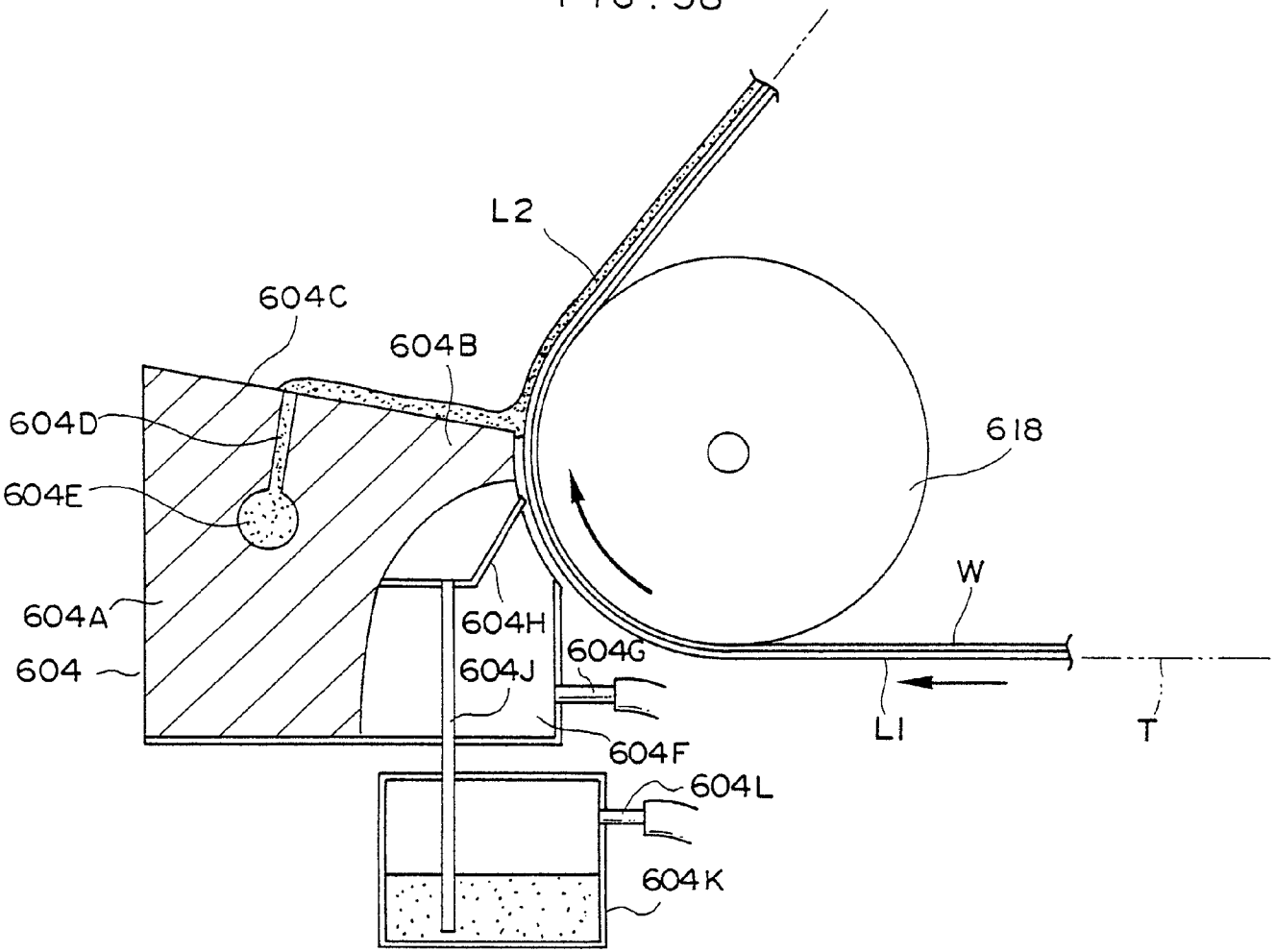
FIG. 38 is an enlarged view showing a portion of the coating apparatus shown in FIG. 36, i.e., a slide bead coater belonging to the coating apparatus and the vicinity of the slide bead coater.

FIG. 37 shows a structure of the bar coater 602. The bar coater 602 is constructed to include: the bar 602A; a bar supporting member 602B or a plate-shaped member for supporting the bar 602A upward with a V-shaped groove formed in its top face; an upstream weir plate 602C erected on the upstream side of the bar supporting member 602B and extending vertically toward the traveling plane T or the traveling path of the support web W; a downstream weir plate 602D erected on the downstream side of the bar supporting member 602B and extending vertically toward the traveling plane T or the traveling path of the support web W; and a platform 602E fixing the bar supporting member 602B, the upstream weir plate 602C and the downstream weir plate 602D. The bar 602A rotates in the same direction as the traveling direction a of the support web W, as indicated by arrow b in FIG. 37, while abutting against the roughed surface W2 of the support web W.

Between the bar supporting member 602B and the upstream weir plate 602C, an upstream liquid feed passage 602F is disposed for feeding the photosensitive layer forming liquid to the upstream side of the bar 602A. Between the bar supporting member 602B and the downstream weir plate 602D, a downstream liquid feed passage 602G is disposed for feeding the photosensitive layer forming liquid to the downstream side of the bar 602A. The upstream liquid feed passage 602F and the downstream liquid feed passage 602G communicate with each other via a communication passage 602H formed in the lower portion of the bar supporting member 602B.

To the lower end portion of the upstream liquid feed passage 602F, a liquid feed conduit 602J is connected for feeding the photosensitive layer forming liquid.

Over the traveling plane T, a pair of web pressure rollers 602K are arranged for pressurizing the support web W toward the bar 602A while corotating about each axis at the time of applying the photosensitive layer forming liquid.

Below the platform 602E, a lift 602L is disposed for moving the platform 602E upward and downward. The lift 602L has functions: to lower the platform 602E thereby to bring the bar 602A apart from the support web W, when a coating defect is made in the bar coater 602 to leave the uncoated portion in the support web W; and to output a signal indicating that the platform 602E has descended and the bar 602A has been moved away from the web W, to the non-contact signal generator 612. In response to that signal from the lift 602L, the non-contact signal generator 612 generates and outputs the non-contact signal to the encoder 614 and the pre-wet liquid coater control unit 616. Double-dotted lines in FIG. 37 show the state in which the platform 602E is in a descended position and the bar 602A is away from the support web W.

The lift 602L may be a ball-screw type lift for moving the platform 602E up and down, a hydraulic cylinder type lift for moving the same up and down with a hydraulic cylinder, or a pneumatic cylinder type lift for moving the same up and down with a pneumatic cylinder.

The bar 602A may be a bar with circumferential surface-grooves formed at a constant interval, another bar with surface-grooves closely provided, or a wire bar with a thin metal wire wound around a surface of the wire bar.

At the time of applying the photosensitive layer forming liquid, the bar 602A abuts against the support web W at its portion of the grooves formed in the surface or the wire wound on the surface. Thus, the passage of the photosensitive layer forming liquid is formed between the grooves or the recesses between the wire bars and the support web W and is applied to a predetermined thickness.

Next, the slide bead coater 604 and its vicinity are shown in FIG. 3. The slide bead coater 604 includes a slide bead coater body 604A formed into a generally rectangular parallelepiped block.

The slide bead coater body 604A includes a leading end portion 604B protruding in a wedge shape toward the backup roller 618 and having an end edge parallel to the surface of the backup roller 618. This leading end portion 604B is formed to have a clearance of about 0.1 to 1 mm normally between the end edge and the support web W made to run on the backup roller 618 near the slide bead coater 604. This clearance can be determined of the thickness of the anti-oxidant layer L2 to be formed on the support web W.

On the upper face of the slide bead coater body 604A, a slide face 604C is provided, sloping downward toward the end edge of the leading end portion 604B. From the inside of the slide bead coater body 604A toward the slide face 604C, a discharge slit 604D or a slit passage is formed for discharging the anti-oxidant layer forming liquid. This discharge slit 604D is opened in the slit shape midway of the slide face 604C and along the width direction of the traveling plane T and communicates at its lower end with a liquid feed passage 604E for feeding the anti-oxidant layer forming liquid to the discharge slit 604D.

Below the leading end portion 604B, a vacuum chamber 604F connected at its bottom portion to a vacuum tube 604G is disposed for depressurizing the inside thereof. In the vacuum chamber 604F, there is disposed a channel-shaped excess liquid receiver 604H for that excess of the anti-oxidant layer forming liquid discharged from the discharge slit 604D as has failed to be applied to the support web W. From this excess liquid receiver 604H, a drain pipe 604J is extended for extracting the excess anti-oxidant layer forming liquid to the outside. At the lower end of the drain pipe 604J, a drain liquid reserving bath 604K is disposed for reserving the anti-oxidant layer forming liquid discharged via the drain pipe 604J. A vacuum tube 604L is also connected to the drain liquid tank 604K for depressurizing the inside of the same.

When the anti-oxidant layer forming liquid is to be applied to the support web W, the inside of the vacuum chamber 604F is depressurized to about a level of about 0.5 to 10 cm water-column by a vacuum pump or an aspirator connected to the vacuum tube 604G. Moreover, the inside of the drain liquid tank 604K is also depressurized to a level similar to that of the inside of the vacuum chamber 604F via the vacuum tube 604L.

In this state, the anti-oxidant layer forming liquid is discharged from the discharge slit 604D and is caused to flow toward the end edge of the leading end portion 604B of the slide face 604C. Thus, the coating beads are formed between the end edge of the leading end portion 604B and the photosensitive layer L1 in the support web W to apply the anti-oxidant layer forming liquid thereby to form the anti-oxidant layer L2.

Figure 39:
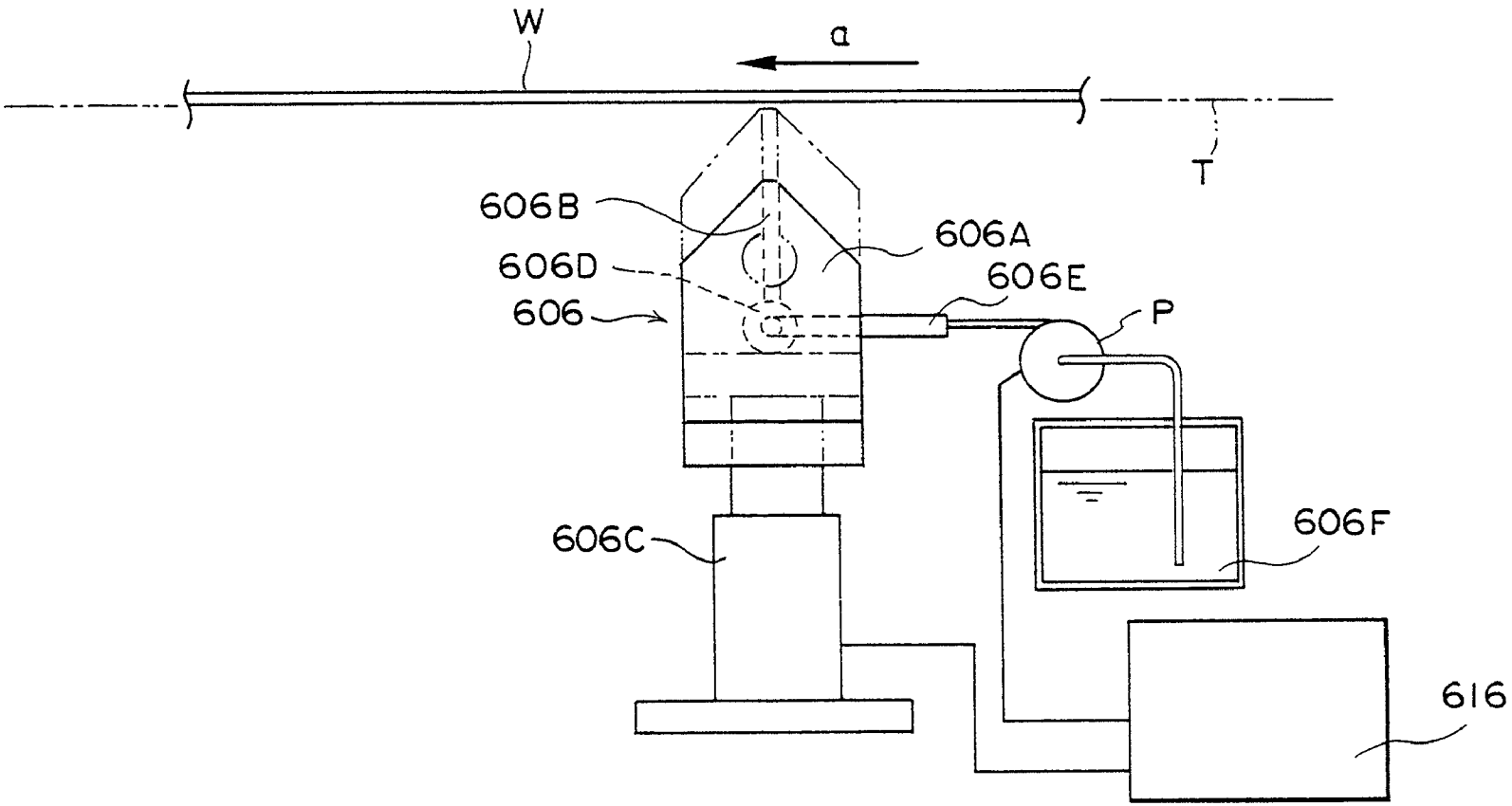
FIG. 39 is an enlarged view showing a portion of the coating apparatus shown in FIG. 36, i.e., a construction of a pre-wet liquid coater belonging to the coating apparatus.

FIG. 39 shows a construction of the pre-wet liquid coater 606. The pre-wet liquid coater 606 is provided with a coating head 606A formed in a wedge shape converging upward and along the width direction of the traveling plane T. In the coating head 606A, a pre-wet liquid discharge passage 606B is formed and opened in a slit shape at the upper end in the longitudinal direction of the coating head 606A. The coating head 606A is fixed on a lift 606C movable upward and downward by a hydraulic cylinder. Here, a pneumatic cylinder or a ball-screw type mechanism may move the lift 606C.

The pre-wet liquid discharge passage 606B communicates at its lower end with a liquid feed passage 606D for feeding the pre-wet liquid to the pre-wet liquid discharge passage 606B. The liquid feed passage 606D is connected via a liquid feed conduit 606E to a pre-wet liquid tank 606F. In the liquid feed conduit 606E, a liquid feed pump P is disposed for feeding the pre-wet liquid to the pre-wet liquid discharge passage 606B. Here, the liquid feed pump P may be replaced by a liquid feed bellows for supplying the pre-wet liquid.

The lift 606C and the liquid feed pump P are controlled by the pre-wet liquid coater control unit 616. When this pre-wet liquid coater control unit 616 outputs a command to start the coating of the pre-wet liquid, the lift 606C ascends, as indicated by double-dotted lines in FIG. 39, and the upper end opening of the coating head 606A approaches the support web W. Next, the liquid feed pump P acts to feed the pre-wet liquid, as reserved in the pre-wet liquid tank 606F, to the coating head 606A. Thus, the pre-wet liquid is discharged upward from the upper end opening of the pre-wet liquid discharge passage 606B and applied to the support web W. When the pre-wet liquid coater control unit 616 outputs the command to interrupt the coating of the pre-wet liquid, the liquid feed pump P stops to interrupt the discharge the pre-wet liquid from the upper end opening of the pre-wet liquid discharge passage 606B. Then, the lift 606C descends to bring the coating head 606A to the position, as indicated by solid lines in FIG. 39.

Figure 40:
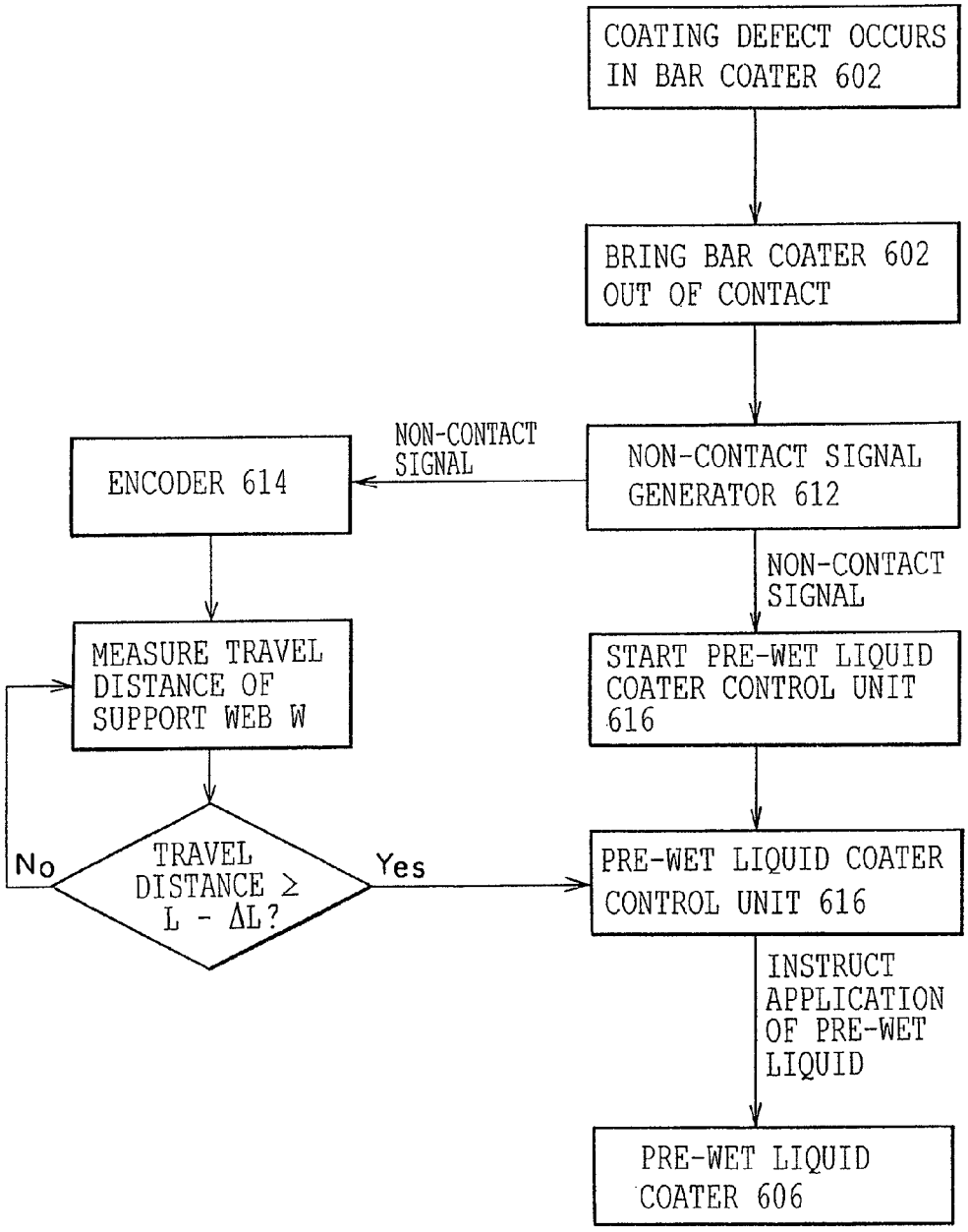
FIG. 40 is a flow chart showing a flow of the actions of the coating apparatus shown in FIG. 36 when a coating defect occurs in the bar coater.

Here will be described the operations of the coating apparatus 600. FIG. 40 shows the flow of the actions when a coating defect occurs in the bar coater 602.

When a coating defect occurs in the bar coater 602 and the uncoated portion is formed in the grained surface W2 of the support web W, the lift 602L moves the platform 602E downward to detach the bar 602A from the support web W. Then, the lift 602L sends a command to the non-contact signal generator 612 to generate a non-contact signal indicating that the bar coater is away from the web W.

In response to that command, the non-contact signal generator 612 generates and outputs the non-contact signal to the encoder 614 and the pre-wet liquid coater control unit 616.

The non-contact signal activates the pre-wet liquid coater control unit 616 automatically to be ready to receive the signal from the encoder 614.

In response to the non-contact signal, the encoder 614 measures the travel distance d of the support web W after the bar 602A of the bar coater 602 detaches from the web W. Next, the encoder 614 compares the travel distance d with a distance L from the bar 602A to the coating head 606A. When the distance d exceeds a value of (L−ΔL), the encoder 614 outputs a signal indicating the excess to the pre-wet liquid coater control unit 616. Here, the value ΔL is a length far smaller than the distance L and can be arbitrarily determined of the traveling speed of the support web W, the rate of the pre-wet liquid coater 606, and the like to respond to the pre-wet liquid coater control unit 616. When the travel distance d becomes equal to the value (L−ΔL), the uncoated portion is brought close to the coating head 606A.

In response to the signal indicating that the travel distance d is equal to the value (L−ΔL) from the encoder 614, the pre-wet liquid coater control unit 616 sends a command to the pre-wet liquid coater 606 to apply the pre-wet liquid.

When the pre-wet liquid coater 606 receives that command, the coating head 606A is elevated to approach the grained surface W2 of the support web W by the lift 606C. Then, the liquid feed pump P starts and the pre-wet liquid is discharged upward from the top portion of the coating head and applied to the grained surface W2.

The coating defect is eliminated in the bar coater 602, and the platform 602E is elevated to get the bar 602A abutted against the support web W. When the coating of the photosensitive layer forming liquid is restarted, a corresponding signal is transmitted via the non-contact signal generator 612 to the encoder 614 and the pre-wet liquid coater control unit 616.

Receiving that signal, the encoder 614 measures again the travel distance of the support web W. When the travel distance d' after the reception of the signal reaches the value L, the encoder 614 outputs a signal indicating that the travel distance d'=L to the pre-wet liquid coater control unit 616. This signal activates the pre-wet liquid coater control unit 616 to output a signal to the pre-wet liquid coater 606 for interrupting the coating of the pre-wet liquid. Receiving this signal, the pre-wet liquid coater 606 interrupts the coating of the pre-wet liquid in a procedure reversed from that of starting the coating.

When a coating defect occurs during coating the support web W with the photosensitive layer forming liquid to form the photosensitive layer L1, an uncoated portion is left in the support web W and the anodized coating film is exposed to the outside. The anti-oxidant layer forming liquid has a poor wettability to the anodized coating film, as has been described hereinbefore. No coating of the pre-wet liquid leads to repelling of the anti-oxidant layer forming liquid at the uncoated portion, and a homogeneous coating film of the anti-oxidant layer forming liquid cannot be obtained even if the coating defect in the photosensitive layer L1 is eliminated.

Figure 41A:
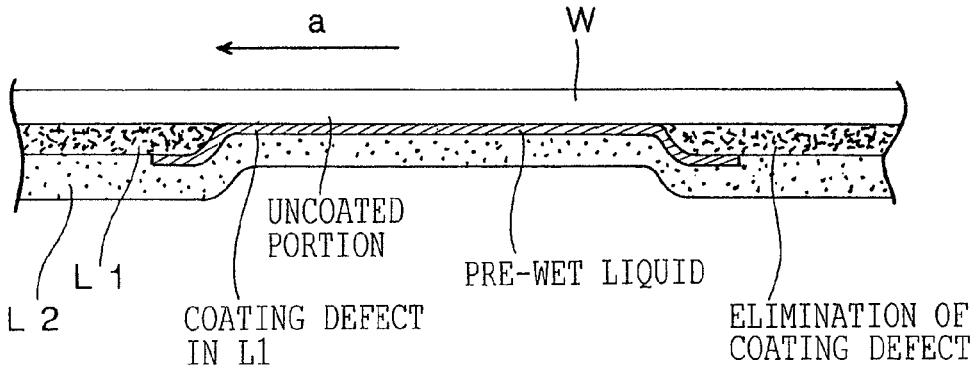
FIG. 41A is a sectional view showing the state of the coating apparatus shown in FIG. 36, in which the anti-oxidant layer is formed when a portion left uncoated occurs in the photosensitive layer while the photosensitive layer and the anti-oxidant layer are being formed in the support web, for the case in which the pre-wet liquid is coated.
Figure 41B:
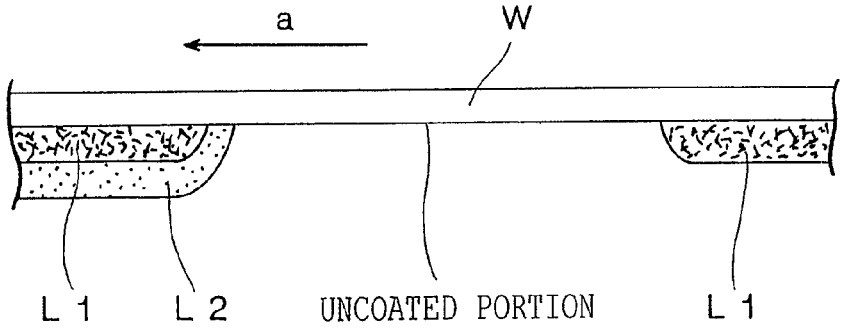
FIG. 41B is a sectional view showing the state of the coating apparatus shown in FIG. 36, in which the anti-oxidant layer is formed when a portion left uncoated occurs in the photosensitive layer while the photosensitive layer and the anti-oxidant layer are being formed in the support web, for the case in which the pre-wet liquid is not coated.

In contrast, in the coating apparatus 600 of the fourteenth embodiment, the pre-wet liquid is applied and the anti-oxidant layer layer L2 is formed without any cut even in the uncoated portion, as shown in FIG. 41A. When the coating defect in the photosensitive layer forming liquid L1 is eliminated, a coating film of a two-layered structure is stably again formed with the photosensitive layer L1 and the anti-oxidant layer L2.

Therefore, in the coating apparatus 600, even if the uncoated portion is formed in the photosensitive layer L1, neither the forming defect nor the uncoated portion is made in the anti-oxidant layer L2 to be laid over the photosensitive layer L1.

In the coating apparatus 600, moreover, the pre-wet liquid coater 606 is started with the non-contact signal indicating that the bar coater 602 has left the coating position. It is, therefore, unnecessary to provide an uncoated position detector for detecting the uncoated portion in the photosensitive layer L1.

The grained surface of the support web W is roughed and has the anodized coating film formed thereon and it is difficult to be coated with the anti-oxidant layer forming liquid or the photosensitive layer forming liquid. Despite this difficulty, the coating apparatus 600 uses the bar coater for applying the photosensitive layer forming liquid and is advantageous in that a homogeneous photosensitive layer can be easily formed substantially without defective or heterogeneous coating.

Fifteenth Embodiment

Figure 42:
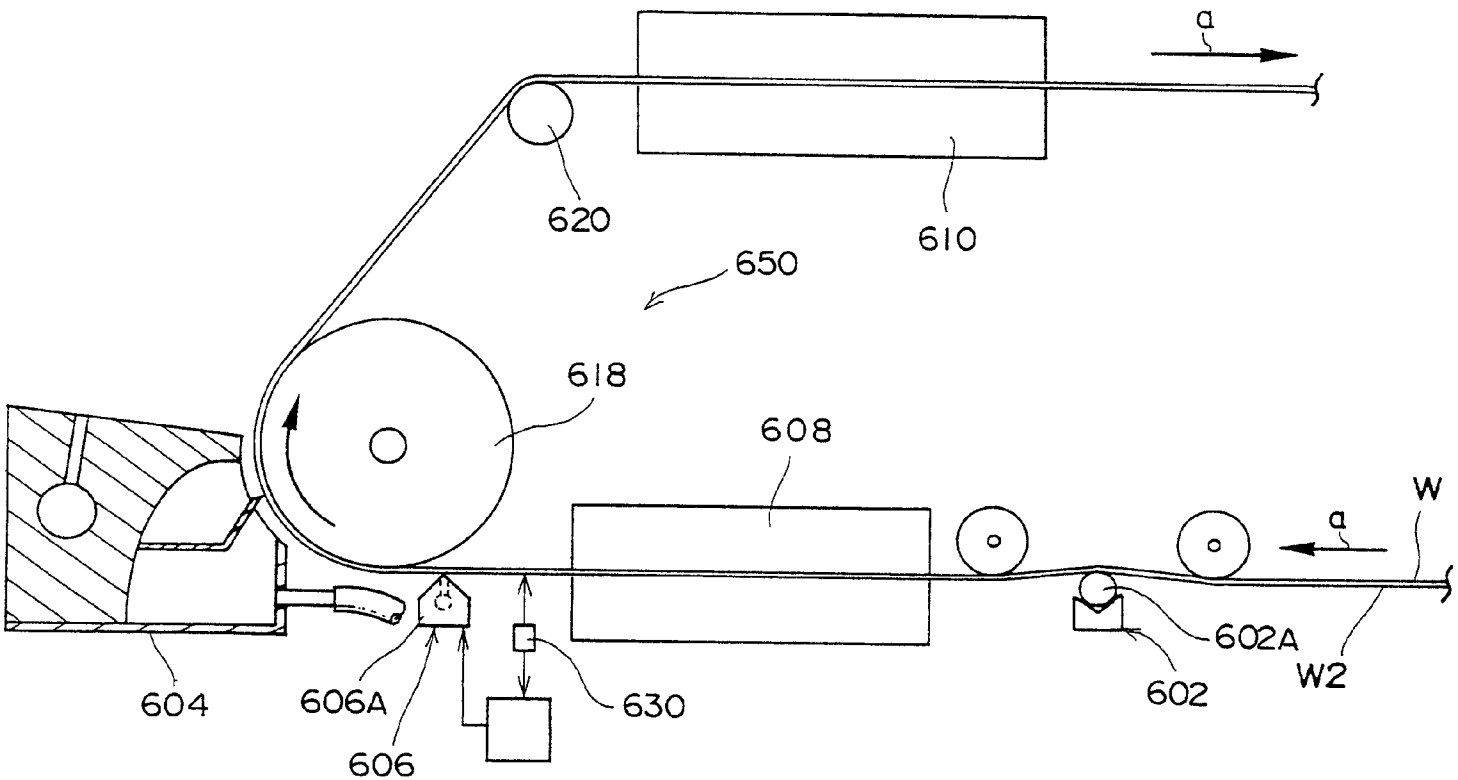
FIG. 42 is a schematic diagram showing a construction of a further embodiment of the coating apparatus for forming the photosensitive layer over the support web and the anti-oxidant layer over the surface of the photosensitive layer.

FIG. 42 shows a construction of a coating apparatus of the invention, i.e., a coating apparatus of a fifteenth embodiment for forming a photosensitive layer on a support web and an anti-oxidant layer on the surface of the photosensitive layer. In FIG. 42, the same reference numerals as those of FIG. 36 designate the components as those shown in FIG. 36.

In a coating apparatus 650 of the fifteenth embodiment, an uncoated portion detector 630 for detecting the occurrence of an uncoated portion is disposed in the vicinity of the coating head 606A between the photosensitive layer drier 608 and the coating head 606A of the pre-wet liquid coater 606.

The uncoated portion detector 630 is connected with the pre-wet liquid coater control unit 616 to output, when it detects the occurrence of an uncoated portion, a signal indicating the occurrence to the pre-wet liquid coater control unit 616.

As the uncoated portion detector 630, a light emitting/receiving element may be used, in which a light emitting element such as a light emitting diode and a light receiving element such as a photo-transistor are integrated. The light emitting element is often exemplified by one for emitting a red to infrared light.

The coating apparatus 650 has a construction similar to that of the coating apparatus 600 of the fourteenth embodiment except the aforementioned point and that the apparatus 650 is not provided with the non-contact signal generator 612 and the encoder 614.

The operations of the coating apparatus 650 will be described in the following.

The photosensitive layer forming liquid to be applied by the bar coater 602 is usually blended with not only a photosensitive resin but also various pigments or dyes and it is colored in dense green to dense blue. Therefore, the photosensitive layer L1 to be formed by coating it with the photosensitive layer forming liquid has a similar color.

Therefore, as far as the photosensitive layer L1 is homogeneously formed over the support web W, the light emitted from the light emitting element in the uncoated portion detector 630 to the photosensitive layer L1 is absorbed nearly completely by the photosensitive layer L1. Accordingly, very little light will be reflected to the light receiving element of the uncoated portion detector 630.

When a coating defect occurs in the bar coater 602 and an uncoated portion is left in the photosensitive layer L1, the metallic face of the support web is exposed. Thus, the light from the light emitting element in the uncoated portion detector 630 is so reflected by the uncoated portion as to enter the light receiving element. The uncoated portion detector 630 is enabled to detect the uncoated portion by detecting the incident light.

When the uncoated portion detector 630 detects the uncoated portion on the support web W, as has been described hereinbefore, it sends out a signal indicating the existence of the uncoated portion to the pre-wet liquid coater control unit 616. Then, this pre-wet liquid coater control unit 616 starts the pre-wet liquid coater 606 in the procedure which has been described in connection with the fourteenth embodiment. Thus, the coating head 606A applies the pre-wet liquid.

Additionally to advantages belonging to the coating apparatus 600 of the fourteenth embodiment, the coating apparatus 650 has an advantage that the detection of the uncoated portion and the application of the pre-wet liquid can be ensured by detecting the uncoated portion optically in the vicinity and upstream of the pre-wet liquid coater 606.

The coating apparatus 650 has another feature that the apparatus 650 may be structured without the non-contact signal generator 612 and the encoder 614.

EXAMPLE 12

The invention will be described more specifically in connection with Embodiment 12. By using the coating apparatus shown in FIG. 36, the photosensitive layer forming liquid was applied to the support web W to form the photosensitive layer, and this photosensitive layer was coated with the anti-oxidant layer forming liquid to form the anti-oxidant layer. The compositions of the photosensitive layer forming liquid, the anti-oxidant layer forming liquid and a later-described pre-wet liquid are enumerated in Table 3.

TABLE 3

| Type of LFL | Viscosity | Specific Gravity | Surface Tension (dyne/m$^2$) |
|---|---|---|---|
| PLFL | 0.7-2 | 0.828-0.88 | 22-23 |
| A-O LFL | 7-10 | 1.014 ± 0.002 | 30-34 |
| P-WL | 0.6-1 | 1.002 | 30-34 |

| Type of LFL | Main Components | Coating Amount (cc/m$^2$) |
|---|---|---|
| PLFL | OSS of PR | 18.75 ± 1 |
| A-O PFL | AS of PVA with F-SAA | 42 ± 3 |
| P-WL | 0.1% AS of F-SAA | 7.5 ± 0.5 |

In Table 3:

LFLLayer Forming Liquid;

PLFLPhotosensitive Layer Forming Liquid;

A-O LFLAnti-Oxidant Layer Forming Liquid;

P-WL Pre-Wet Liquid;

CA (cc/m$^2$) Coating Amount (cc/m$^2$);

OSS of PROrganic Solvent Solution of Photosensitive Resin;

AS of PVA with F-SAAAqueous Solution of PVA with Fluorine Surface Active Agent; and 0.1% AS of F-SAA0.1% Aqueous Solution of Fluorine Surface Active Agent.

When a coating defect occurred in the bar coater 602 of the coating apparatus 600 to form the uncoated portion in the surface of the support web W, the bar 602A left the coating face in the support web W. Then, the non-contact signal generator 612, the encoder 614 and the pre-wet liquid coater control unit 616 acted in the procedure, as described in connection with the fourteenth embodiment. In the pre-wet liquid coater 606, moreover, the uncoated portion was coated with the pre-wet liquid. In the face coated with the anti-oxidant layer forming liquid, the homogeneous anti-oxidant layer L2 was formed without any uncoated portion.

[Comparison 7]

As Comparison 7, the photosensitive layer forming liquid and the anti-oxidant layer forming liquid, as enumerated in Table 3, were applied by using a coating apparatus having the same construction as that of the coating apparatus 600 excepting that the pre-wet liquid coater control unit 616 and the pre-wet liquid coater 606 were omitted.

When the coating defect occurred in the bar coater 602 to form the uncoated portion in the photosensitive layer L1, the streaks or the liquid runout also occurred in the face coated with the anti-oxidant layer forming liquid, and the uncoated portion was formed. The coating defect did not disappear even after the bar coater 602 eliminated it and a homogeneous anti-oxidant layer was not formed.

Of the invention, as has been described hereinbefore, the coating apparatus and method are provided, substantially free from the coating defect in the upper layer to be laminated over the lower layer even if the coating defect occurs in the lower layer.

What is claimed is:

1. A coating method for forming a plurality of layers over a continuously traveling band-shaped substrate, comprising the steps of:

forming a lower layer by coating a first coating liquid on the continuously traveling band-shaped substrate, and forming an upper layer over the lower layer by coating a second coating liquid including a composition substantially identical to or different from a composition of the first coating liquid; and applying an undercoating liquid to an uncoated portion of the continuously traveling band-shaped substrate before coating the second coating liquid wherein the uncoated portion is generated during forming the lower layer;

wherein the undercoating liquid is a solution having a surface tension equal to or greater than a surface tension of the second coating liquid;

wherein the substrate is made of metal, plastics or paper.

2. The coating method of claim 1, wherein applying the undercoating liquid further comprises:

stopping the application of the undercoating liquid when the uncoated portion no longer exists.

3. The coating method of claim 1, further comprising:

detecting the uncoated portion when forming the lower layer, wherein applying the undercoating liquid is performed upon detection of the uncoated portion.

4. A coating method of claim 1, further comprising:

drying the lower layer wherein drying the lower layer is performed between forming the lower layer and applying the undercoating liquid.

5. The coating method of claim 1, wherein the undercoating liquid is a solution including a main solvent of the second coating liquid.

6. The coating method of claim 1, wherein the undercoating liquid is a solution including a surface active agent.

7. The coating method of claim 6, wherein the density of the surface active agent included in the undercoating liquid is substantially a micellar density or higher.

8. The coating method of claim 6, wherein the second coating liquid includes a surface active agent, and wherein the undercoating liquid is a solution including a surface active agent substantially identical to the surface active agent included in the second coating liquid.

9. The coating method of claim 1, wherein the substrate is a band-shaped metal sheet, a support web used for a planographic printing plate, a photographic film substrate, a photographic paper, a recording tape substrate, a video tape substrate, or a floppy disk substrate.

10. The coating method of claim 9, wherein the substrate is the support web used for the planographic printing plate.

11. The coating method of claim 10, wherein the coating liquid is a photosensitive layer forming liquid including a photosensitive resin.

12. The coating method of claim 10, wherein the second coating liquid is an anti-oxidant layer forming liquid including a solution of polyvinyl alcohol.

* * * * *